US009802072B2

(12) United States Patent
Wehrell

(10) Patent No.: US 9,802,072 B2
(45) Date of Patent: Oct. 31, 2017

(54) ELASTIC RESISTANT TRAINING APPARATUS AND METHODS

(71) Applicant: Michael A Wehrell, Tampa, FL (US)

(72) Inventor: Michael A Wehrell, Tampa, FL (US)

(73) Assignee: Vertimax, LLC, Tampa, FL (US)

( * ) Notice: Subject to any disclaimer, the term of this patent is extended or adjusted under 35 U.S.C. 154(b) by 0 days.

(21) Appl. No.: 14/588,892

(22) Filed: Jan. 2, 2015

(65) Prior Publication Data

US 2015/0297932 A1 Oct. 22, 2015

Related U.S. Application Data

(60) Provisional application No. 61/923,104, filed on Jan. 2, 2014, provisional application No. 61/976,721, filed on Apr. 8, 2014.

(51) Int. Cl.
*A63B 21/04* (2006.01)
*A63B 21/02* (2006.01)
(Continued)

(52) U.S. Cl.
CPC .. *A63B 21/00076* (2013.01); *A63B 21/00069* (2013.01); *A63B 21/0442* (2013.01);
(Continued)

(58) Field of Classification Search
CPC ..... A63B 21/00; A63B 21/021–21/028; A63B 21/05; A63B 21/055; A63B 21/0552; A63B 21/0555; A63B 21/0557
(Continued)

(56) References Cited

U.S. PATENT DOCUMENTS 807,670 A * 12/1905 Grabner ..... A63B 21/0552 482/129
4,685,670 A * 8/1987 Zinkin ..... A63B 21/04 482/129

(Continued)

FOREIGN PATENT DOCUMENTS

FR 2982165 A1 5/2013

OTHER PUBLICATIONS

International Searching Authority, International Search Report for corresponding PCT Application No. PCT/US15/10071 mailed Apr. 28, 2015, 1 pg.

(Continued)

*Primary Examiner* — Stephen R Crow
*Assistant Examiner* — Garrett Atkinson
(74) *Attorney, Agent, or Firm* — Duane Morris LLP

(57) ABSTRACT

An exercise apparatus and method for applying one or more lateral resistive loads to drive, swing and other phases to participants while performing complex motions at low or high speeds to condition one's body to better and more quickly perform physical movements at high speeds. Elastic members may be used to generate resistance emanating from a ground-based or vertically-positioned apparatus. The elastic members may connect to one or more body parts simultaneously. The apparatus may be mechanically designed to fully retract the elastic members into the apparatus to maintain resistance while participants are in close proximity to the apparatus. The apparatus provides a plurality of self-contained elastic members and provides participants the ability to alter the vertical and horizontal positions of each elastic member's emanation point from the apparatus. This provides ability to control applied resistance vectors between the attachment point on the participant and the apparatus.

20 Claims, 68 Drawing Sheets

(51) Int. Cl.

| | |
|---|---|
| ***A63B 21/00*** | (2006.01) |
| ***A63B 21/055*** | (2006.01) |
| ***A63B 21/16*** | (2006.01) |
| *A63B 17/00* | (2006.01) |
| *A63B 21/072* | (2006.01) |
| *A63B 23/035* | (2006.01) |
| *A63B 23/04* | (2006.01) |
| *A63B 23/12* | (2006.01) |

(52) U.S. Cl.
CPC ..... *A63B 21/0552* (2013.01); *A63B 21/0557* (2013.01); *A63B 21/154* (2013.01); *A63B 21/16* (2013.01); *A63B 21/4013* (2015.10); *A63B 17/00* (2013.01); *A63B 21/0724* (2013.01); *A63B 21/169* (2015.10); *A63B 21/4035* (2015.10); *A63B 23/03508* (2013.01); *A63B 23/03541* (2013.01); *A63B 23/047* (2013.01); *A63B 23/1209* (2013.01); *A63B 2225/107* (2013.01)

(58) Field of Classification Search
USPC ..... 482/92, 121–130
See application file for complete search history.

(56) References Cited

U.S. PATENT DOCUMENTS

| | | | | | |
|---|---|---|---|---|---|
| 4,830,365 | A * | 5/1989 | March | A63B 21/04 | 482/129 |
| 4,919,231 | A * | 4/1990 | Klokseth | A62B 1/18 | 182/5 |
| 5,468,205 | A * | 11/1995 | McFall | A63B 21/169 | 482/121 |
| 5,658,222 | A | 8/1997 | Brown | | |
| 6,042,523 | A * | 3/2000 | Graham | A63B 21/0552 | 482/121 |
| 6,220,994 | B1 * | 4/2001 | Rich | A63B 21/0004 | 482/123 |
| 6,267,711 | B1 * | 7/2001 | Hinds | A63B 1/00 | 482/121 |
| 7,179,209 | B2 * | 2/2007 | Sechrest | A63B 21/152 | 482/103 |
| 7,591,763 | B1 * | 9/2009 | Fucci | A63B 21/4029 | 482/121 |
| 7,651,450 | B2 * | 1/2010 | Wehrell | A61H 1/0229 | 482/124 |
| 7,775,936 | B2 * | 8/2010 | Wilkinson | A63B 22/0005 | 482/51 |
| 7,997,993 | B1 * | 8/2011 | Matthews | A63B 21/0442 | 473/229 |
| 8,771,155 | B1 * | 7/2014 | Bell | A63B 69/0059 | 482/124 |
| 9,056,218 | B2 * | 6/2015 | Zoltak | A63B 21/4013 | |
| 9,192,802 | B2 * | 11/2015 | Pearce | A63B 21/02 | |
| 2005/0124471 | A1 * | 6/2005 | Wilkinson | A63B 22/0005 | 482/121 |
| 2008/0300118 | A1 * | 12/2008 | Wehrell | A63B 21/04 | 482/129 |
| 2010/0130338 | A1 * | 5/2010 | Wehrell | A61H 1/0229 | 482/124 |
| 2013/0130866 | A1 * | 5/2013 | Wehrell | A63B 21/1403 | 482/5 |
| 2013/0310231 | A1 * | 11/2013 | Pearce | A63B 21/02 | 482/121 |

OTHER PUBLICATIONS

European Patent Office, Supplemental Partial European Search Report for corresponding EP Application No. 15733325 dated Aug. 4, 2017, 3pgs.

* cited by examiner

L' = Multiple X L

Equivalent Spatial Requirement With Current Art to Apply Multi-Point Loading To Throwing Motion Elastic Space Compression (View A Perspective Routing of Resistance Band 20)

(View A Perspective Routing of Resistance Band 26)

| | 3/16" Band Vol. ($Ft.^3$) | 1/4" Band Vol. ($Ft.^3$) | 5/16" Band Vol. ($Ft.^3$) | 3/8" Band Vol. ($Ft.^3$) |
|---|---|---|---|---|
| Training Distance ( 10 ft) | 0.24 | 0.24 | 0.24 | 0.24 |
| Training Distance (30 ft) | 0.54 | 0.54 | 0.54 | 0.54 |
| Training Distance (45 ft) | 0.74 | 0.74 | 0.74 | 0.74 |
| Training Distance (90 ft) | 1.2 | 1.2 | 1.2 | 1.2 |
| Training Distance (135 ft) | 1.6 | 1.6 | 1.6 | 1.6 |

| Training Distance (Ft.) | 10 ft. | 30 ft. | 45 ft. | 90 ft. | 135 ft. |
|---|---|---|---|---|---|
| 3/16" Resistance @ 0' | 2 lb. | 2 lb. | 2 lb. | 2 lb. | 2 lb. |
| 3/16" Resistance @ Half Way | 6.2 lb. | 9.6 | 11 | 17.7 | 22.2 |
| 3/16" Resistance @ Max Range | 10.4 lb. | 17.2 | 20 | 33.5 | 42.4 |
| 1/4" Resistance @ 0' | 4 lb. | 4 lb. | 4 lb. | 4 lb. | 4 lb. |
| 1/4" Resistance @ Half Way | 12.4 lb. | 19.2 lb. | 22 lb. | 35.5 lb. | 44.4 |
| 1/4" Resistance @ Max Range | 20.7 | 34.5 lb. | 40 lb. | 67 lb. | 84.8 |
| 5/16" Resistance @ 0' | 7 lb. | 7 lb. | 7 lb. | 7 lb. | 7 lb. |
| 5/16" Resistance @ Half Way | 17.4 lb. | 26 lb. | 29.5 lb. | 46.3 lb. | 57.5 lb. |
| 5/16" Resistance @ Max Range | 27.9 lb. | 45.1 lb. | 52 lb. | 85.7 lb. | 108 lb. |
| 3/8" Resistance @ 0' | 12 lb. | 12 lb. | 12 lb. | 12 lb. | 12 lb. |
| 3/8" Resistance @ Half Way | 24.5 lb. | 34.9 lb. | 39 lb. | 59.2 | 72.6 lb. |
| 3/8" Resistance @ Max Range | 37.1 | 57.7 lb. | 66 lb. | 106.4 | 133.2 |

Figure 52

Counter Clockwise cord routing in power module. Note no chord rotation before multiple extractions of the elastic member.

Excessive cord rotations will eventually cause permanent disfiguring of the elastic band and eventually cause the band to twist during retraction causing the pulleys to lock up. This is highly undesirable when training at high speeds because resistance will dissipate upon pulley lockup almost immediately causing the trainee to become unstable.

Side View Pulley Stack A & B

Top View Pulley Stack A & B

Figure 59 – Cord Twist Problem

Figure 60 – Counter Rotation

Dual Bearing Swivel Assembly

Baseline photo of cord twist before 20 extractions to 60 feet. Modified pulleys with custom grooves have been installed and counter rotation windings have been implemented with two reversals. A bearing swivel on cord end attached to athlete has also been installed.

After 20 extractions and retractions out to and back from 60 feet, the combination of custom designed pulley grooves, pulley counter rotation routing, and use of bearing swivel reduced cord twisting to almost undetectable levels as compared to the same test case shown in FIG. 55.

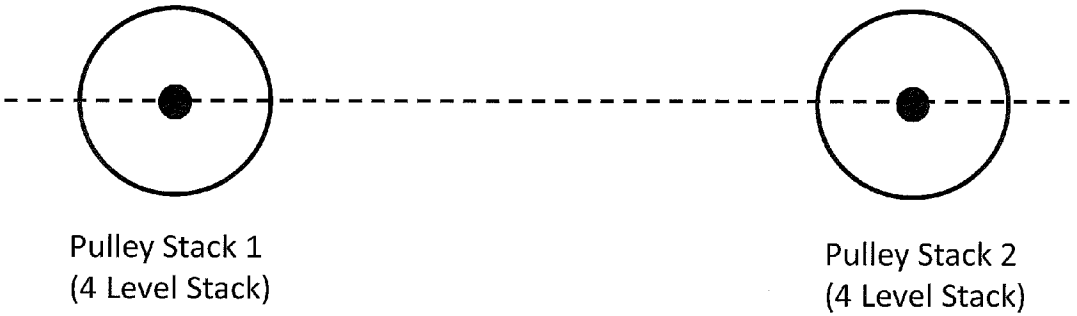
Figure 67 - Top View Pulley Stack 1 and 2
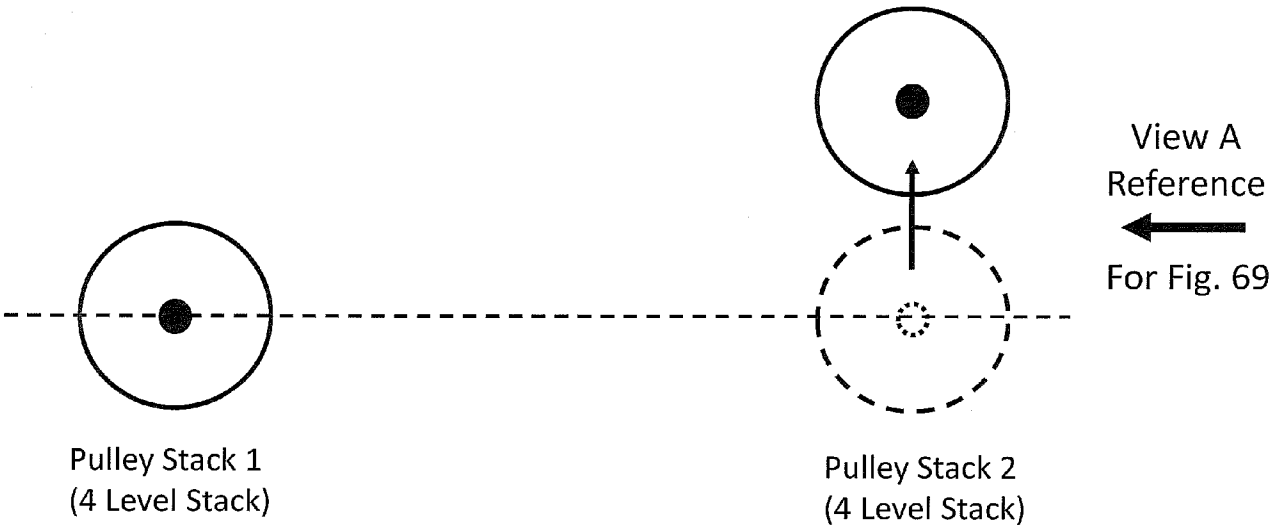
Figure 68 - Top View Pulley Stack 1 and 2 with Stack 2 shifted

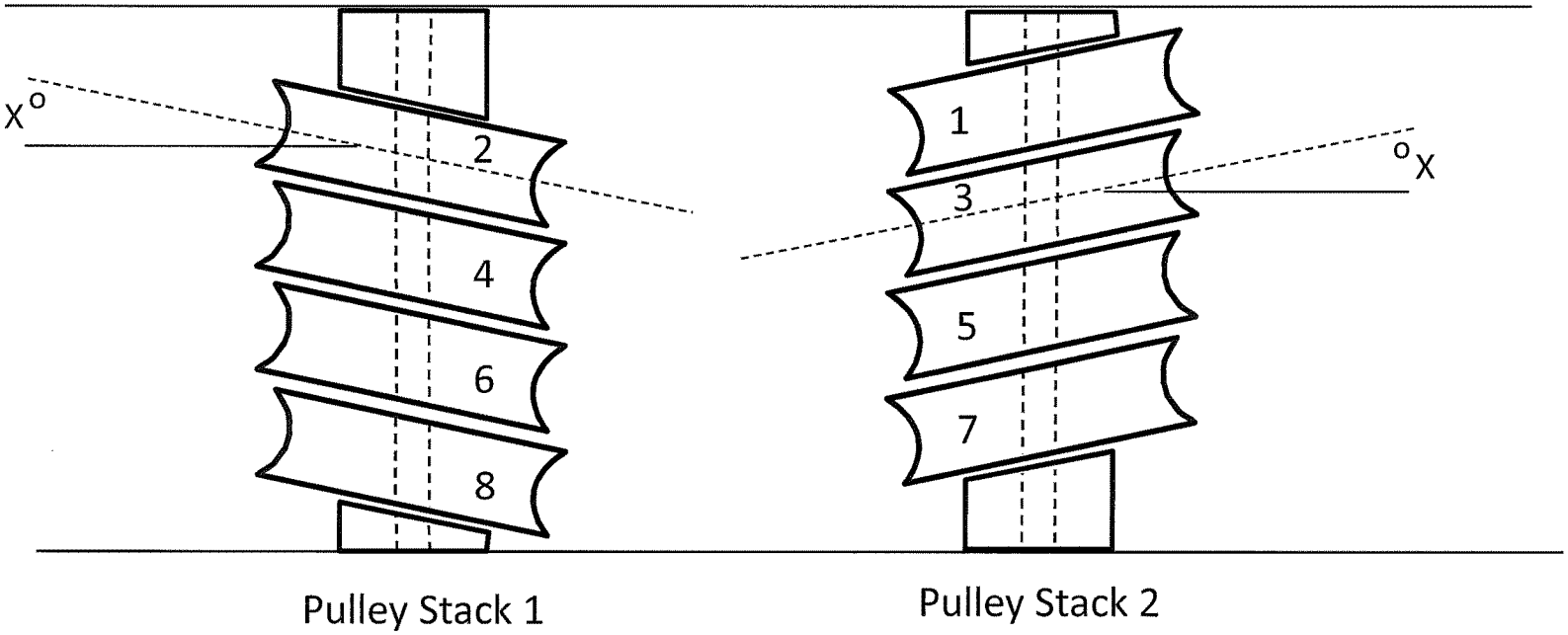
Figure 69 (As seen from View A Reference of Fig. 68 )

Pulley Stack 1 & 2 Aligned

Alternate Embodiment

ELASTIC RESISTANT TRAINING APPARATUS AND METHODS

CROSS-REFERENCE TO RELATED APPLICATIONS

This application claims priority under 35 U.S.C. §119(e) from U.S. Provisional Patent Application Ser. No. 61/923,104 filed Jan. 2, 2014, the entirety of which is hereby incorporated by reference herein. This application also claims priority under 35 U.S.C. §119(e) from U.S. Provisional Patent Application Ser. No. 61/976,721 filed Apr. 8, 2014, the entirety of which is hereby incorporated by reference herein.

BACKGROUND

The present disclosure relates to apparatus and methods for applying resistance to the movement of a trainee using elastic resistance bands. More specifically, the present disclosure relates to such apparatus and methods where the resistance to the trainee increases substantially linearly while the trainee moves at distances from one to nearly one-hundred fifty feet.

Elastic resistance bands are becoming more popular for use in athletic training, physical rehabilitation and general fitness for people of all ages. Elastic resistance has many benefits with the most prominent being the fact that an elastic band can generate many times its weight in resistance and it can bend to compactly fit into very small spaces. Thus, elastic bands are an easily portable exercise means to provide resistance to human training movements when one end of an elastic band is attached to a trainee and the other end is anchored to a fixed object or opposing body part. Though elastic bands have a resistance to weight ratio that can be hundreds of times greater than that of metal weight plates, the increase in the resistance of the band over the distance the band is stretched may be a significant drawback that limits the usefulness of elastic bands to trainees. Most often the increase in resistance as the elastic band is stretched is considerably greater than desired by the trainee.

The shorter the band is in its contracted state the greater the percent increase in resistance will be as a function of distance stretched. For example, if you take a one foot long, one quarter inch thick elastic band and anchor one end to a wall and hold the opposite end exactly eleven inches from the wall, the band provides no resistance because the twelve inch band is slack. However, if you stretch the twelve inch band one hundred percent (100%) out to 24 inches the resistance will go from 0 to about 10 pounds. If you stretch the band to two hundred percent of the slack length of the band of 12 inches out to 36 inches, the resistance will increase 150% to about 25 pounds. If you stretch the band to three hundred percent of the slack length out to 48 inches, the resistance will increase 200% increase to about 50 pounds. The resistance required to stretch an elastic band increases exponentially as the stretched length becomes a larger percentage of the slack length of the elastic band. The exponential increase in resistance as a function of distance stretched may be detrimental to many training applications.

In many applications, it is desirable to minimize the increase in the resistance applied to a trainee by one or more elastic bands over the length of a training path. The present disclosure presents a light weight portable apparatus that includes elastics that can apply resistance to a trainee within an inch of the apparatus (mimicking a resistance band less than 1 inch long) and then be stretched great distances out to 10, 50, 100 and even in excess of 120 feet before resistance begins to increase nonlinearly. In one aspect of the present disclosure, it is difficult for the trainee to perceive an increase in applied resistance over any incremental 10 foot length that the elastic band is stretched thus providing broad, effective and safe training benefits for physical rehabilitation and athletic training.

Two important limitations associated with conventional elastic bands are described below. First, when elastic bands are used in physical rehabilitation settings, often the angle of resistance acting on the patient's limb for which the elastic is attached is critical during the exercise movement. This requires the point of origin or anchor point of the elastic band to be in close proximity to the patient forcing the physical therapist to use a relatively short elastic bands to maintain the proper angle of resistance while performing the exercise. Unfortunately utilizing a short band as explained earlier, will cause the resistance to increase dramatically through the range of motion from start to finish. Most often, the resistance is not enough at the start of the exercise movement and far too great at the end of the exercise movement. It is very difficult for doctors to estimate the start resistance and finish resistance in these cases and the patients recovering from joint surgery utilizing the bands often cannot complete the full range of the desired exercise movement due to the excessive increase of resistance across the range of movement.

FIGS. 1 and 2 illustrate respectively the start and stop position of a common shoulder exercise where the hand starts across the body at the lower left (FIG. 1) and rises to the upper right at a 45 degree angle (FIG. 2). Therapist typically desire to apply resistance at a 45 degree angle throughout this movement from the trainee's lower left to upper right. To accomplish loading the movement at a 45 degree angle the therapist has no choice when using an elastic band but to anchor one end near the patient at point A as shown in FIGS. 1 and 2. In order to apply loading at the beginning of the movement a very short elastic band ($EB_{Short}$) is required based on the position of the necessary anchor point A and the fact that the band has to be taut at the start of the exercise movement. Thus the unstressed length of the elastic band must be less than length D. When comparing the distance $DS_1$ which is the length of the exercise movement to the length of the elastic resistance band which is less than D, it is readily apparent that the exercise band must stretch multiple times its length from the start to finish of the exercise movement ($DS_1$=D'−D>>D). As previously explained, stretching an elastic band even 100% of its length will result in a dramatic increase in resistance from the start to finish of the exercise movement for any conventional elastic training band. For the particular exercise shown in FIGS. 1 and 2, getting to the FIG. 2 position with a resistance 2 to 5 times greater than the starting resistance in FIG. 1 is extremely difficult if not impossible for many trainees to do, especially those trying to rehab after shoulder surgery when the shoulder is weak.

This problem of undesired large resistance variations over the range of an exercise movement is well known among physical therapists and sports trainers and they can only avoid the problem by using a resistance band that applies too little load at the start of the exercise but can apply the desired load at the end of the range of movement. Most physical therapists prefer stable non-varying loading through range of motion but as just explained, if they wish to use elastic bands they must usually significantly under-load the start of a movement using a longer band in order to minimize the increase in resistance as the trainee stretches the band and attempts to complete the exercise movement. This loading differential through the range of the exercise movement is most often not desired but it cannot be helped if conventional elastic bands are the choice of exercise resistance.

To avoid the problem illustrated in FIGS. 1 and 2 utilizing elastic bands, a much longer resistance band would be required so that the distance covered during the exercise movement would be a smaller fraction of the exercise band's unstressed natural length. However, referencing FIGS. 3 and 4, if a much longer band is utilized, in order to have resistance applied at the start of the movement in FIG. 3, the trainee would have to be placed on a pedestal P to elevate the trainee high enough to make the elastic band $EB_{Long}$ taut at the start of the exercise but also keep the desired resistance angle illustrated in FIGS. 1 and 2. Now the same exercise distance traveled from the start to finish of the exercise movement $DS_1$ of FIG. 4, is a much smaller percentage of the overall band length E of $EB_{Long}$ shown in FIG. 3. The significantly longer elastic band $EB_{Long}$ used in the training configuration of FIGS. 3 and 4 would present the Trainee with a significantly smaller change in exercise resistance from the start to finish of the exercise movement between FIGS. 3 and 4 since the $DS_1$ distance is a small fraction of the $EB_{Long}$ length vs multiples of the $EB_{short}$ length in FIG. 1.

FIGS. 5 and 6 illustrate how one aspect of the present disclosure obviates the problems described with reference to FIGS. 1-4. The module 1 includes one or more long elastic bands 26 in a compact portable unit such that the present disclosure could route said band to the trainee through routing assembly 27. The module 1 is capable of pre-loading elastic band 26 so that the trainee feels the desired training resistance when positioned as illustrated in FIG. 5. The relative length $EB_R$ of the elastic band 26 extending between mechanism 27 and the trainee's hand is about the same length D as the elastic band $EB_{short}$ used in FIGS. 1 and 2. However, the Effective band length $EB_{EFFECTIVE}$ may be ten (10) to sixty (60) times greater than $EB_R$ or length D in FIG. 1, Hence the exercise travel distance $DS_1$ shown in FIGS. 2, 4 and 6 would be a much smaller percentage of the effective band length $EB_{EFFECTIVE}$ which is actually a band whose physical length is 10 to 60 feet long. The combination of the extended length band 26 and the mechanical innovations carried by module 1 provides a resistance variation so minimal that the trainee would not be able to perceive a change in resistance over the exercise range denoted by $DS_1$ in FIG. 6. The minimization of resistance variations over short and long training ranges presents a novel and beneficial improvement in elastic band training technology that solves the significant problems with the use of conventional elastic bands.

The problem of excessive resistance variations over the distance traveled during the training movement can be illustrated in many exercises. FIGS. 7 and 8 illustrate an exercise training movement which requires the trainee to load their arm while bringing their arm down and across their body from an overhead extended position. For such an exercise to maintain the angle of desired resistance an elastic band EB of length L would have to be anchored to a structure C in the position shown in FIG. 7. Stretching EB to length L' represents a length significantly greater than L which would inherently cause a significant resistance differential in force applied by EB between hand positions illustrated in FIGS. 7 and 8. A significant number of people from an average sample set of any populous group would actually not be able to complete the exercise movement for the shown configuration if a starting resistance of 10 pounds was present in FIG. 7 and then having the trainee subjected to an increase in resistance resultant from the band being stretched about 400% of its natural length as illustrated in FIG. 8.

Referencing FIG. 9, the present disclosure would eliminate the resistance variation problem illustrated in FIGS. 7 and 8 by providing physical and mechanical means with module 1 and elastic band 20 which is routed through routing assembly 21 to provide an elastic training element with an effective length of 2 to 10 times the length of L' as illustrated in FIG. 10. Hence the resistance variation over the exercise movement range of L' illustrated in FIG. 9 utilizing the present disclosure will be nearly undetectable to the Trainee because the stretch distance L' of band 20 is a fraction of the effective length of band 20 compared the variation of resistance experienced in the FIGS. 7 and 8 configuration where the stretch distance L' is multiples of the natural band length of band EB which is less than length L in FIG. 7.

FIGS. 11 and 12 illustrate a highly popular exercise conducted by athletes to train the hip flexor muscle used to lift the leg while running. With conventional elastic means this exercise can only be performed by strapping a short elastic band between the ankles and anchoring each end of the elastic band to an ankle harness strap. When performing explosive athletic training drills it is very important that the muscles are loaded at the start of the movement as opposed to the load being applied after 40% to 60% of the training movement is completed. Referencing FIG. 11 it is clear that the elastic band EB1 anchored to each ankle with AS1 and AS2 respectively will be slack and not apply any resistance or a useful magnitude of resistance at the start of the exercise movement at the moment the foot begins to leave the ground. In fact it is a well-known among sports trainers that with this particular exercise, there will be no useful load applied by EB1 on the AS2 ankle strap until the knee has completed approximately 50% of the exercise movement which is half the distance between the left knee position in FIG. 11 and FIG. 12. This means half of the training movement will be performed with no load. This is not a desired loading characteristic when performing the majority of training movements for athletic training or rehabilitation purposes.

FIGS. 13 and 14 show illustrate one aspect of the present disclosure for providing resistance to a trainee. The module 1 carries elastic bands 20,26 which are routed through routing assemblys 21, 27 to the trainee. When the exercise movement is initiated, the trainee will feel a constant load from the instant the foot begins upward movement right through the high knee position illustrated in FIG. 14. Additionally, as FIG. 15 illustrates, with an effective length of thirty (30) feet for each band 20,26 in FIGS. 13 and 14, it would take two 30 foot long conventional bands anchored in the ground and placing the trainee on a 25 foot pedestal with both bands pre-loaded to simulate the load placed on the trainee by the apparatus of the present disclosure through the range of movement in FIGS. 13 and 14. Due to the internal routing of additional elastic band length in module 1 for both bands 20 and 26, the effective length of each band would be many times the distance of movement represented by the difference in the left ankle position of FIGS. 13 and 14. Since the distance traveled by the left ankle would be a small fraction of the total band length 20 or 26, the trainee will not be able to detect any change in applied resistance while raising or lowering either foot. This is a novel and beneficial improvement that modifies how elastic bands interact with trainees to eliminate large resistance variations throughout the exercise movement while providing the ability to set the direction of applied resistance while in very close proximity to the effective anchor point of the elastic member opposite to the end attached to the Trainee.

When loading the throwing or pitching movement it is critical that resistance levels stay at a minimum (under 3 pounds) and not increase notably from the thrower's perspective so that their arm movement can both complete a natural throwing motion and so that they are not destabilized in the middle of the throwing motion by a rapidly increasing resistance. FIG. 16 shows elastic bands B1, B2, B3 and B4 of approximate length 30 feet would be required to minimize resistance increases throughout the throwing movement. However, to apply resistance from the proper angles the athlete would have to be elevated about 15 feet high on pedestal P and 30 feet from the elastic band anchor points on wall B to load the limbs properly. This is not a practical set up and that is why pitchers use very short bands to exercise their throwing arms and because short bands are used, they rarely if ever load high speed throwing motions with elastics.

FIG. 17 shows how one aspect of the present disclosure would effectively apply similar loads of the 30 foot bands in FIG. 16 but compress the required space by effectively shifting wall B to position B' within inches of the thrower. FIG. 18 illustrates how the spatial compression is achieved by attaching two of the present disclosures 1A and 1B on structure 20. Bands 20 and 26 from each unit are routed by routing assemblies 21 and 27 to attachment points 40, 41, 42 and 43. Both FIGS. 16 and 18 training setups apply resistance with minimal increases throughout the throwing motion but the present disclosure will minimize the required space for the exercise and allow a practical exercise configuration relative to FIG. 16.

Since exercise bands with ¼" diameters and larger can be stretched from 100% to 200% of their natural length, the present disclosure's ability to route significant quantities of elastic bandage within the confinements of module 1, a trainee will now have the ability to begin running within inches of a base support structure and cover over 40 yards while having their leg drive and recovery phases loaded simultaneously. FIG. 19 shows how the module 1 may be attached to support structure 20 with resistance bands 20 and 26 routed to the trainee through routing assemblies 21 and 27 and finally attached behind the knees with harness 204. Attaching the bands behind the knees as opposed to the waist allows all the relevant muscles in the legs to be loaded and trained when the leg is on the ground driving (Drive Phase) and when the leg breaks contact with the ground and is propelled through the air forward for the next ground strike (Recovery Phase). All other conventional training systems attaching resistance to the waist which will only load the Drive Phase and neglect training important muscles required to propel the leg through the air after it breaks contact with the ground. With the present disclosure Sprinters can now have useful resistance applied directly to the drive and recovery phases be within inches of the support structure 20 (FIG. 19) and be able to accelerate out past 40 yards achieving much higher training velocities on both the Drive and Recovery phases which has never been achievable with conventional elastic training means. It has been proven that the ability to train at higher velocities with resistance enables athletes to develop power that can be deployed at higher velocities thus providing an advantage improving high speed performance over conventional elastic methods which can't facilitate the higher training velocities the present disclosure can.

The apparatus and methods of the present disclosure obviate the deficiencies found in the prior art. The present disclosure provides novel mechanical apparatus with the ability to minimize increase in applied force of one or more individual elastic bands as the bands are stretched by the trainee from distances of less than one inch to nearly 150 feet. In one aspect, the apparatus of the present disclosure is portable and can be anchored to any suitable support structure on a permanent or non-permanent basis. The invention may comprise a module carrying an enclosed pulley system with multiple elastic bands. The module may be anchored various structures such as a chain link fence, pole or exercise equipment structure such as a squat rack. The points of origin of the resistance vectors that are applied to the trainee by each of the elastic bands may be easily positioned by the user with a Vector Origination Attachment Mechanism (VOAM). The VOAM may be connected to the module may be removable from the module for connection to another structure. If the base module of the apparatus is attached to a chain link fence the VOAM may be designed to clip onto any point on the chain link fence. The elastic bands are routed from the module though the VOAM to the trainee to provide resistance to the trainee.

BRIEF DESCRIPTION OF THE DRAWINGS

FIG. 52 is a chart for training distance

FIG. 67 shows a top view of two pulley stacks

FIG. 68 shows a top view of two pulley stacks in FIG. 67 shifted to the right FIG. 69 illustrates two pulley systems

DETAILED DESCRIPTION

With reference to the figures, like elements have been given like numerical designations to facilitate an understanding of the present disclosure which has multiple embodiments.

Figure 21:
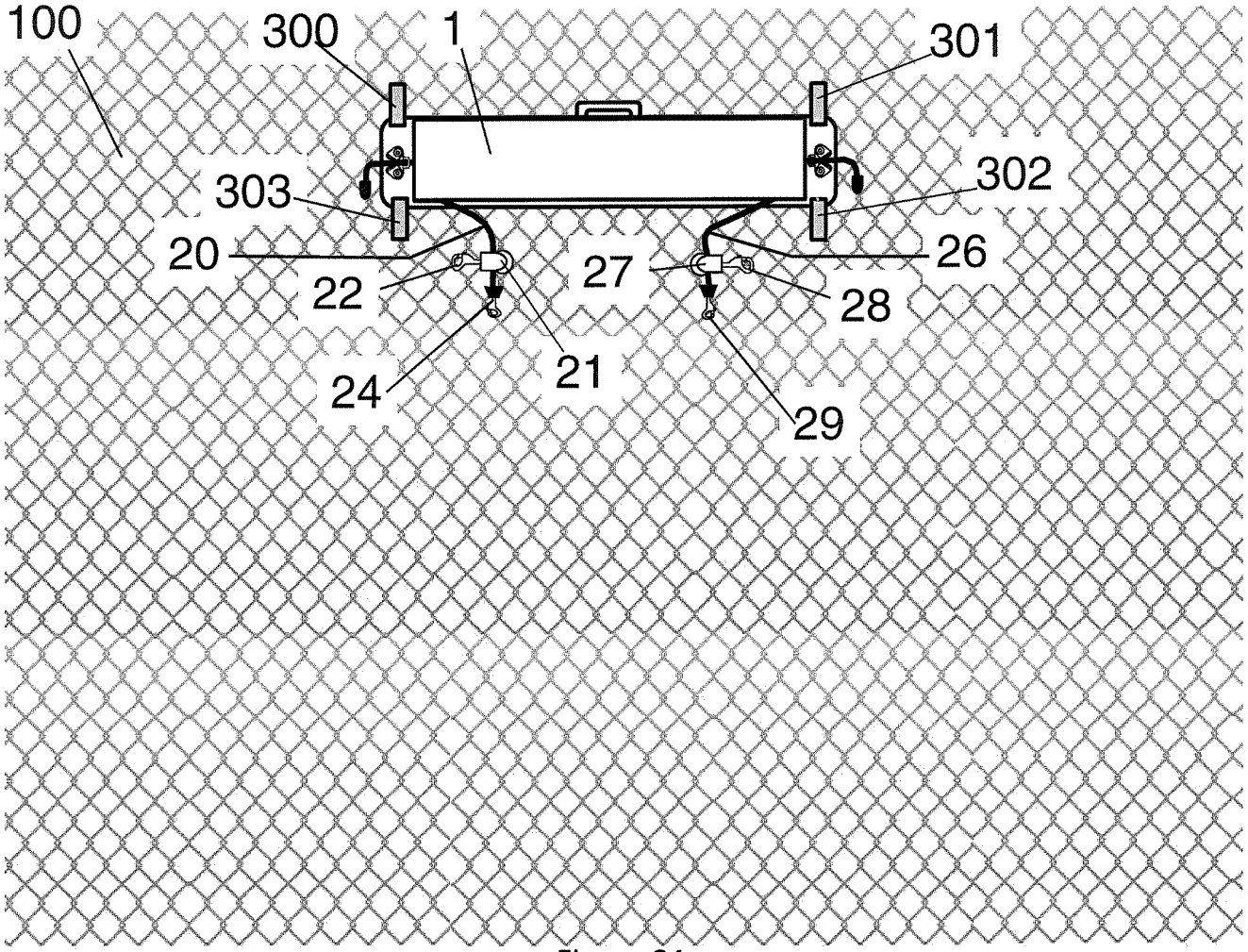
FIG. 21 is a front view of the training module on chain link fence

In one aspect, multiple units may be attached to support structures to provide from one to dozens of resistance bands for one or more trainees to utilize. FIG. 21 illustrates one module 1 of the present disclosure attached to support structure 100 (for example, a chain link fence). Other possible structure may include a wall, floor, squat rack or sled. The module 1 is attached to support structure 100 using conventional attachment means 300, 301, 302 and 303. Resistance band 20 is routed through VOAM 21 which attaches to support 100 by conventional means such as clip 22. The VOAM 21 provides the point of origin of the resistance vector provided by band 20 to the trainee. An attachment means 24 (such as a conventional clip) is adapted to be attached to a harness worn by the trainee.

Resistance band 26 is routed through VOAM 27 which attaches to support 100 by conventional means such as clip 28. The VOAM 27 provides the point of origin of the resistance vector provided by band 26 to the trainee. An attachment means 29 (such as a conventional clip) is adapted to be attached to a harness worn by the trainee.

Figure 22:
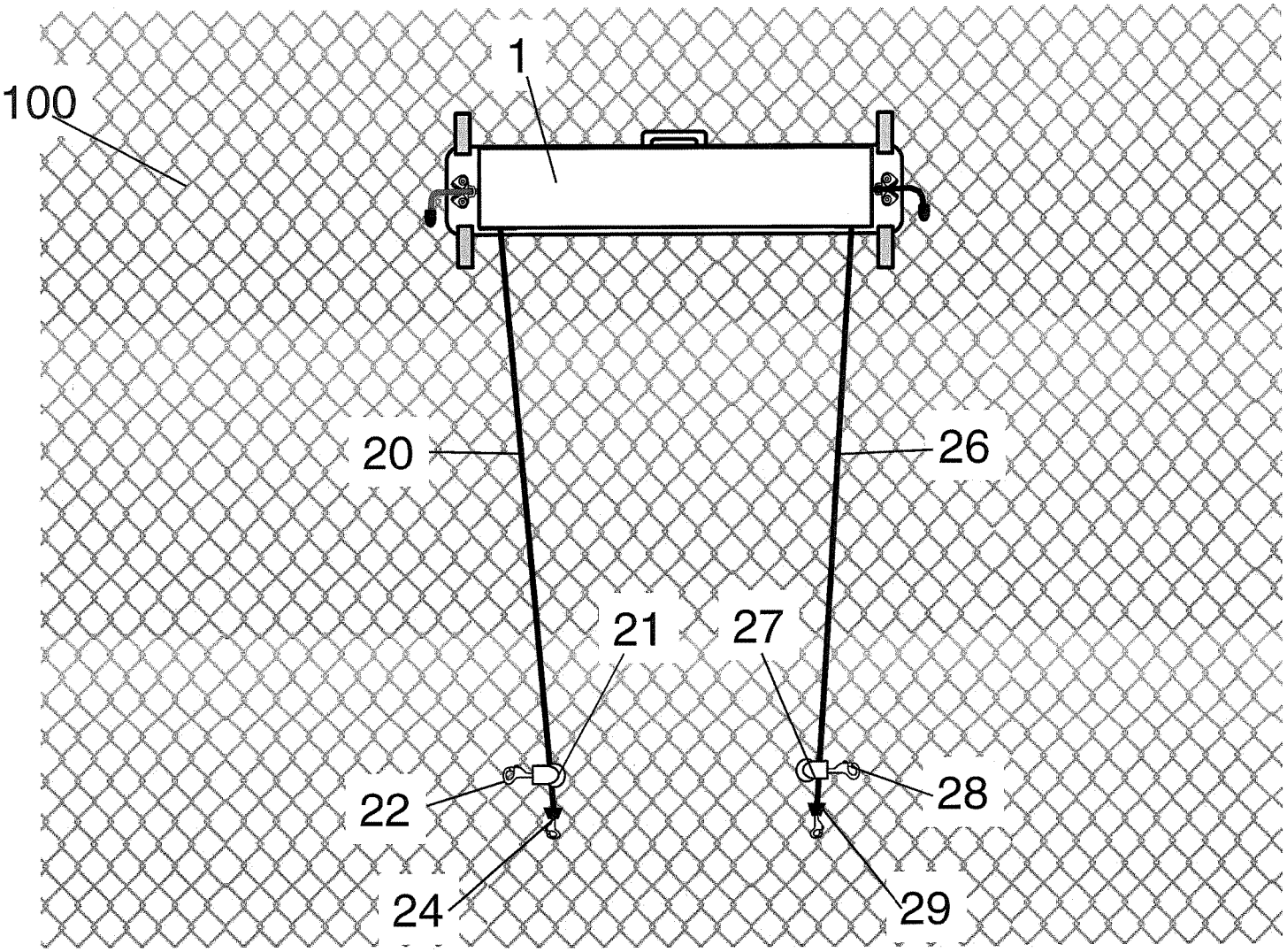
FIG. 22 is a front view of the training module showing bands extended with clips in a vertical position on chain link fence
Figure 23:
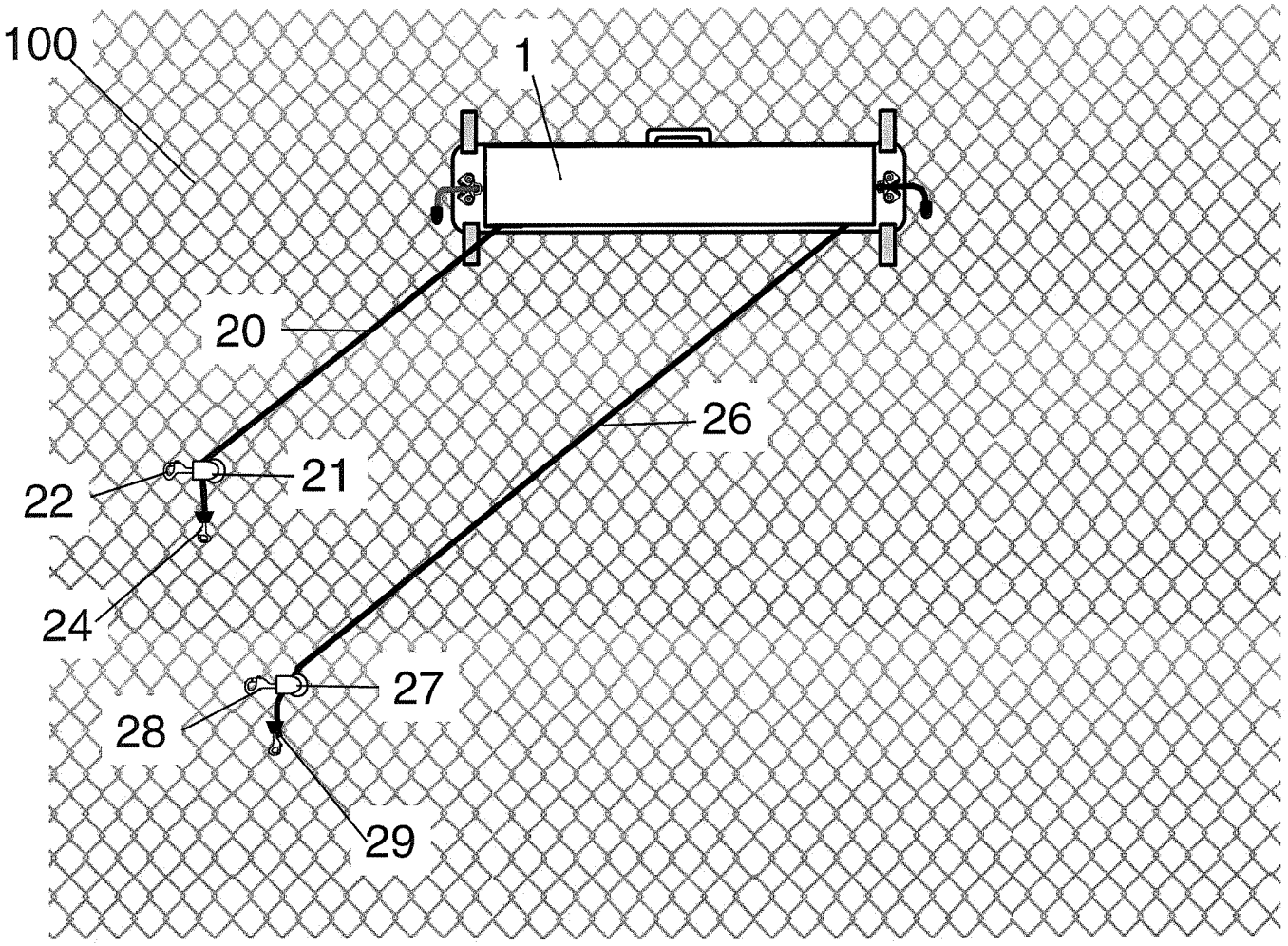
FIG. 23 is a front view of the training module showing bands extended with clips in a horizontal position on chain link fence

FIGS. 22 and 23 illustrate how the VOAMs 21 and 27 may be positioned to change the horizontal and vertical positions of the origin of the resistance vectors allowing the trainee to select the horizontal and vertical elevation from which the resistance vectors will originate.

Figure 24:
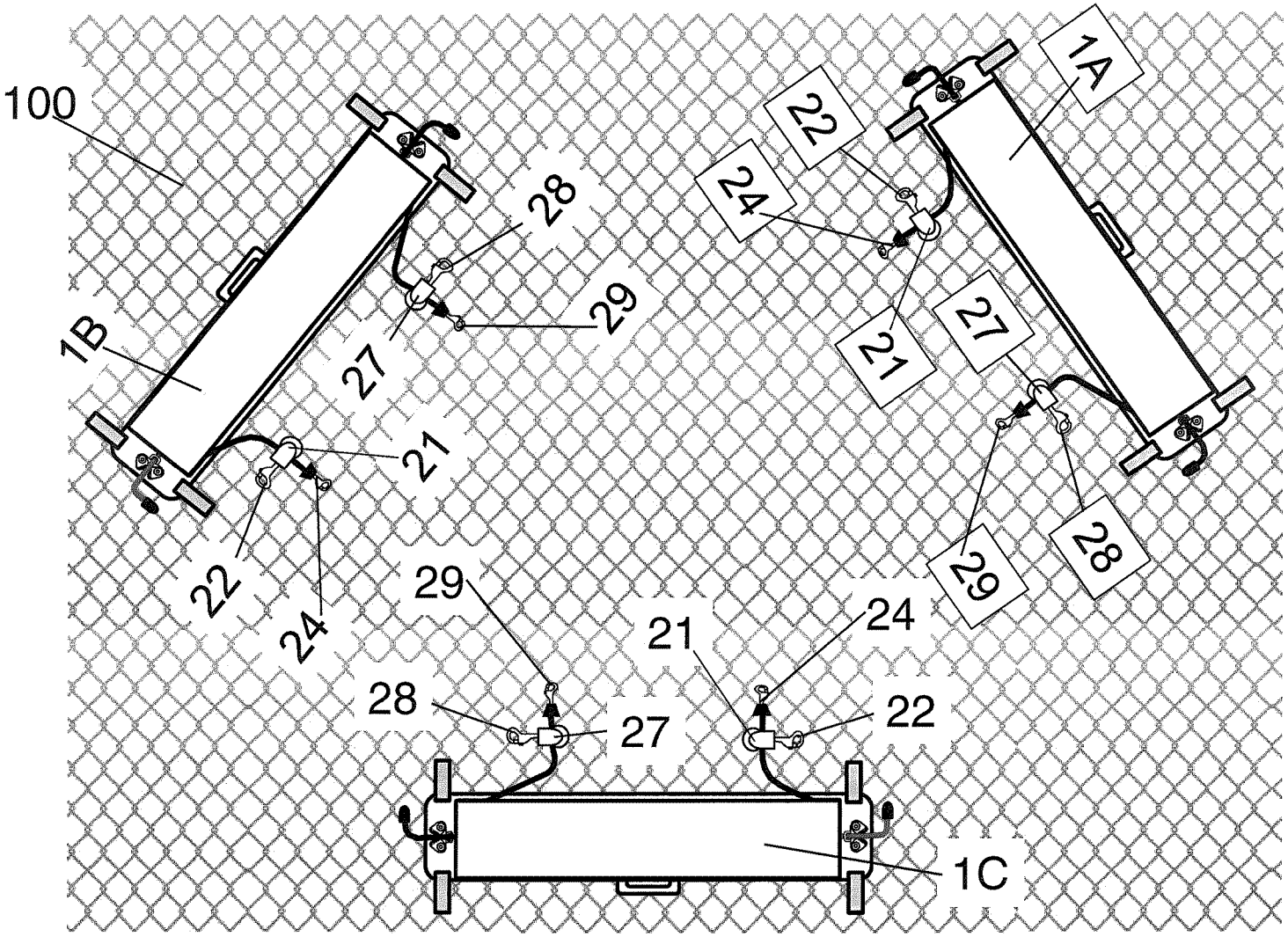
FIG. 24 is a front view of three training modules on chain link fence

FIG. 24 illustrates how three modules 1A, 1B and 1C may be positioned in close proximity in multiple orientations to provide multiple resistance bands to one or more trainees.

Figure 25:
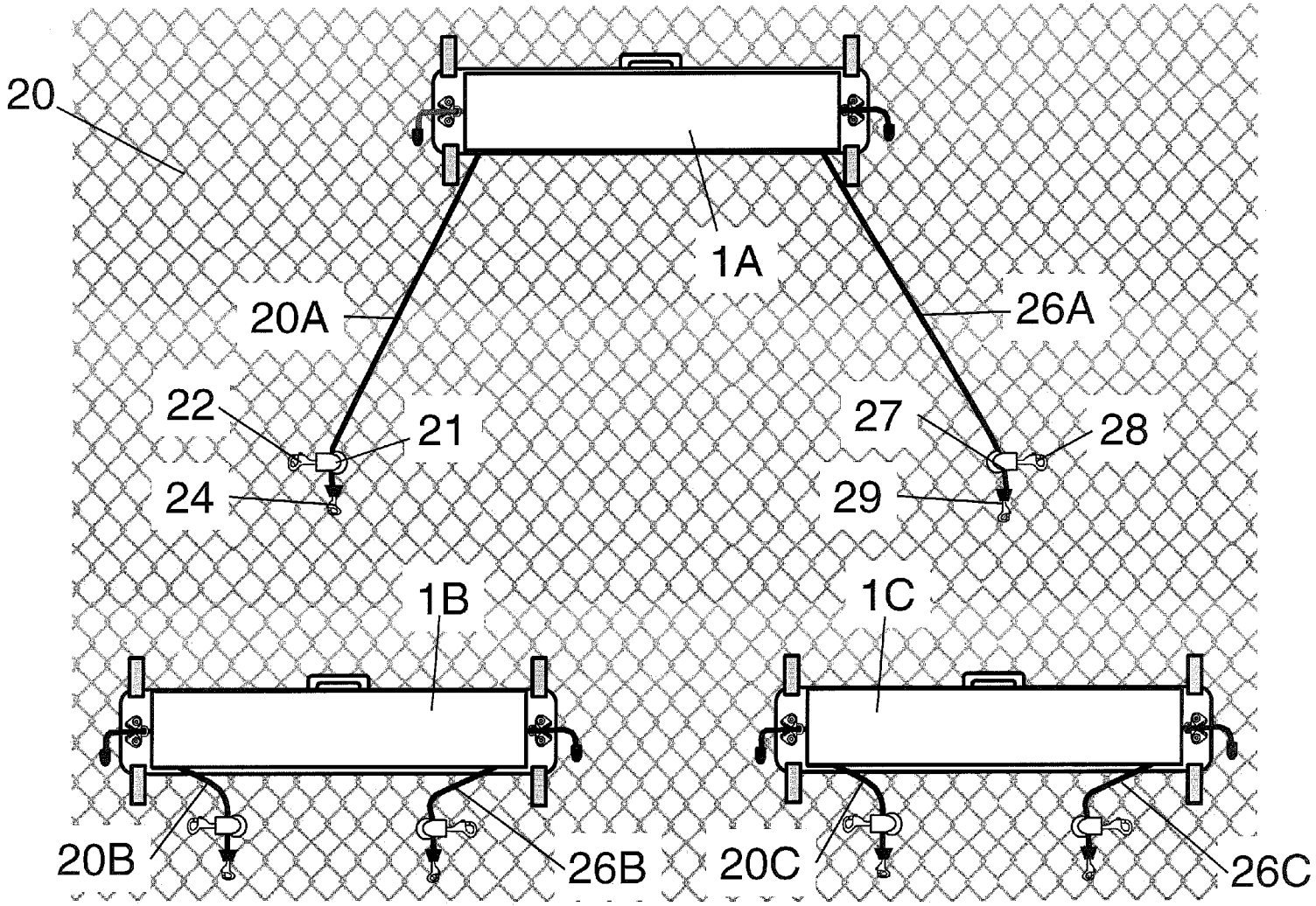
FIG. 25 is another front view of three training modules in a different position than FIG. 24
Figure 26:
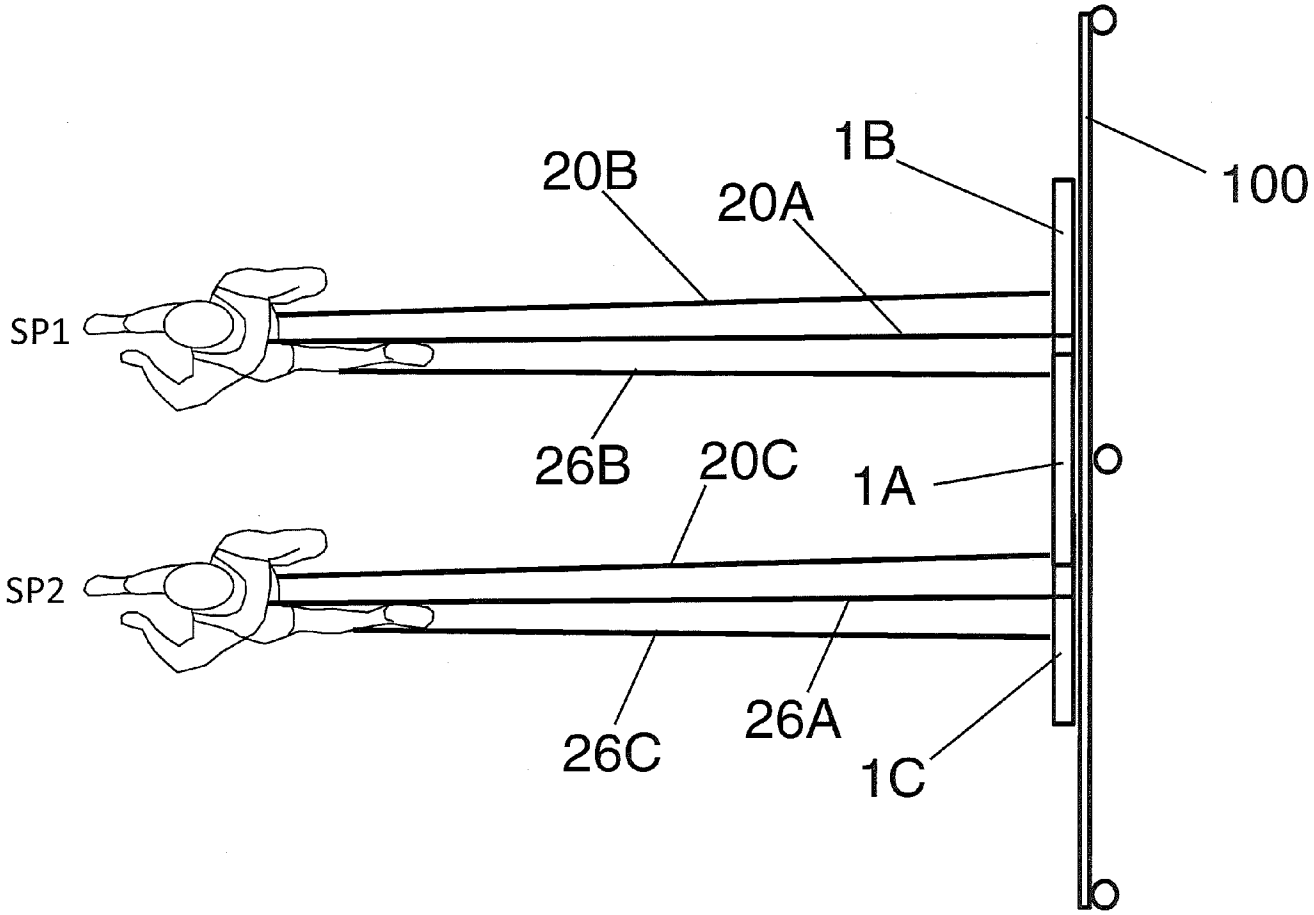
FIG. 26 is a top view of two trainees in a running exercise

FIG. 25 illustrates a three module configuration 1A, 1B and 1C that would provide three resistance bands to each of two sprinters SP1 and SP2 loading at the waist and rear side of both knees. FIG. 26 illustrates how bands 20A and 26A from module 1A would attach to the waist of Sprinters SP1 and SP2 respectively while module 1B's bands 20B and 26B would attach to the right and left leg respectively of sprinter SP1 while module 1C's bands 20C and 26C would attach respectively to sprinter SP2's right and left leg.

Figure 27:
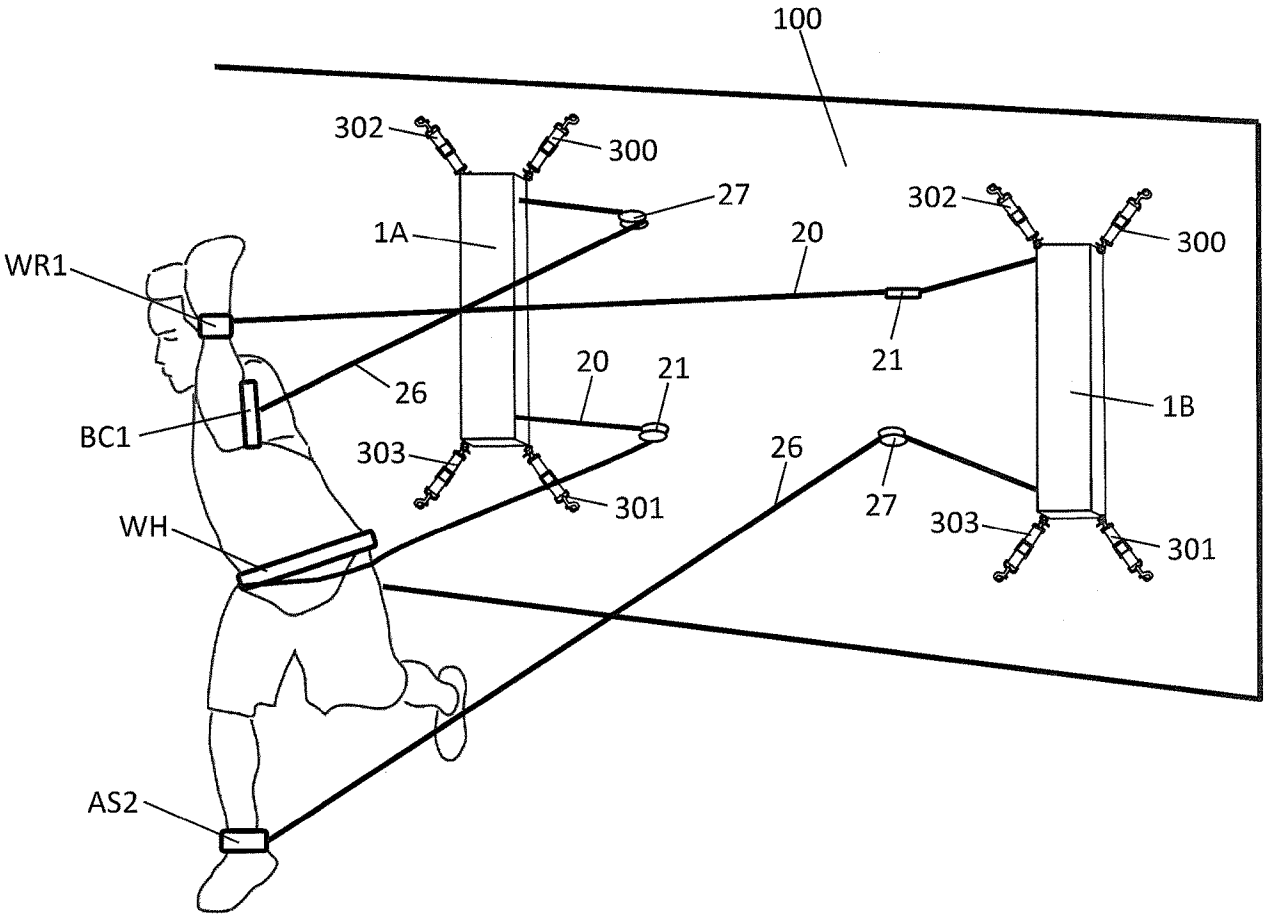
FIG. 27 is a trainee in a pitching exercise

FIG. 27 illustrates how two modules 1A and 1B can utilize respective resistance bands to load a pitcher's throwing motion at full speed. Resistance band 26 from module 1A attaches to the left bicep using attachment harness BC1 while band 20 from module 1B attaches to the left hand using attachment harness WR1. Module 1A band 20 attaches to the right hip of the trainee using attachment harness WH while the final band 26 from module 1B attaches to the right ankle using attachment means AS2. The use of resistance bands that apply approximately 2 pounds of resistance through the full range of the throwing motion enables pitchers and throwers to conduct this drill with proper throwing form at high speed since the highly stable resistance does not disrupt the thrower's balance and form while throwing. This module configuration on support structure 100 can also be used to attach multiple resistance bands to a bat at different locations along the bat to dynamically load the swinging motion.

Figure 28:
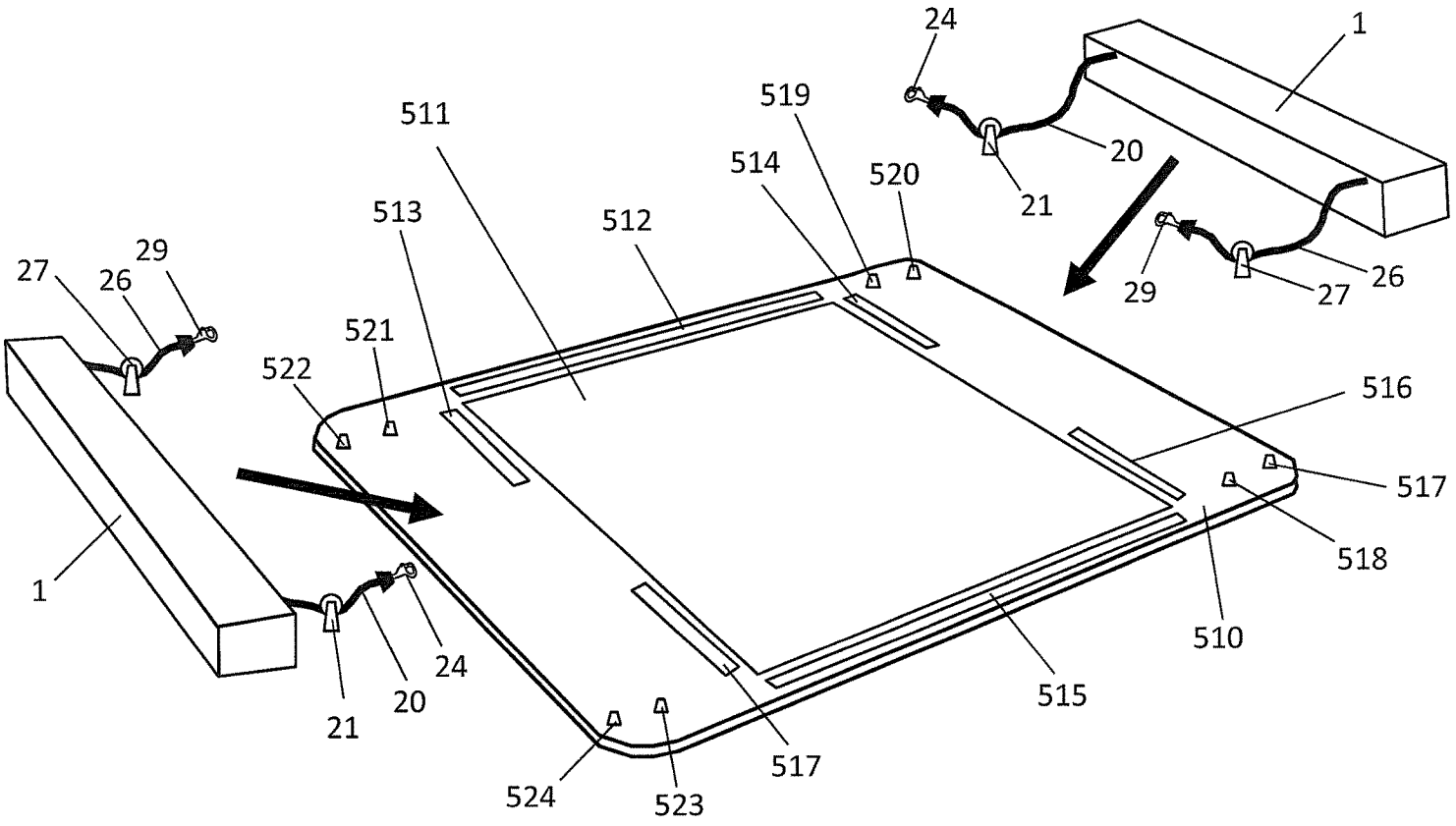
FIG. 28 is two training modules being snapped on to a platform
Figure 29:
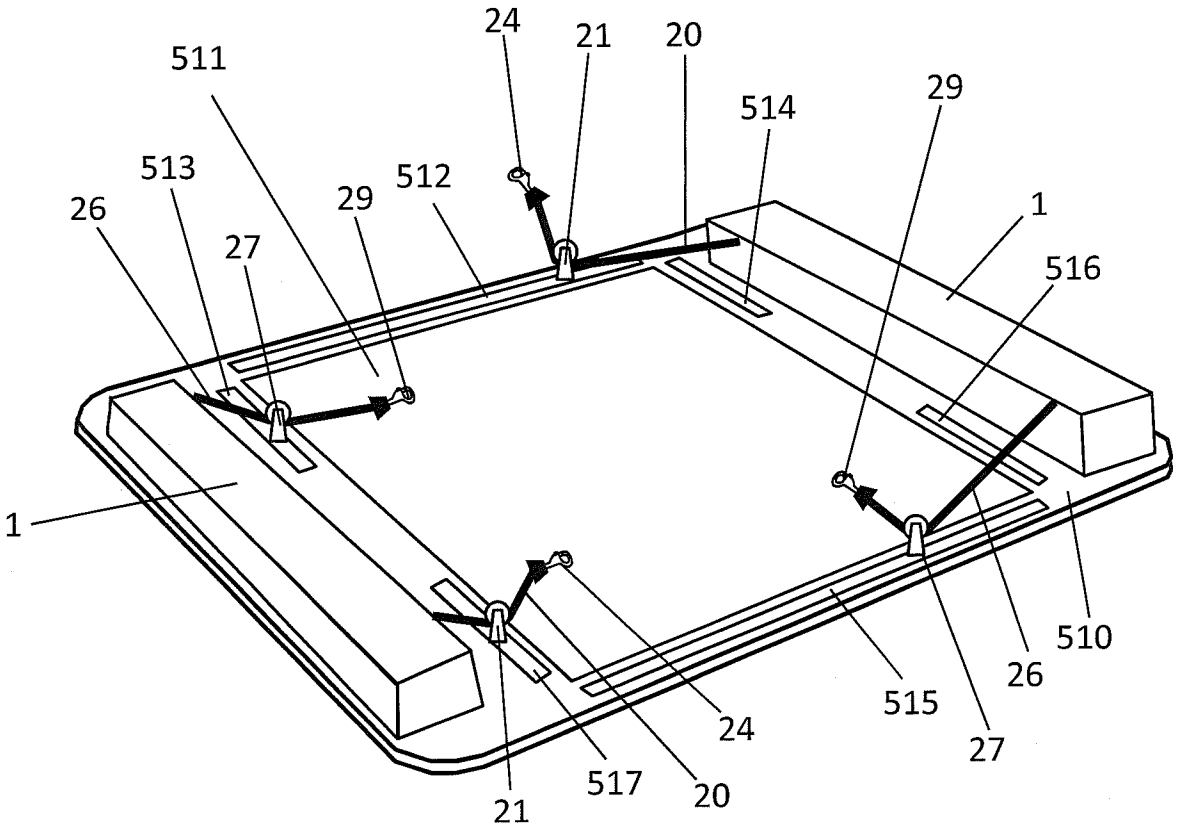
FIG. 29 is two training modules snapped on to a platform

FIGS. 28 and 29 show how the portable modules can be snapped on to vertical jump and athletic training platforms 510 with foam mat 511 using locking means 517 thru 524 which accept one or more modules. Attachment means 512 thru 517 attached to platform 510 accept VOAMs 21 and 27 so that the resistance vectors of band sets 20 and 26 may be set or located around the perimeter of mat 511.

Figure 30:
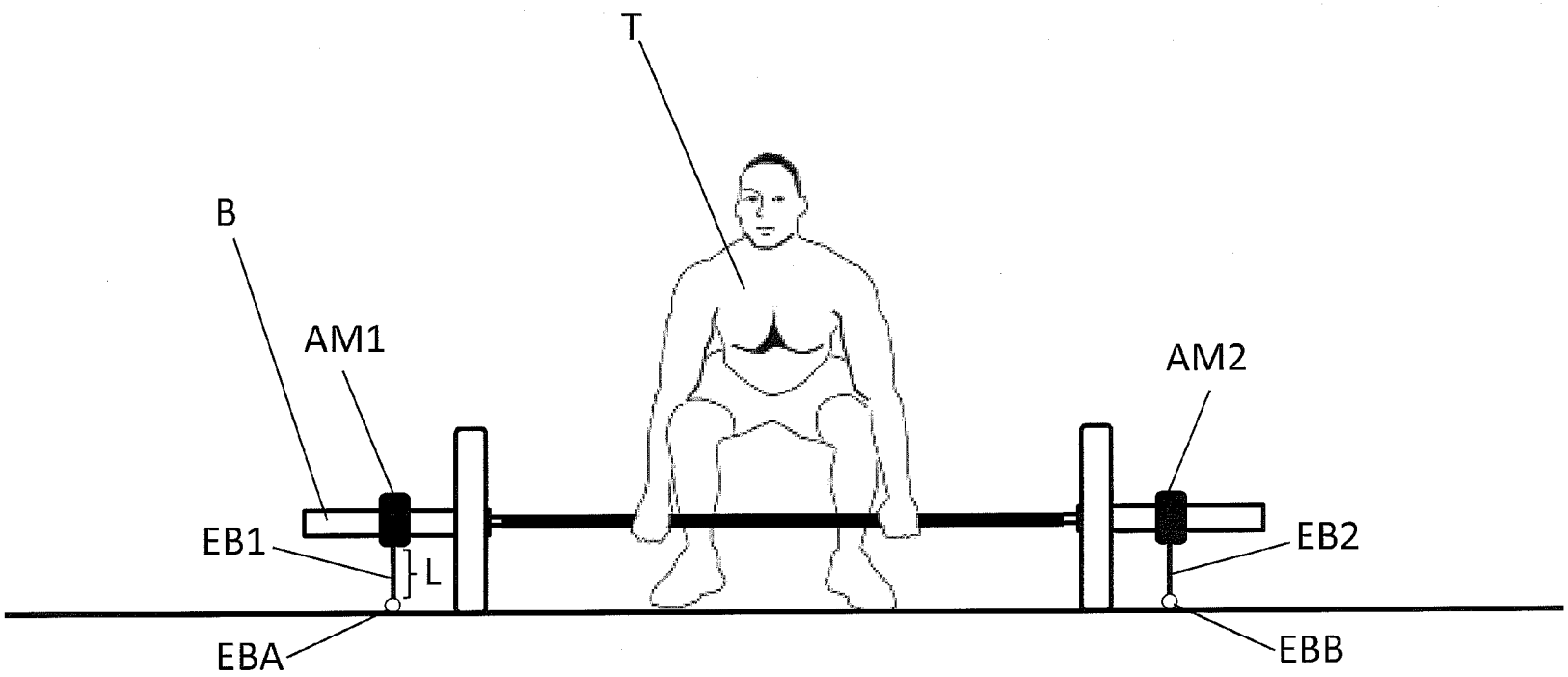
FIG. 30 is a trainee doing a barbell lift exercise
Figure 31:
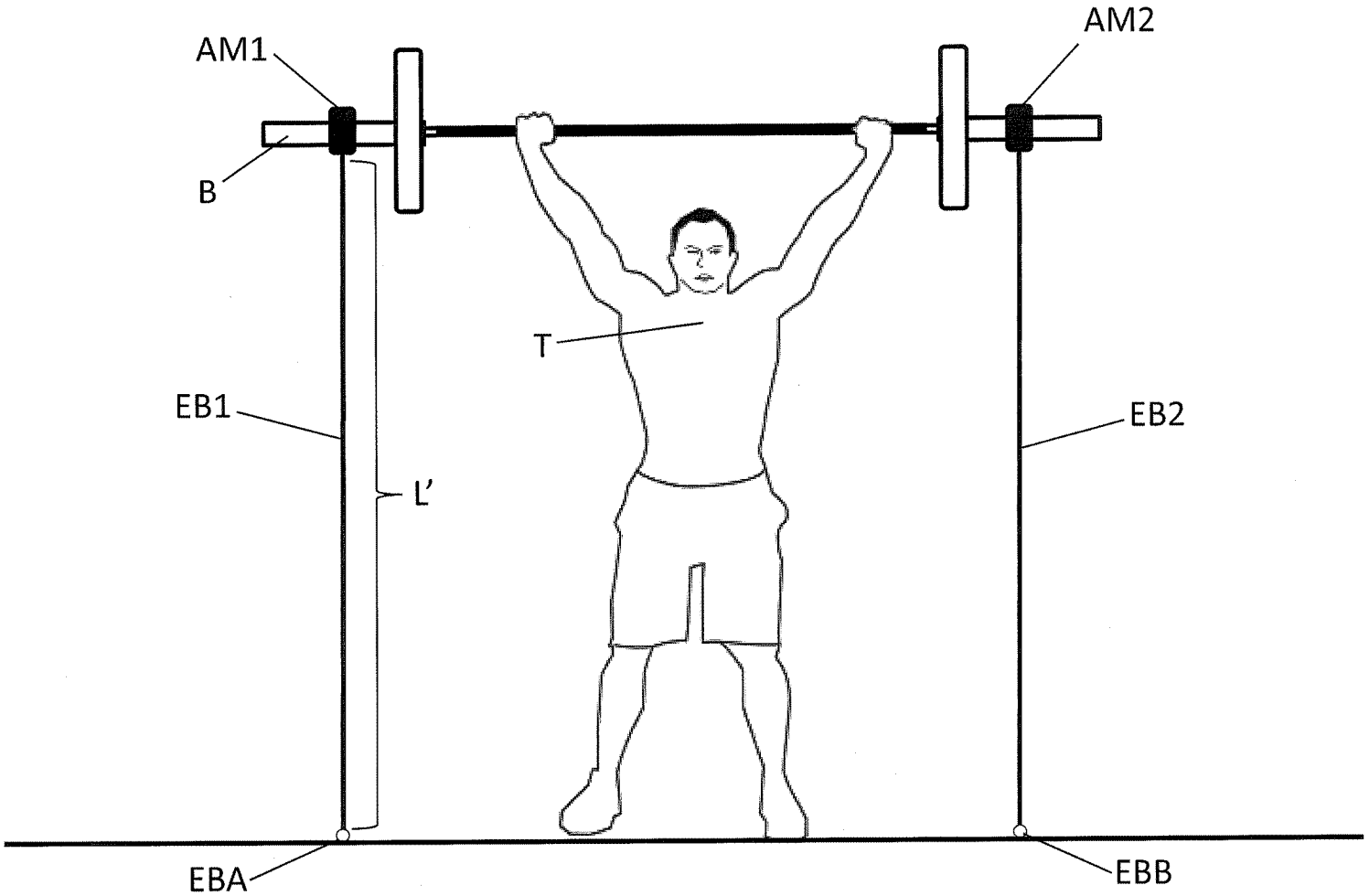
FIG. 31 is a trainee doing a barbell lift exercise overhead
Figure 32:
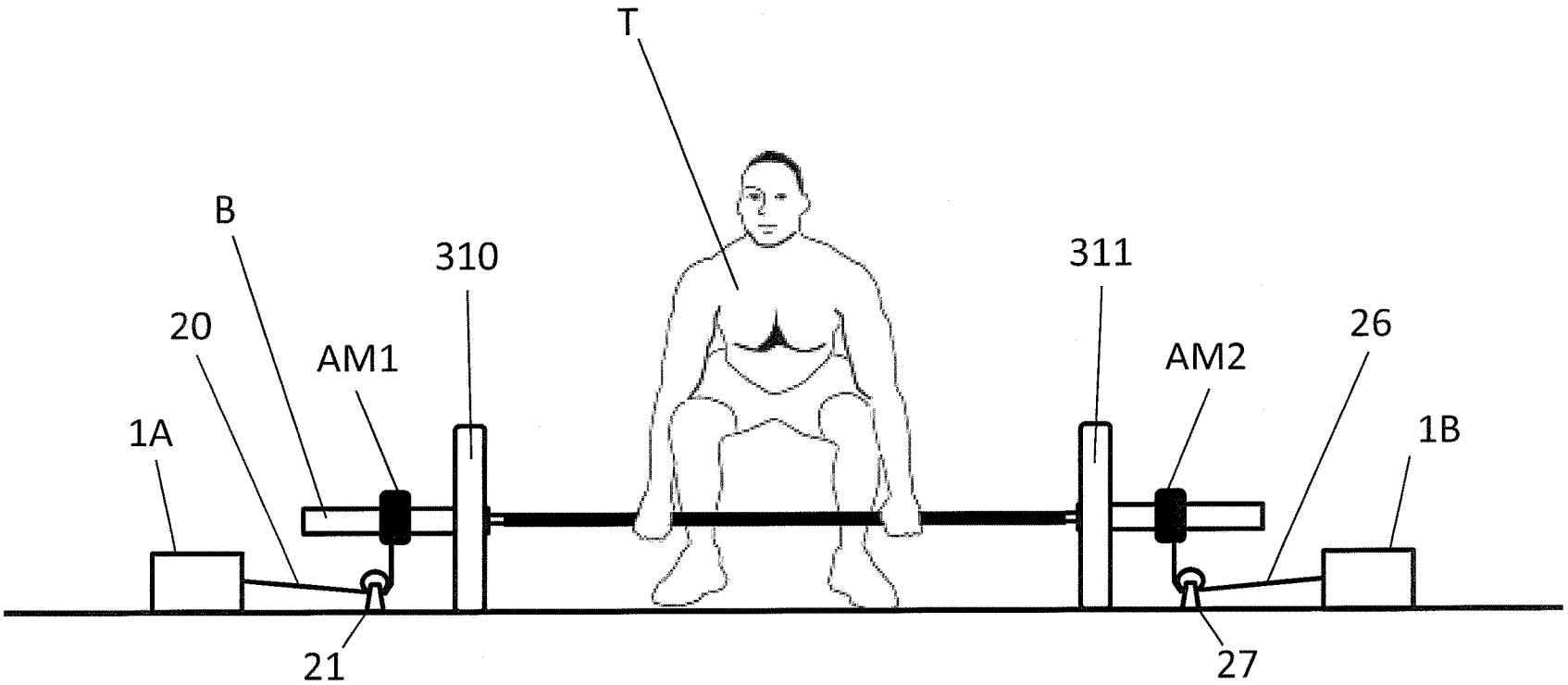
FIG. 32 is a trainee doing a barbell exercise
Figure 33:
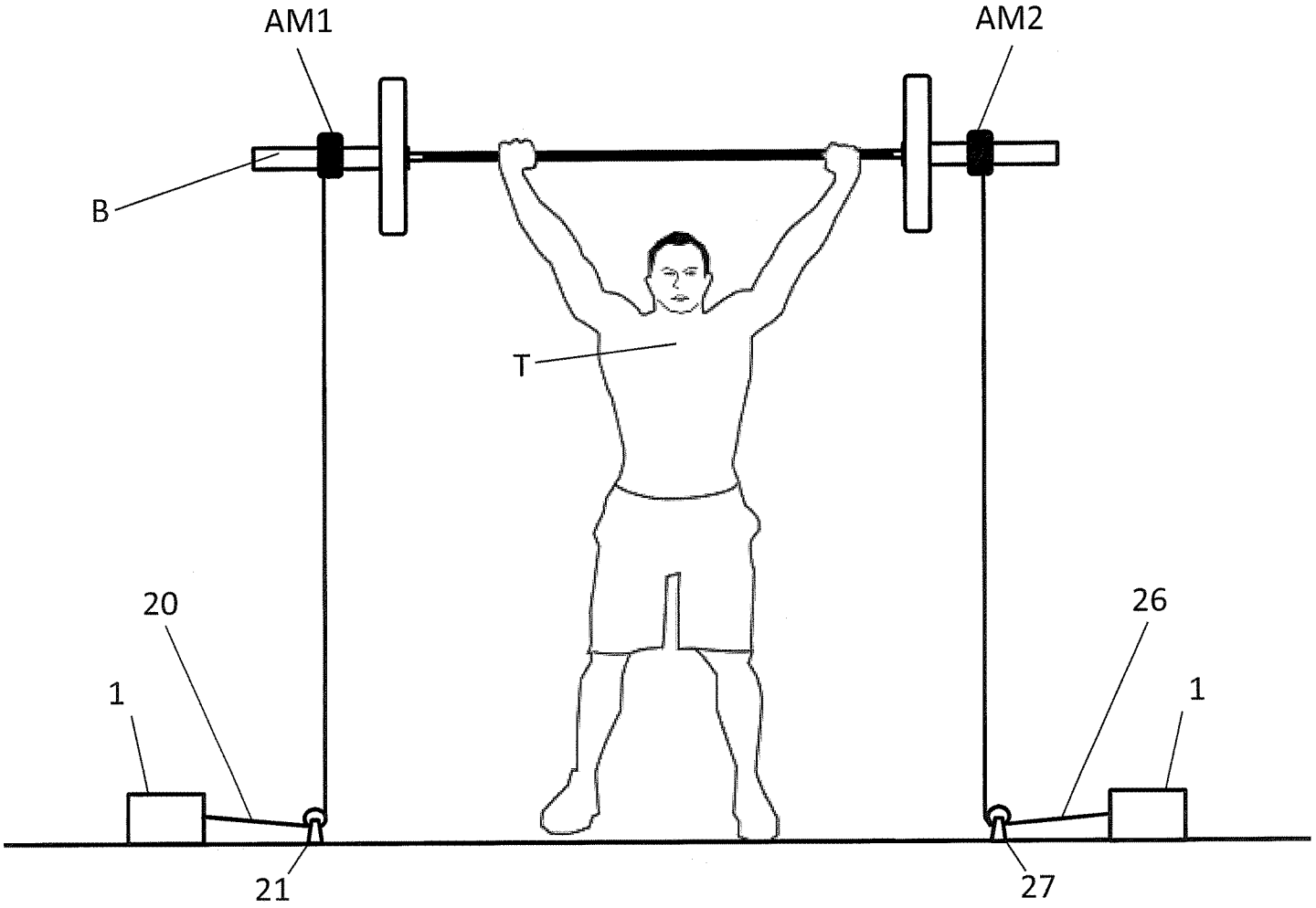
FIG. 33 is a trainee doing a barbell lift overhead

There are many other applications for the portable resistance modules which will allow them to be integrated into many training environments. Elastic bands are commonly used to resist and assist barbell lifts. As FIG. 30 illustrates, a similar problem as previously discussed emerges when desiring to use elastics to resist an overhead lift. Band lengths EB1 and EB2 are extremely limited since they must be attached to the bar when it is on the ground and the length L between barbell B and ground attachment point EBA or EBB is very short. If the trainee (T) attempts to lift the bar B overhead as pictured in FIG. 31, EB1 and EB2 resistance would increase exponentially during the lift and probably prohibit the Trainee from completing the overhead lift or causing a safety issue. Referencing FIG. 32, attaching module 1A and 1B to the ground and pulley assemblies 21 and 27 would allow you to attach resistance bands 20 and 26 with effective lengths 10 to 60 times greater than length L in FIG. 30. When lifting barbell B to the FIG. 33 position the trainee will feel the same relative resistance from the very start to the end of the lift with the bar in the overhead position. Conventional elastic bands will not allow such a force application from the start to finish of the lift illustrated in FIGS. 32 and 33.

Figure 34:
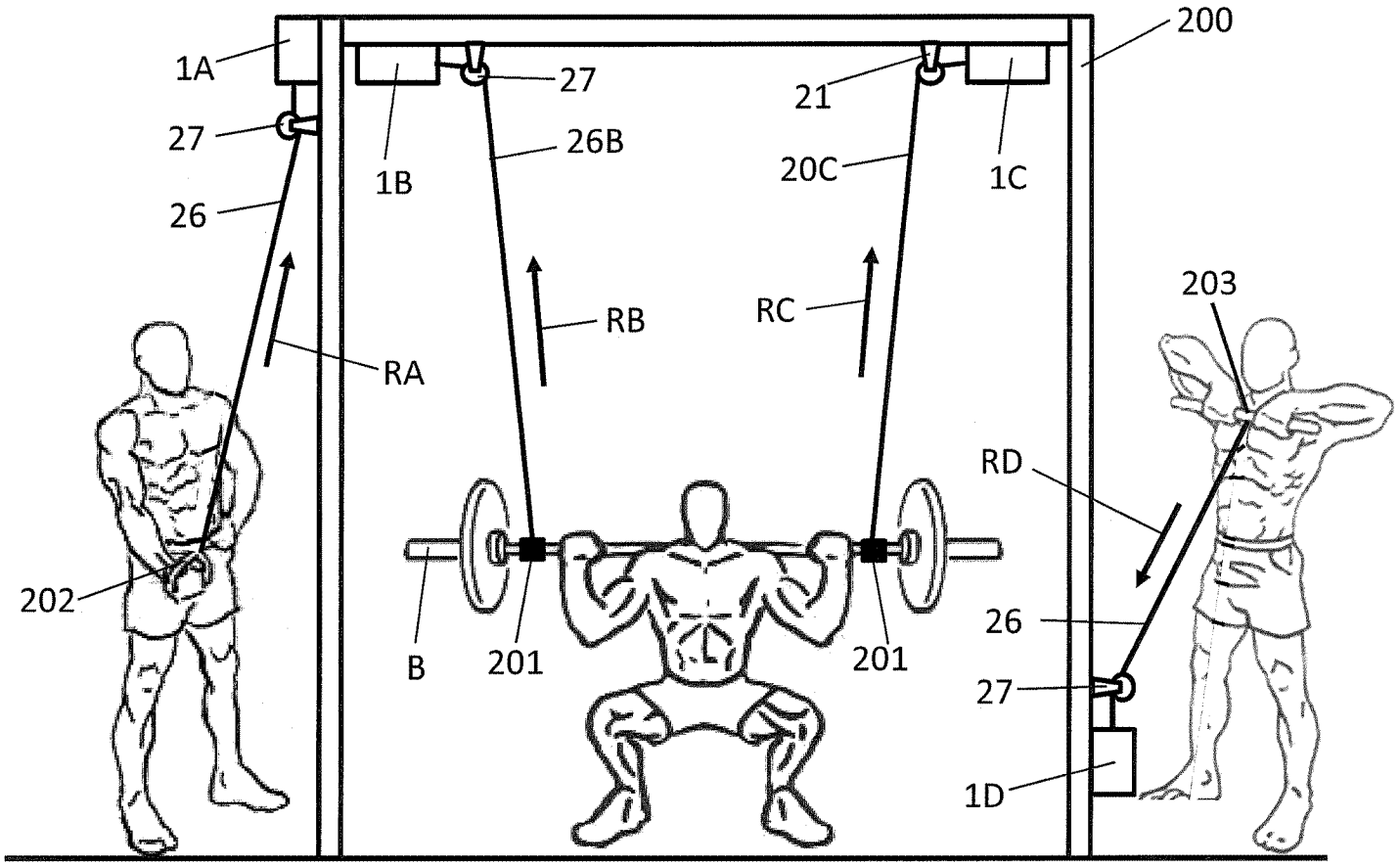
FIG. 34 is three trainees doing exercise training movements with multiple training modules

FIG. 34 shows how multiple modules 1A, 1B, 1C and 1D may be attached to different locations on a squat rack to provide assisted lifts using resistance bands 26B and 20C attached to barbell B with attachment means 201 so that resistance force vectors RB and RC pull up on barbell B. Module 1A provides an upward resistance vector RA for exercises pulling downward while Module 1D provides downward force vectors RD to exercises where the Trainee pulls upward. Pulley assemblies 21 and 27 can be detached from frame 200 and relocated to different locations on 200 to create resistance vectors from different angles and opposite directions.

Figure 35:
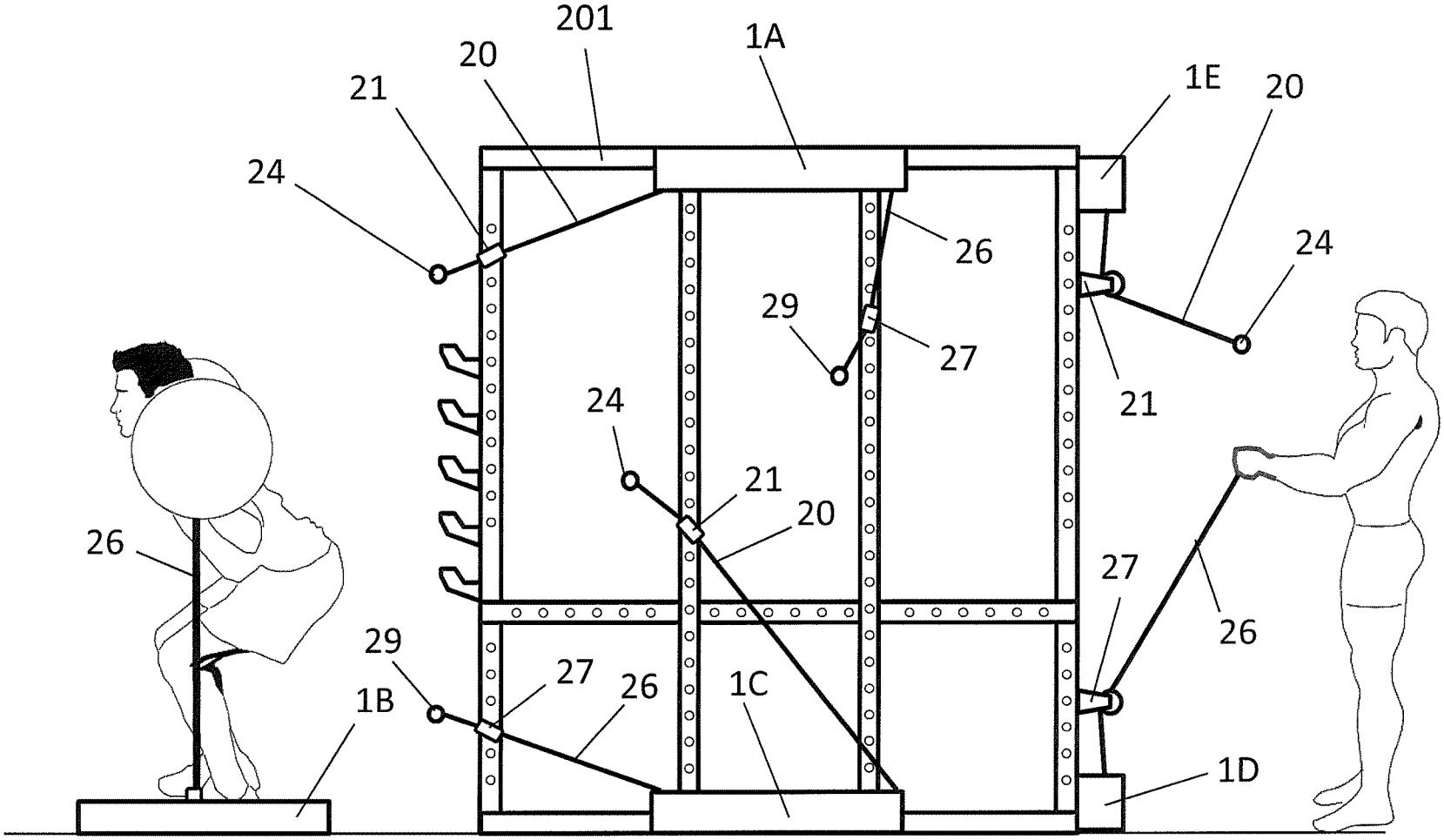
FIG. 35 is a side view of the present disclosure of two trainees doing exercise movements

FIG. 35 illustrates another view point for integrating the present disclosure permanently or as a removable module on or around squat racks. Note moveable pulley assemblies 21 and 27 can relocate to many positions around the support structure 201. Multiple attachment means on 201 will allow module 1 to be placed in multiple locations and orientations on and around structure 201.

Figure 37:
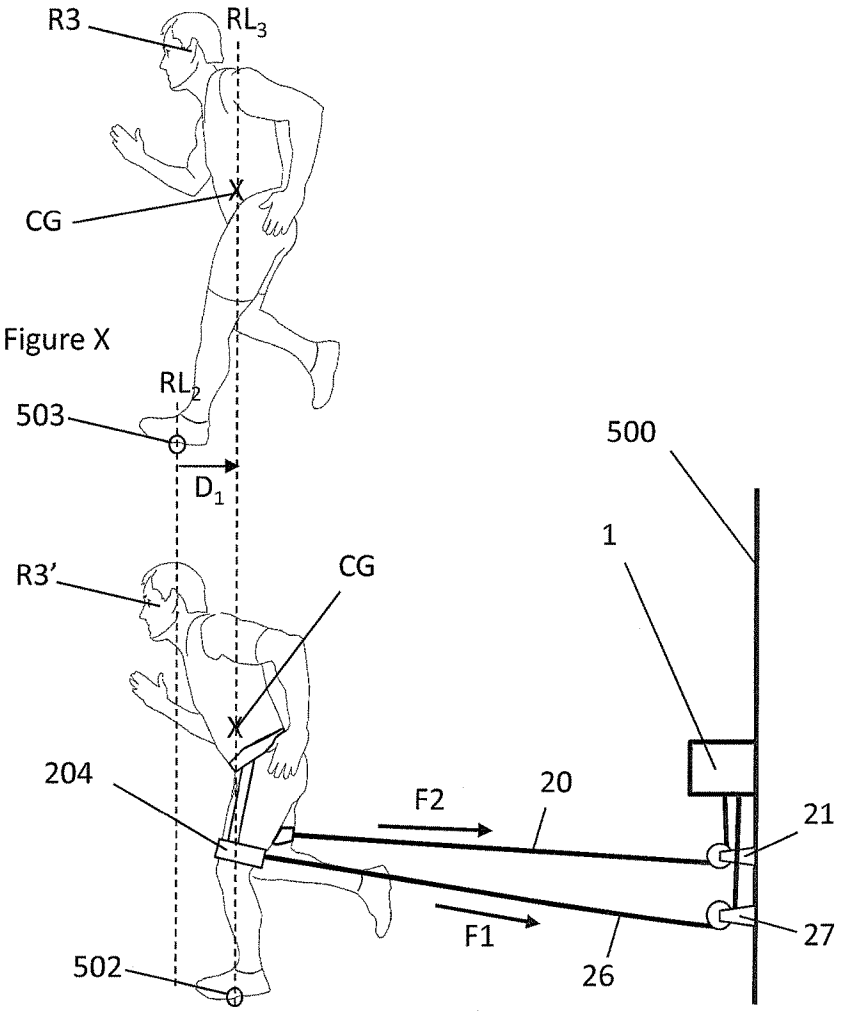
FIG. 37 is a side view of a sprinter using the present disclosure
Figure 36:
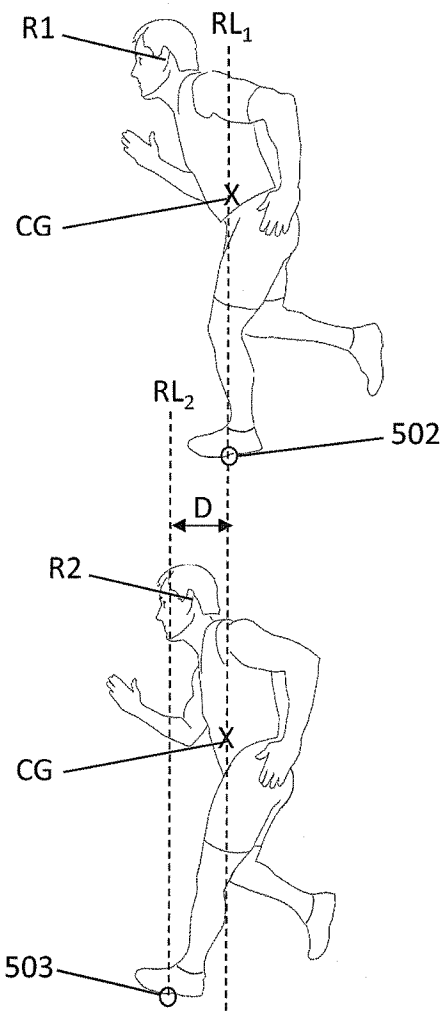
FIG. 36 is a side view of a sprinter

Another embodiment of the present disclosure includes the ability to apply physical queuing to sprinters to automatically correct over-striding. Referencing sprinter R1 in FIG. 36, to achieve maximum sprinting velocity it has been proven the optimum ground strike point must be directly under the sprinter's center of gravity CG indicated by strike point 502 in-line with CG as shown by reference line $RL_1$. One of the most common problems with all sprinters is the tendency to over stride where the foot makes ground contact in front of CG. Referencing sprinter R2 in FIG. 36, strike point 503 in front of reference line $RL_1$ will cause a braking effect because the foot is moving in the opposite direction of the sprinter when it strikes the ground in front of the sprinter's CG by distance D which is typically on the order of an inch or even millimeters. This is a very difficult problem for sprinters to correct and they must try to make the over-stride correction mentally while running and responding to voice commands by their track coach to not over-stride. Referencing FIG. 37, Sprinter R3 is over striding with ground contact at point 503 in front of CG by distance $D_1$. Referencing the same runner but with the present disclosure mounted to support structure 500 and resistance bands 20 and 26 attached to the sprinter's legs behind the knees using harness 204, force vectors F1 and F2 created by the resistance bands automatically and immediately drive the foot back before ground strike and cause the foot to strike in the proper ground location under CG at point 502.

Figure 38:
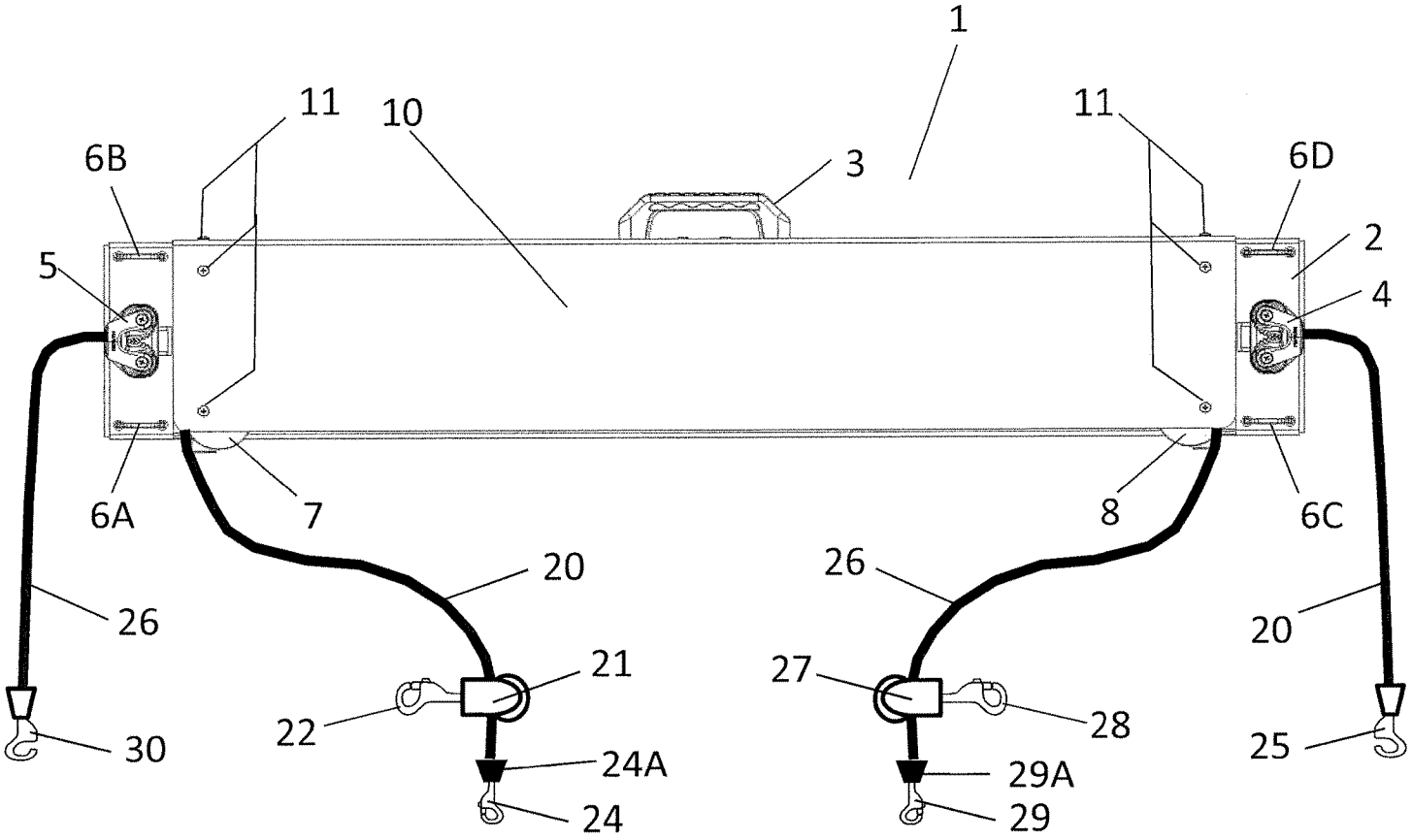
FIG. 38 is another embodiment of the front view of the training module

FIG. 38 illustrates another embodiment of the present disclosure. Pulley housing cover 10 attaches to pulley housings with screws 11. Pulley housings under cover 10 are attached to base structure 2. Mounting strap attachment points are defined by 6A, 6B, 6C an 6D. Resistance band 20 with attachment means 24 and 24A passes through VOAM 21 with attachment means 22 and then enters module body through pulley 7 and is routed back and forth between pulley housings located on either end of the module 1. After traversing back and forth between pulley housings the band 20 exits the right side of base 2 through resistance adjustment cam cleat 4. The end of resistance band 20 includes attachment means 25.

Resistance band 26 with attachment means 29 and 29A passes through VOAM 27 with attachment means 28 and then enters module 1 body through pulley 8 and is routed back and forth between pulley housings located on either end of module 1. After traversing back and forth between pulley housings band 26 exits the left side of base 2 through resistance adjustment cam cleat 5. The end of resistance band 26 includes attachment means 30.

The module 1 may include a handle 3 for ease of transport.

Figure 39:
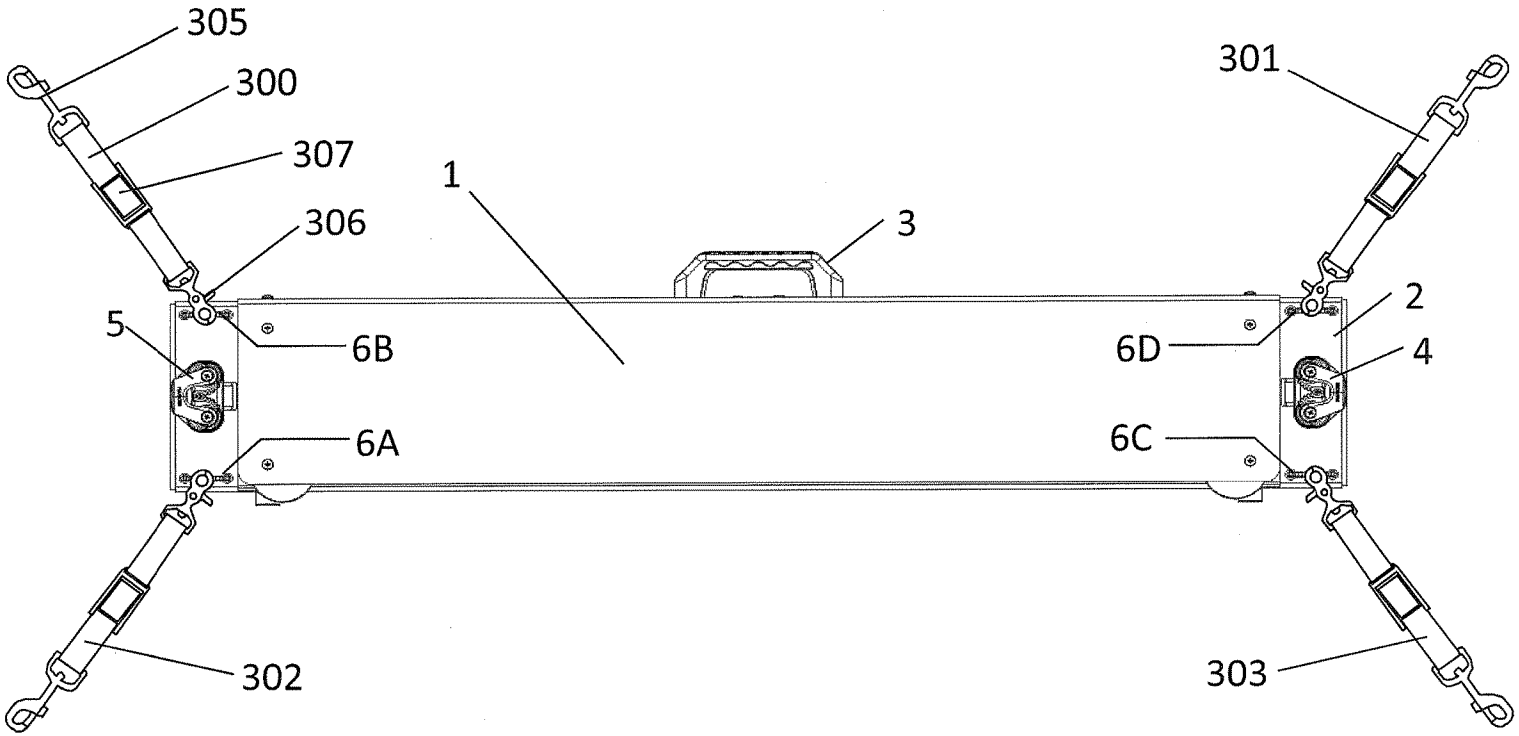
FIG. 39 is a front view of the training module showing attachment strap connectivity

FIG. 39 illustrates attachment strap connectivity on the four corners of base 2. One to four adjustment straps are utilized to physically connect the present disclosure to any suitable support structure. Adjustable strap 300 connects to connector 6B. Adjustable strap 301 connects to connector 6D. Adjustable strap 302 connects to connector 6A. Adjustable strap 303 connects to connector 6C. Resistance bands have been omitted for clarity.

Figure 40:
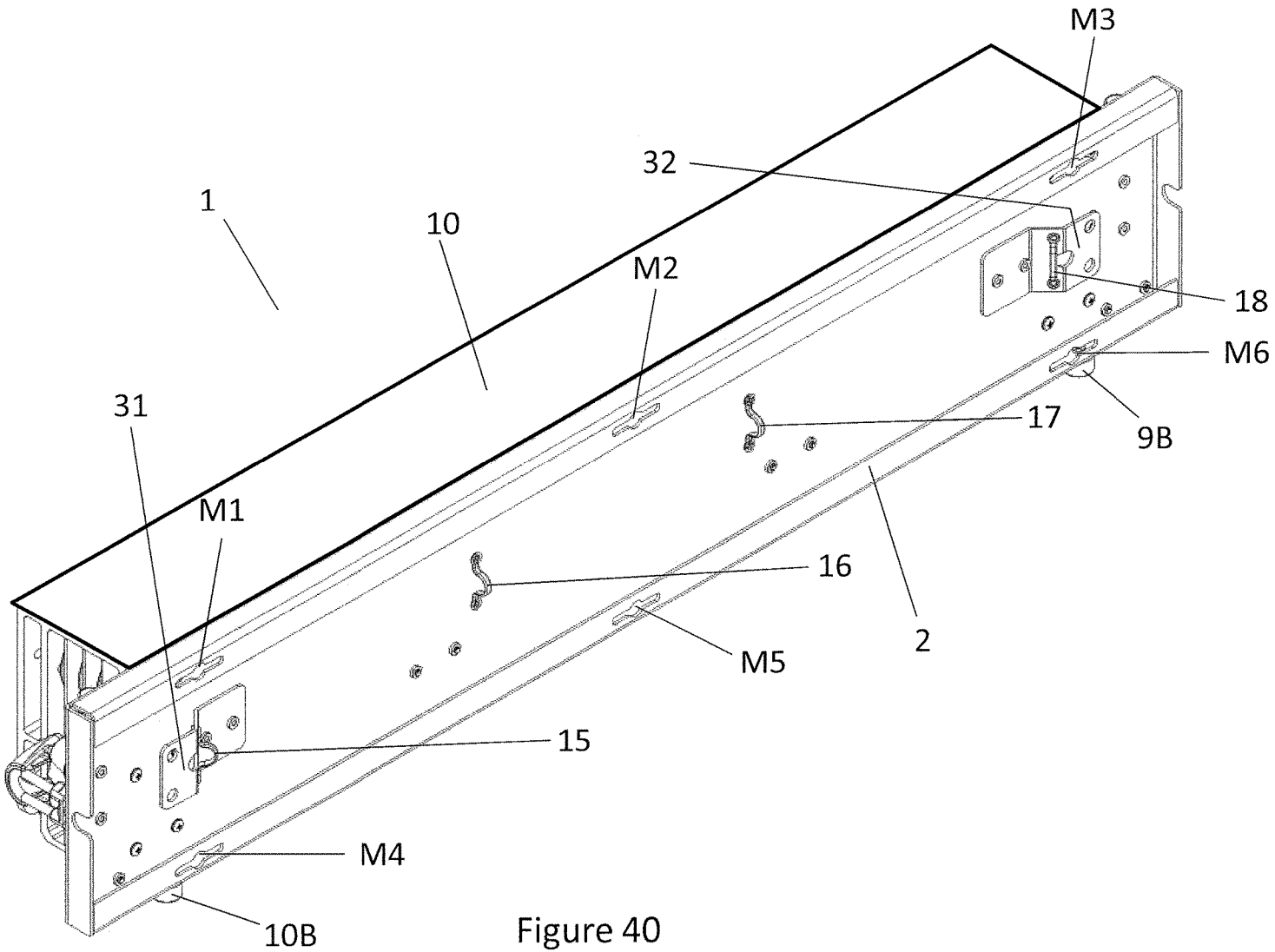
FIG. 40 is a rear view of the present disclosure

FIG. 40 shows the rear side of the present disclosure with carrying means 3 and both resistance bands removed. M1 thru M6 are keyed slots designed to quickly attach base 2 to keyed slot receptors that have been installed on any suitable support structure. The keyed slots allow physical attachment of base 2 without the use of adjustable attachment straps detailed in FIG. 39. Excess bandage (distal ends of resistance bands 20 and 26) are stowed in the rear of the unit by wrapping each band around flanges 31 and 32 and then clipping distal ends with attachment means 25 and 30 to receptors 15, 16, 17 or 18. Rubber stand-offs 9B and 10B are attached to the bottom of base 2 so that the unit rests on the rubber buffers when placed on the ground.

Figure 41:
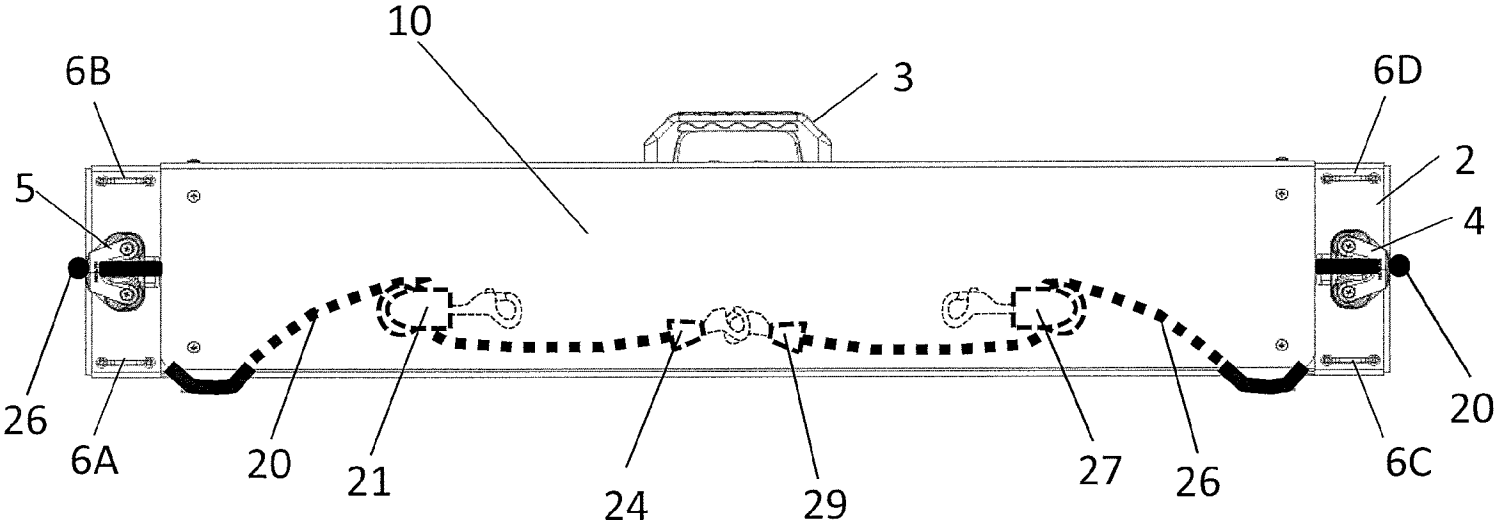
FIG. 41 is a front view of the training module in travel configuration
Figure 42:
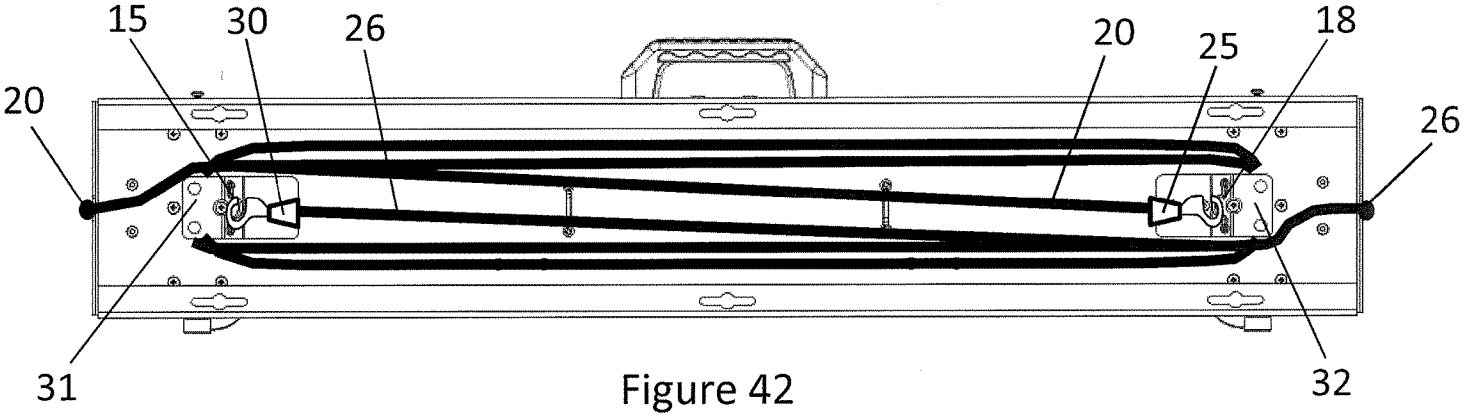
FIG. 42 is a view of the training module resistant bands wrapped around flanges
Figure 43:
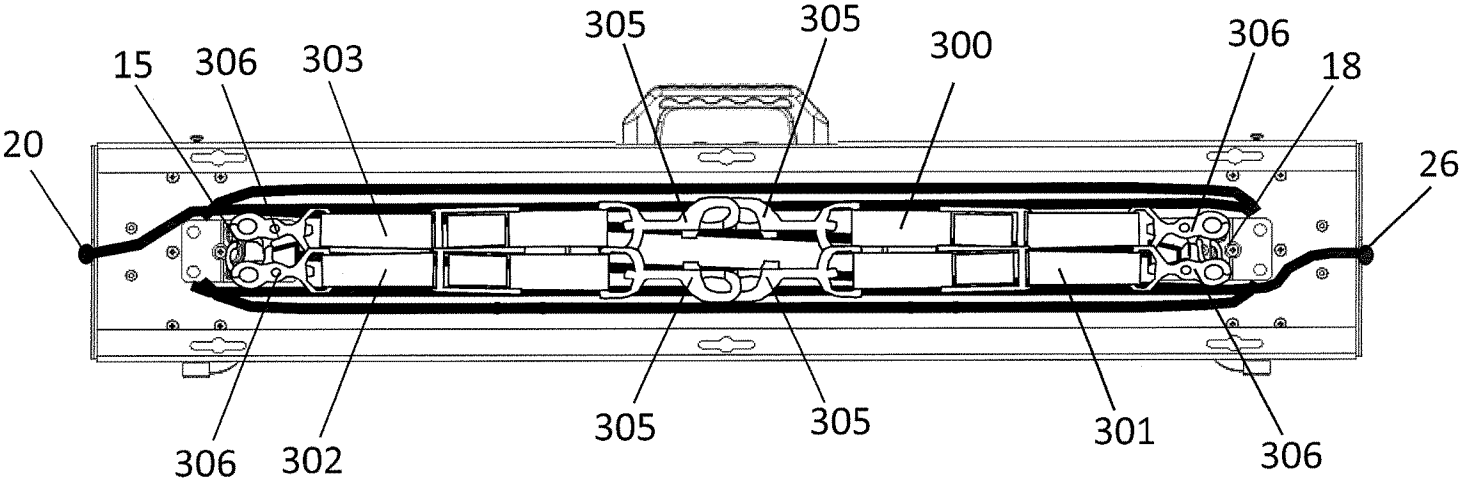
FIG. 43 is a view of the training modules four adjustable attachment straps as stowed
Figure 44:
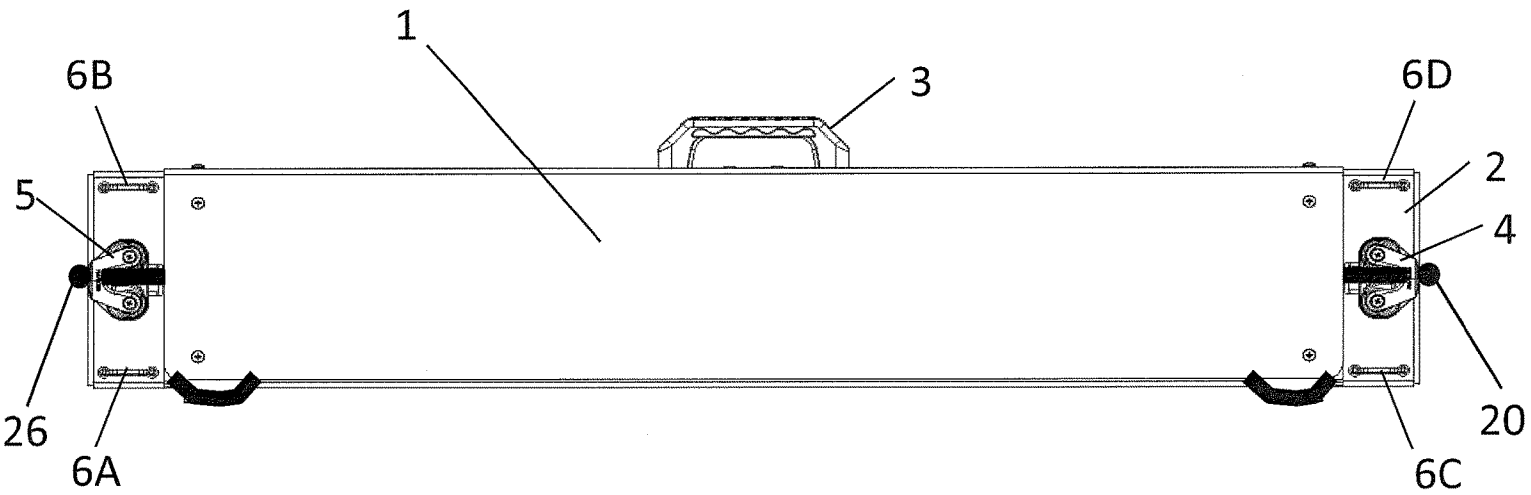
FIG. 44 is a front view of the training module completely stowed

FIG. 41 illustrates how the VOAMs 21 and 27 along with resistance bands 20 and 26 and attachment means 24 and 29 are stowed under cover 10 when the unit is packed up into the travel configuration. FIG. 42 shows how each of the two resistance bands 20 and 26 are wrapped around flanges 31 and 32 with distal ends 30 and 25 finally attached to receptors 15 and 18. After the resistance bands have been stowed FIG. 43 shows how the four adjustable attachment straps are stowed by attaching clip ends 305 together and distal clip ends 306 to receptors 15 and 18. FIG. 44 illustrates the completely stowed unit ready for transport or storage. It is important to note that harness accessories can also be stowed inside cover 10. Thus the stowed unit contains everything required to attach the unit to a suitable structure and perform training drills. Also it is important to note that a third forth resistance band can be added to the module.

Figure 45:
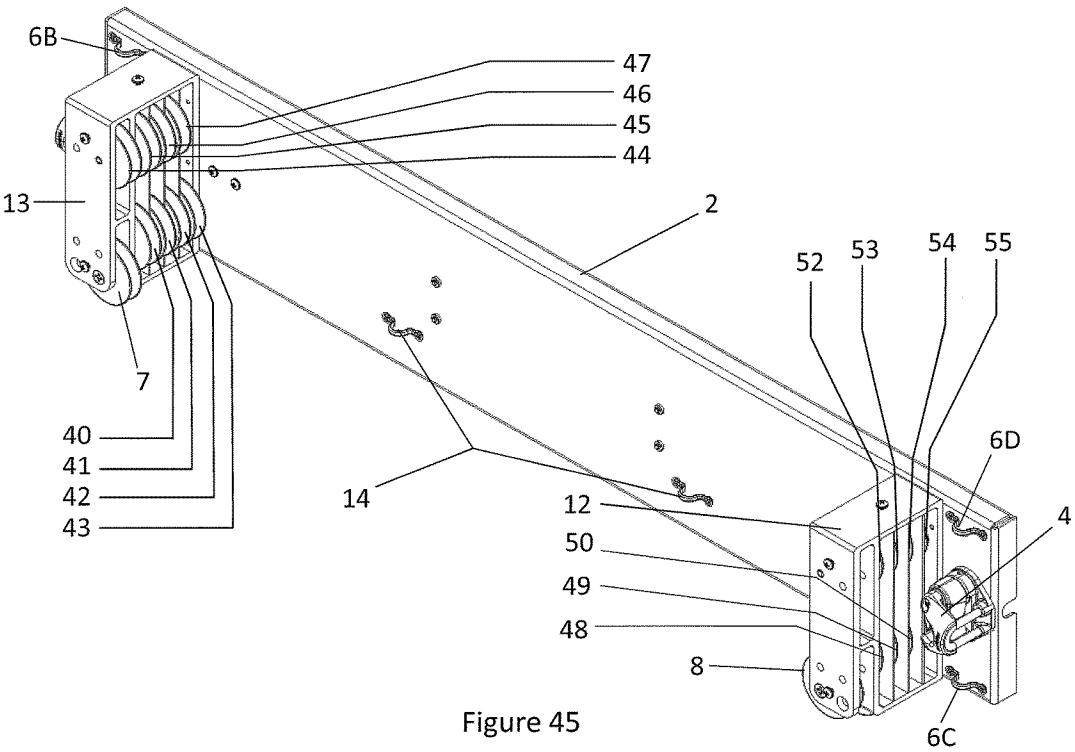
FIG. 45 is a view of the base structure of the training module

FIG. 45 shows the base structure 2 with cover 1 and resistance bands 20 and 26 removed. Pulley housings 12 and 13 for this particular design hold 9 pulleys each. If it is desired to increase the training range of the present disclosure then the pulley housing will scale up in the number of levels and pulleys housed in each housing so that more bandage can be routed and stored internal to the unit and thus increase the range at which a Trainee can extract bandage. Housing 13 contains entry pulley 7 and stacked pulleys 40 through 47. Housing 12 contains entry pulley 8 and stacked pulleys 48 through 55.

Figure 46:
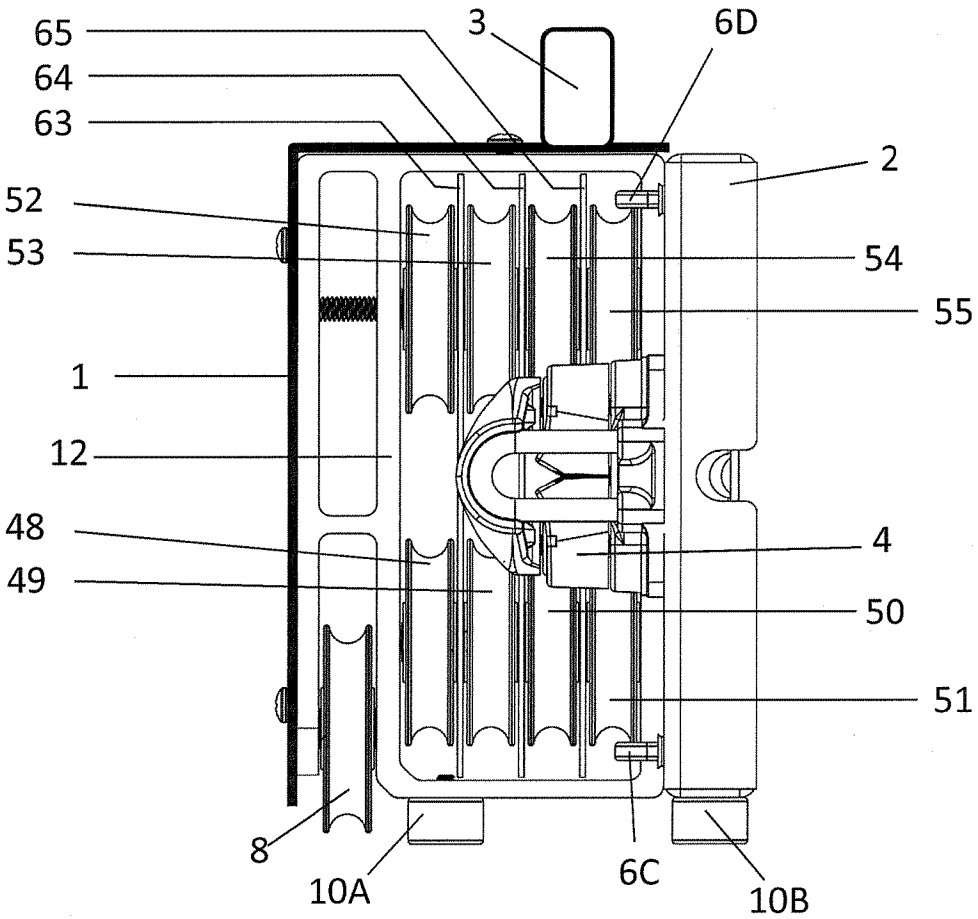
FIG. 46 is a side view of pulley housing

FIG. 46 shows a side view of pulley housing 12 with pulleys 8, 48, 49, 50, 51, 52, 53, 54 and 55. Separator plates 63, 64 and 65 are used to keep resistance bands from derailing off pulleys and getting tangled.

Figure 47:
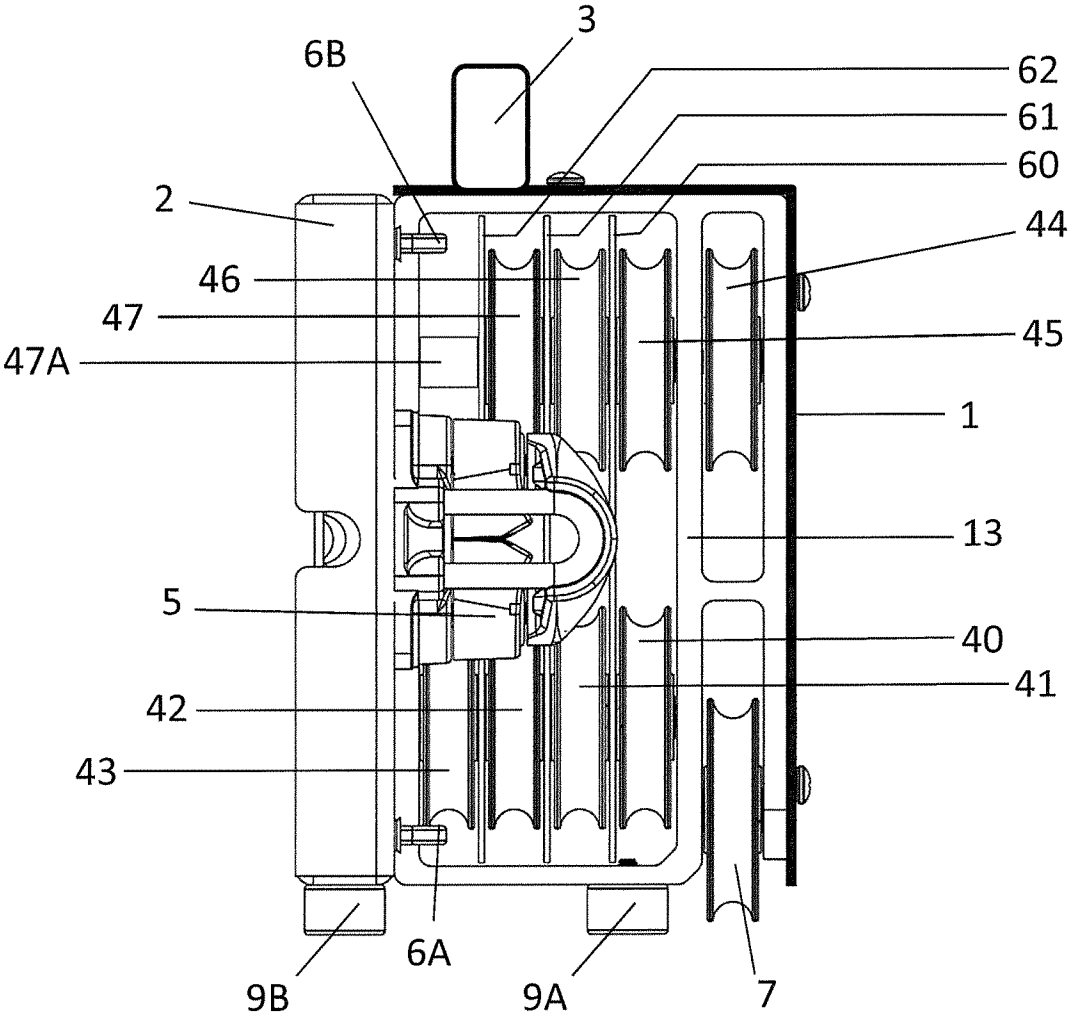
FIG. 47 is another view of pulley housing

FIG. 47 shows a side view of pulley housing 13 with pulleys 7, 40, 41, 42, 43, 44, 45, 46 and 47. Separator plates 60, 61 and 62 are used to keep resistance bands from derailing off pulleys and getting tangled.

Figure 2:
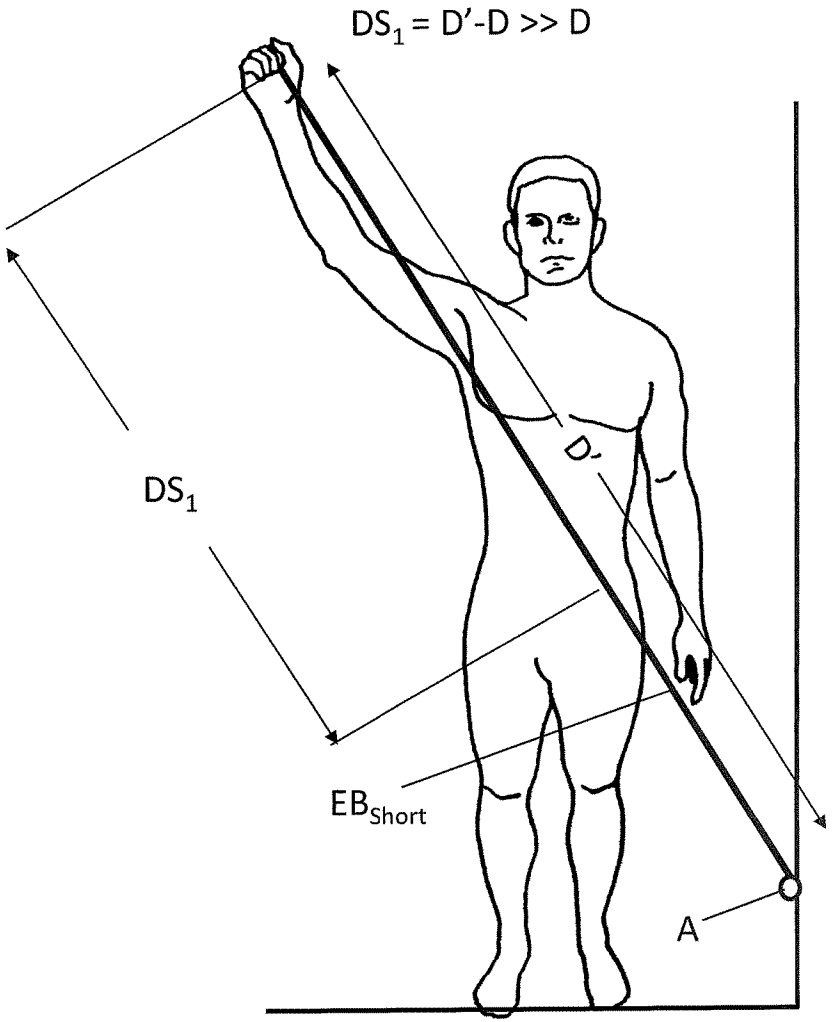
FIG. 2 is a trainee performing an exercise
Figure 1:
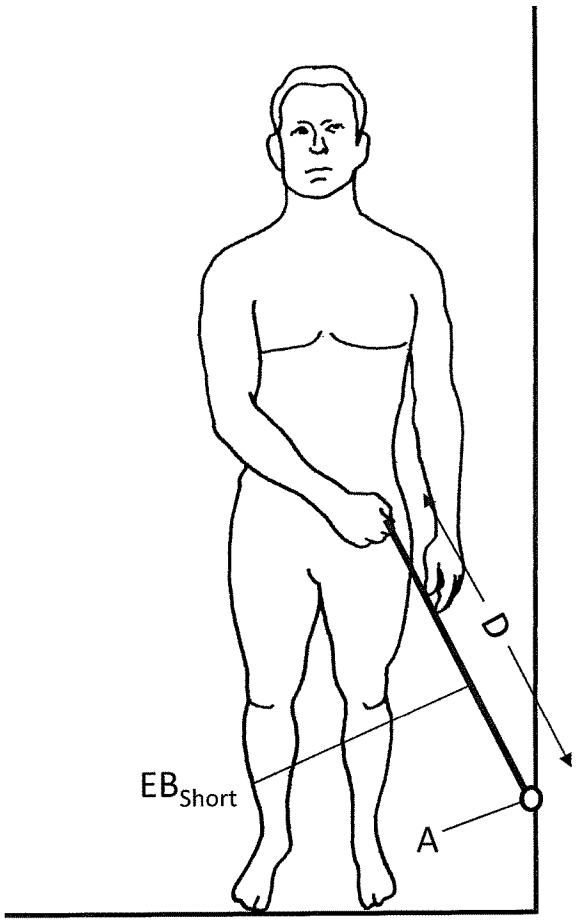
FIG. 1 is a trainee performing an exercise
Figure 4:
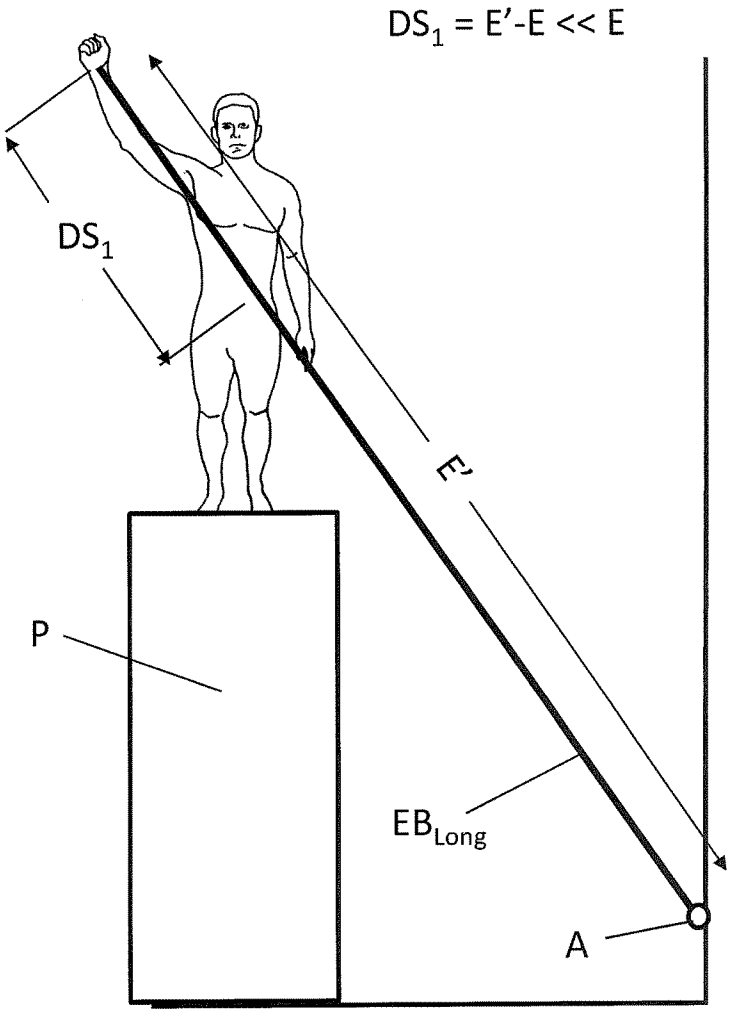
FIG. 4 is a trainee performing an exercise on a pedestal in a stop position
Figure 3:
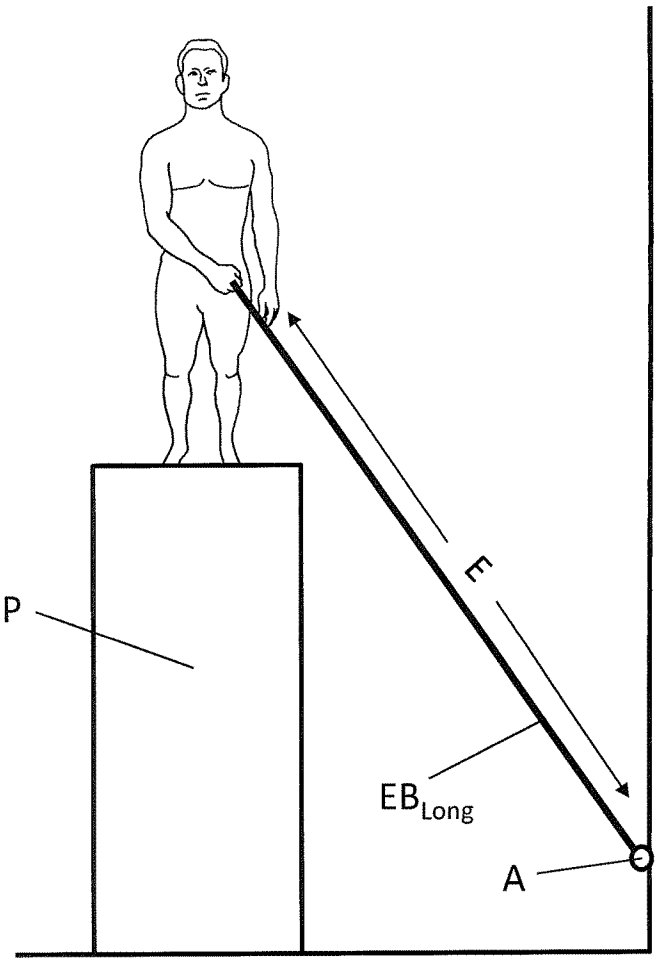
FIG. 3 is a trainee performing an exercise on a pedestal in a start position
Figure 6:
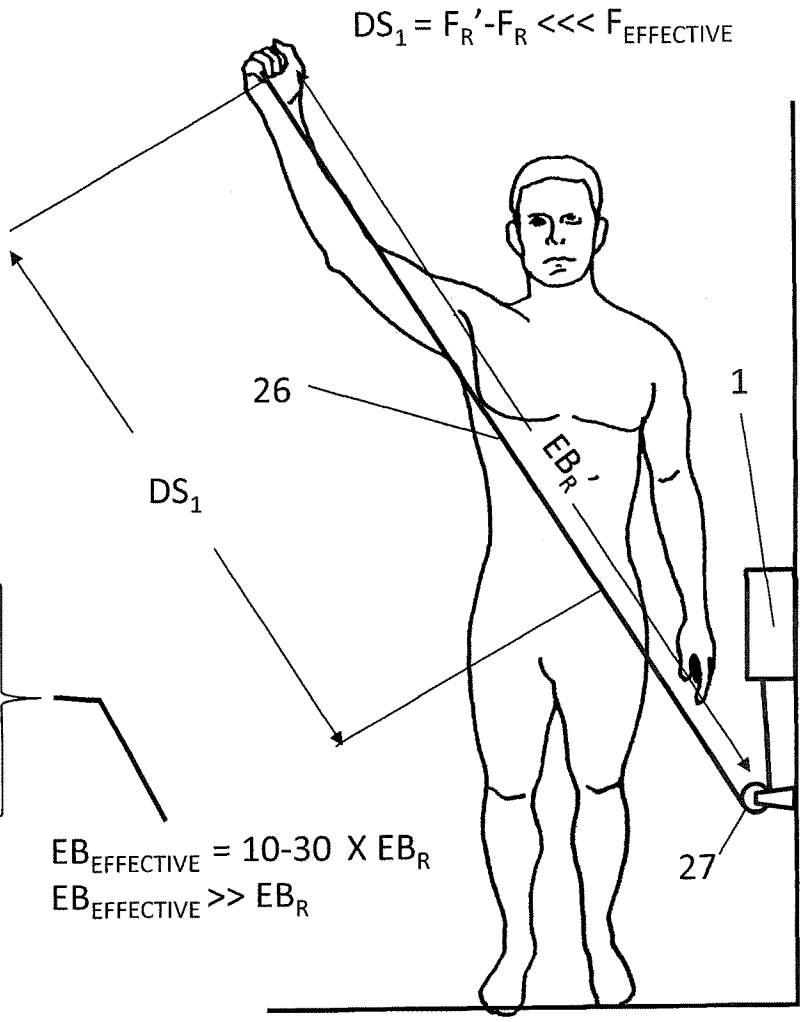
FIG. 6 is one embodiment of the present disclosure for performance exercise of FIG. 1-4
Figure 5:
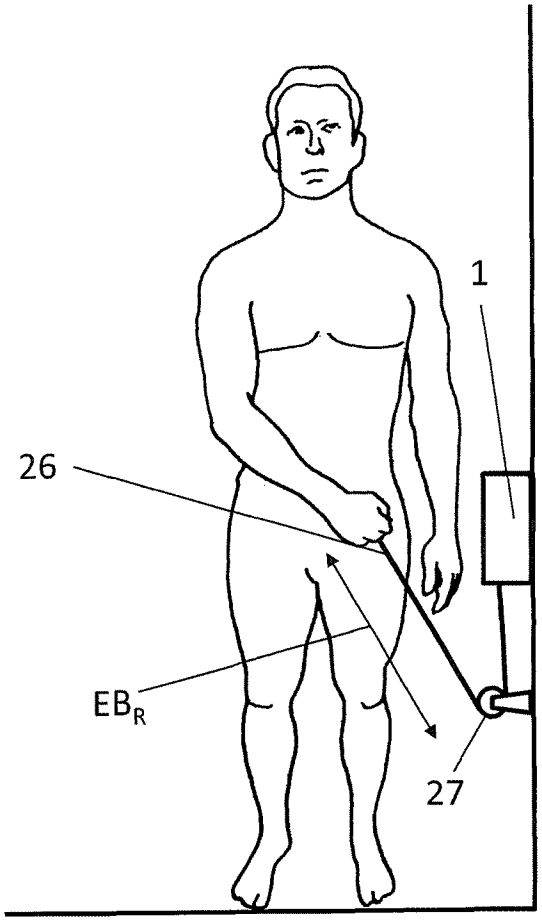
FIG. 5 is one embodiment of the present disclosure for performance exercise of FIG. 1-4
Figure 8:
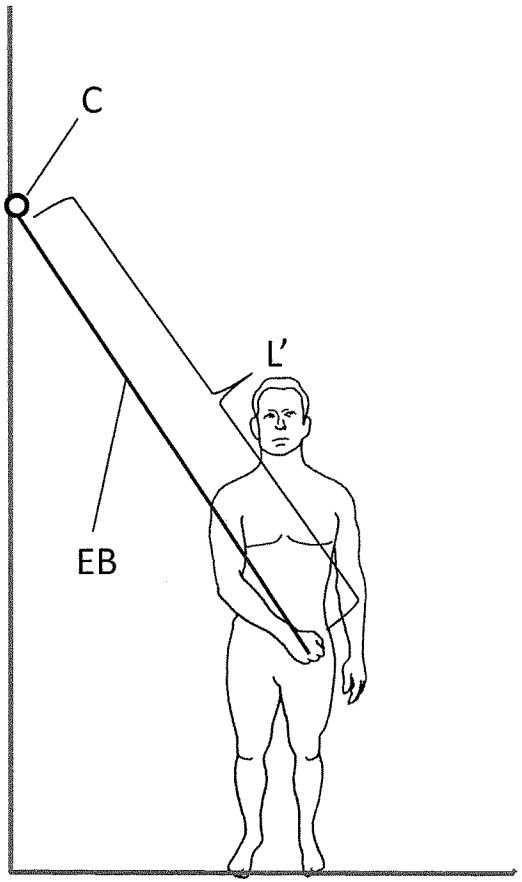
FIG. 8 is a trainee performing an exercise training movement
Figure 7:
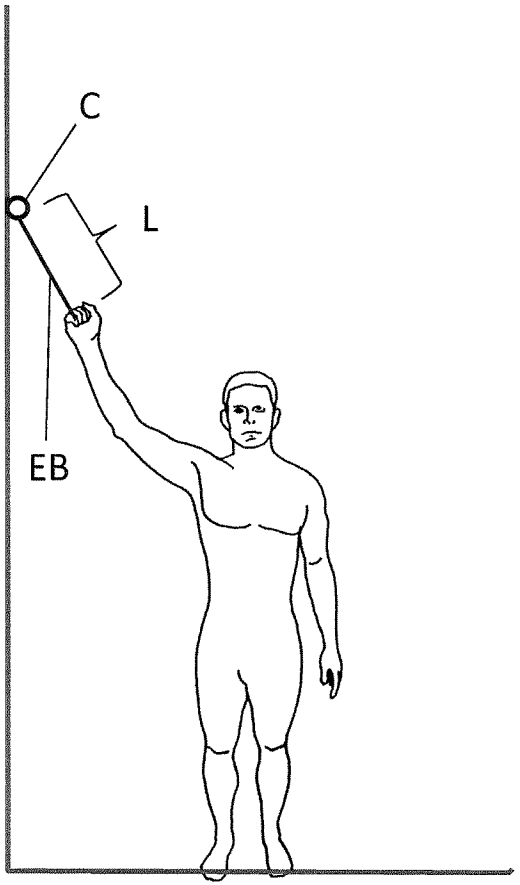
FIG. 7 is a trainee performing an exercise training movement
Figure 10:
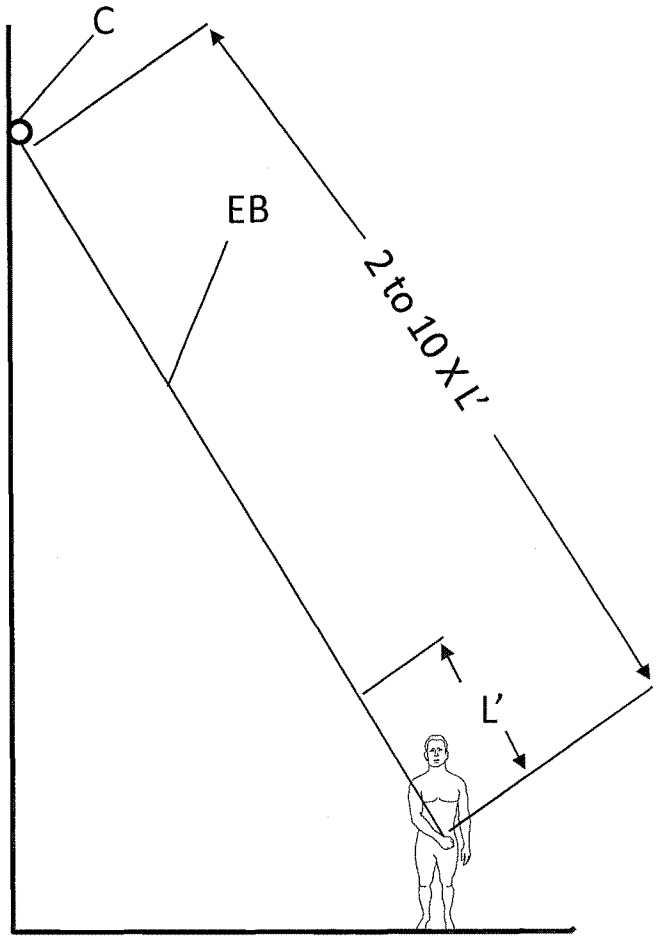
FIG. 10 is a trainee performing an exercise training movement
Figure 9:
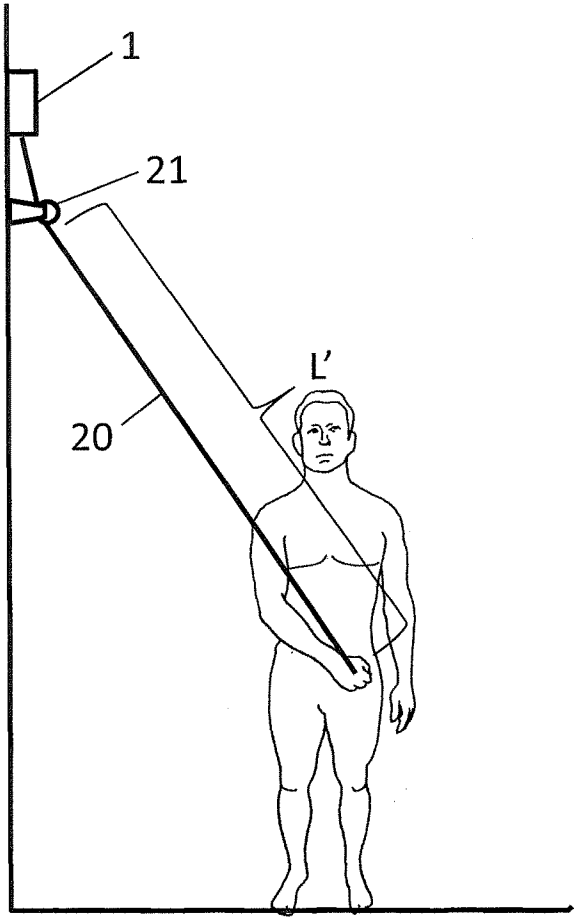
FIG. 9 is a trainee performing an exercise training movement
Figure 12:
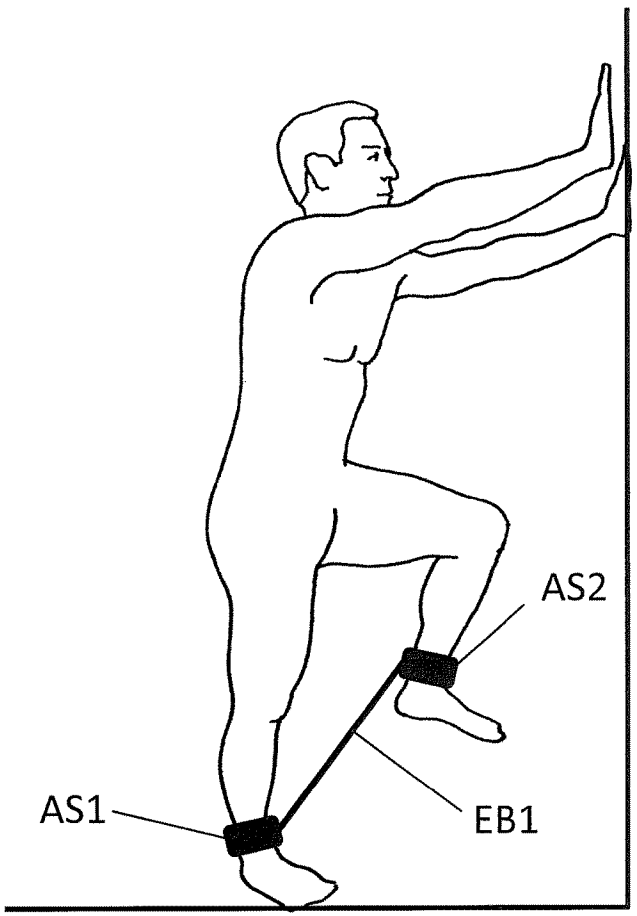
FIG. 12 is a trainee performing an exercise
Figure 11:
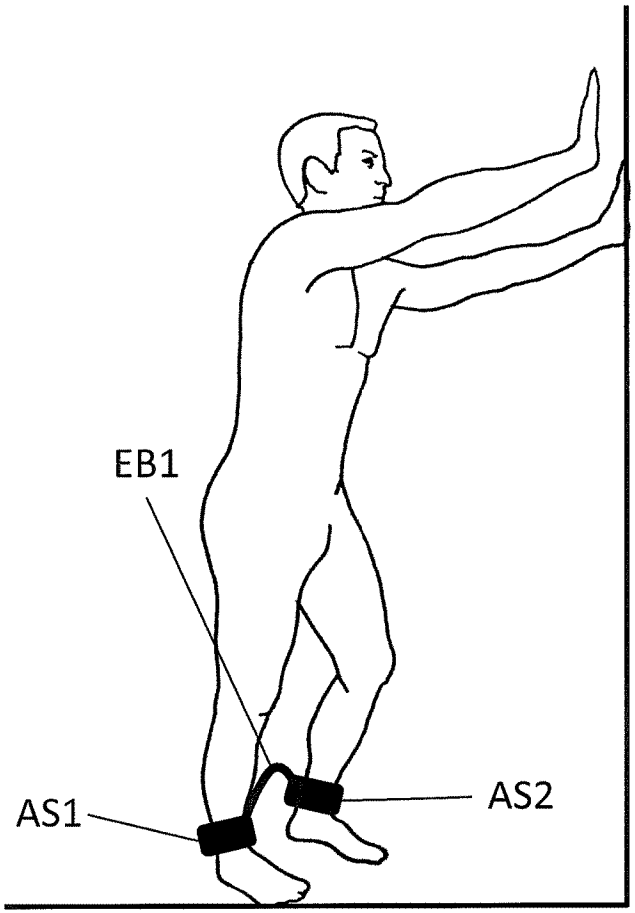
FIG. 11 is a trainee performing an exercise
Figure 14:
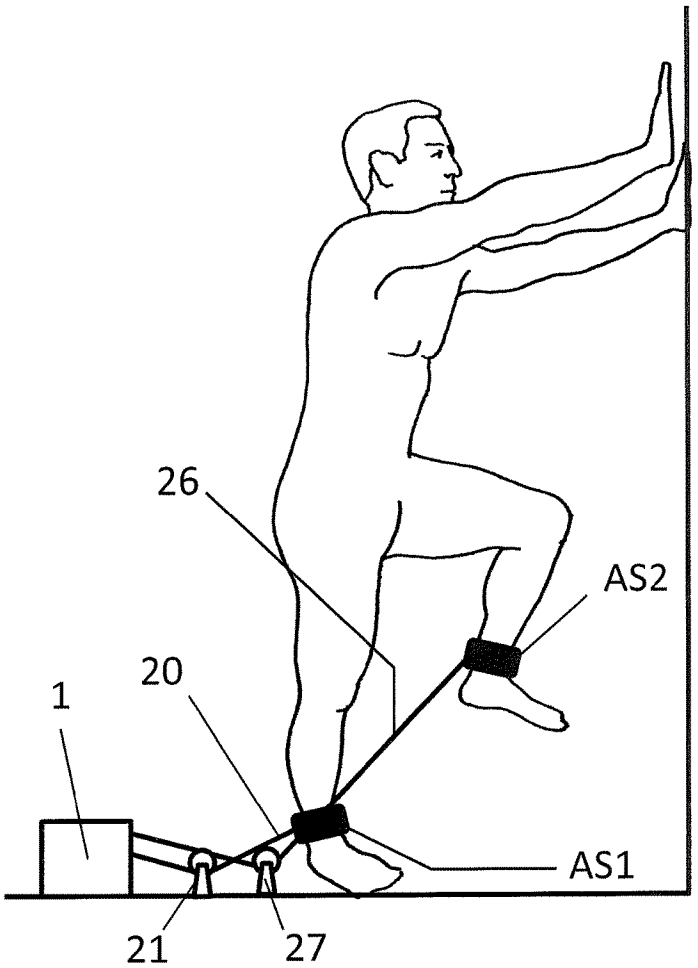
FIG. 14 is a trainee performing an exercise illustrating one aspect of the present disclosure
Figure 13:
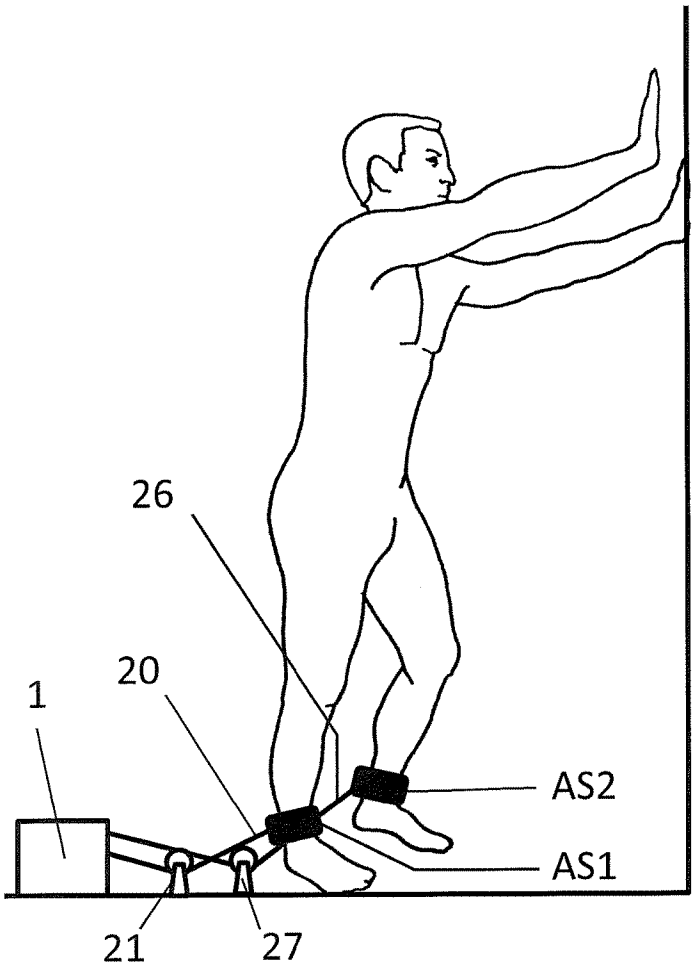
FIG. 13 is a trainee performing an exercise illustrating one aspect of the present disclosure
Figure 15:
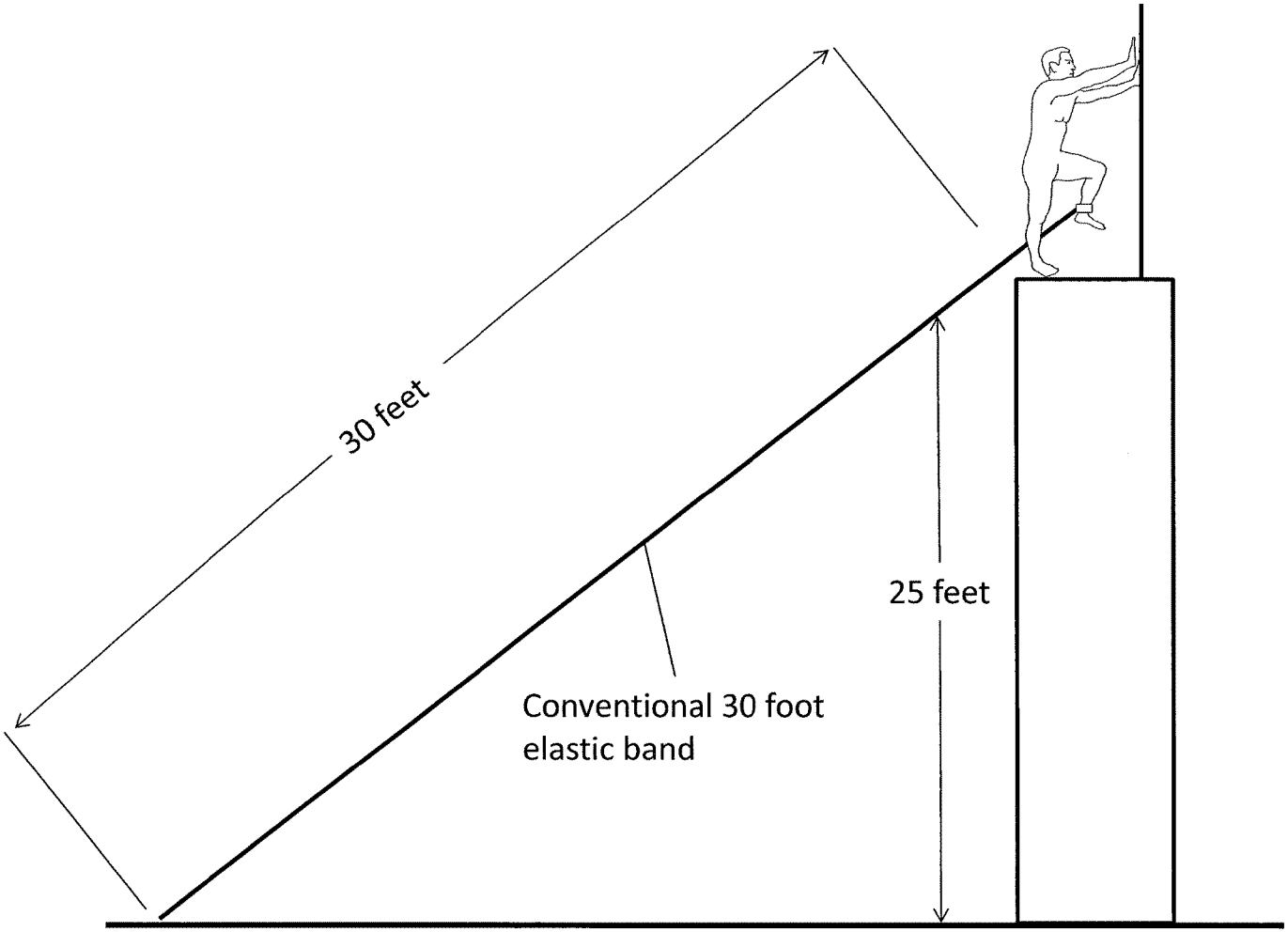
FIG. 15 is a trainee performing an exercise on a pedestal
Figure 16:
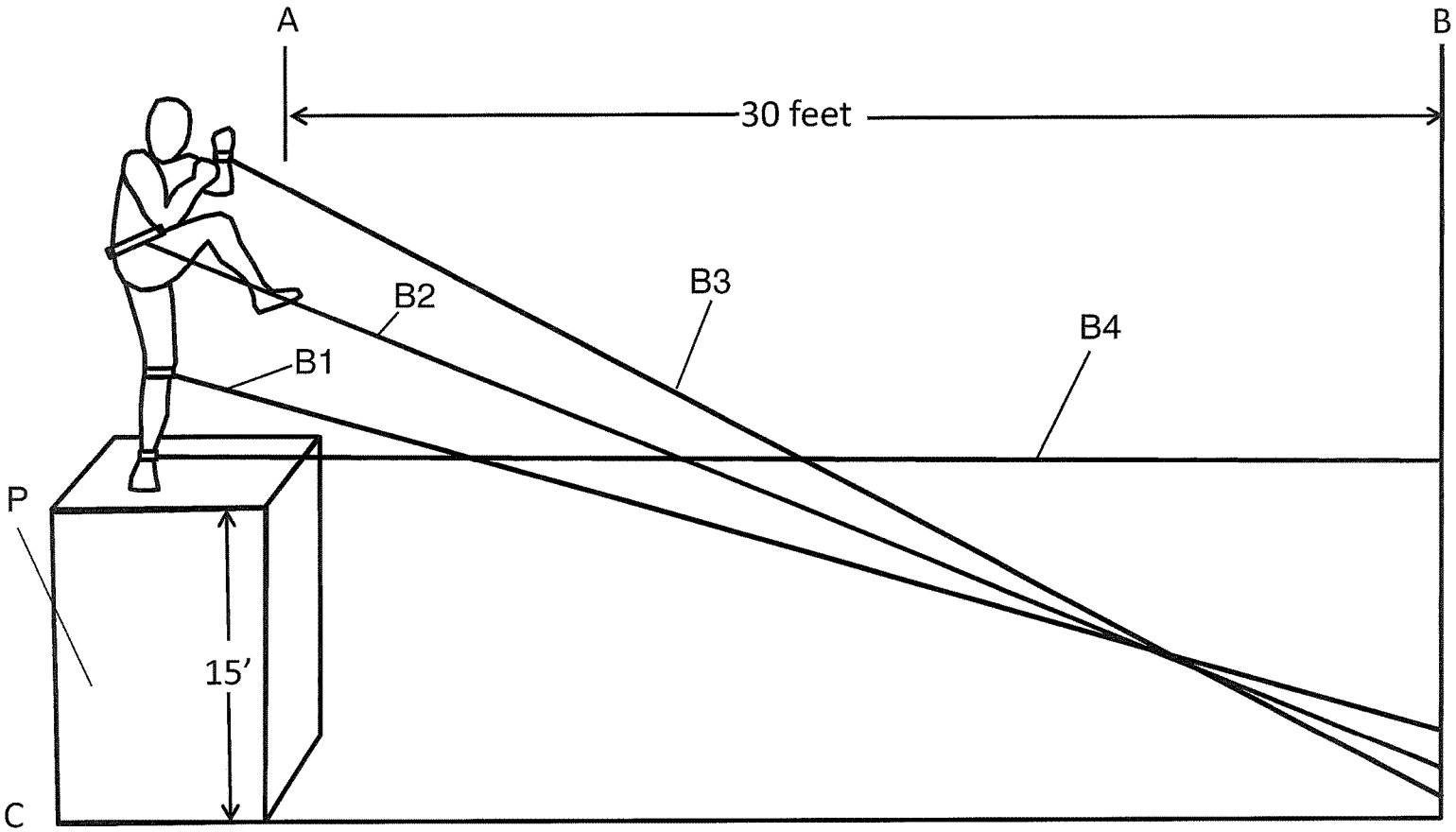
FIG. 16 is a trainee performing an exercise on a pedestal
Figure 17:
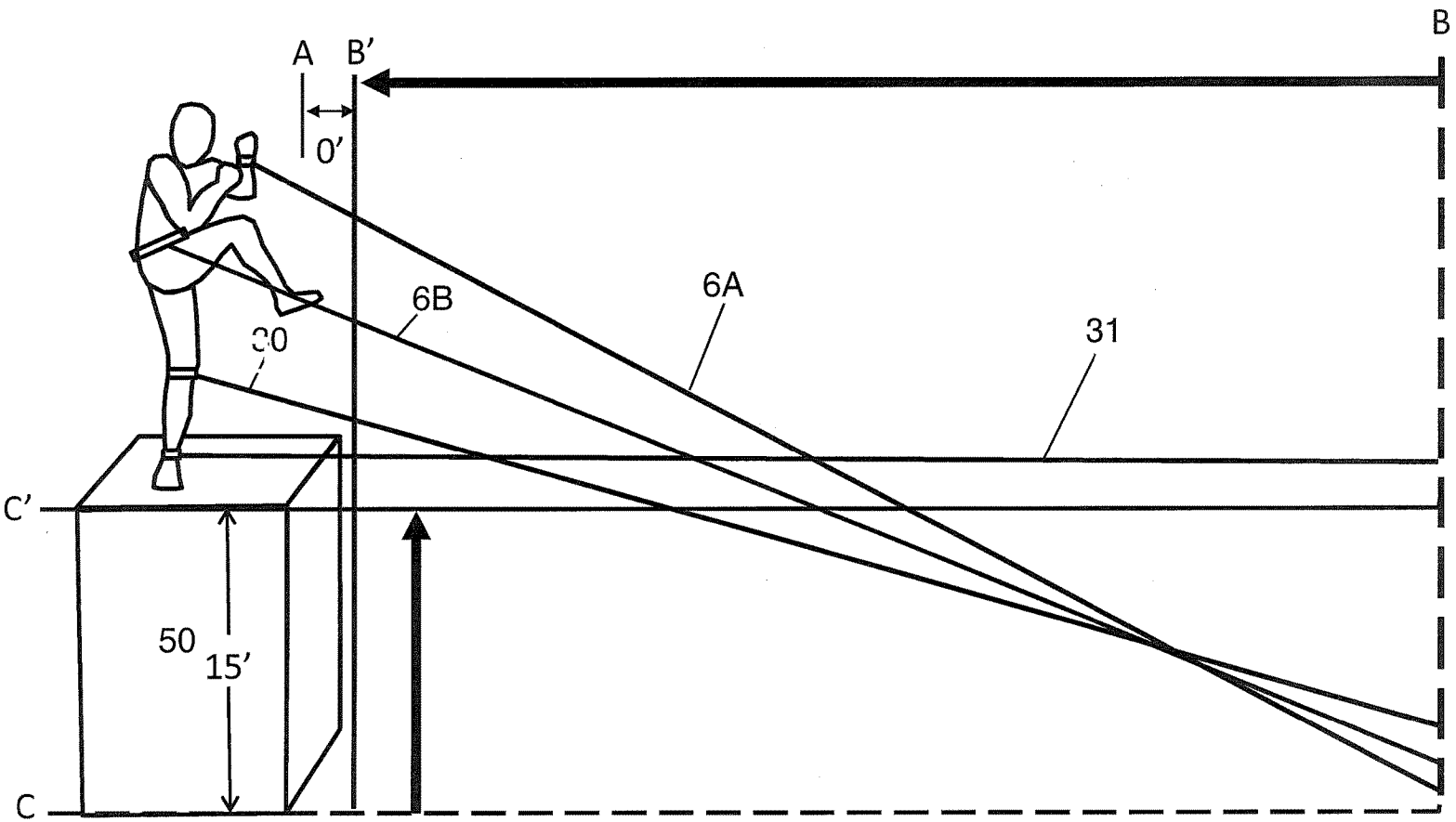
FIG. 17 is a trainee performing an exercise on a pedestal
Figure 18:
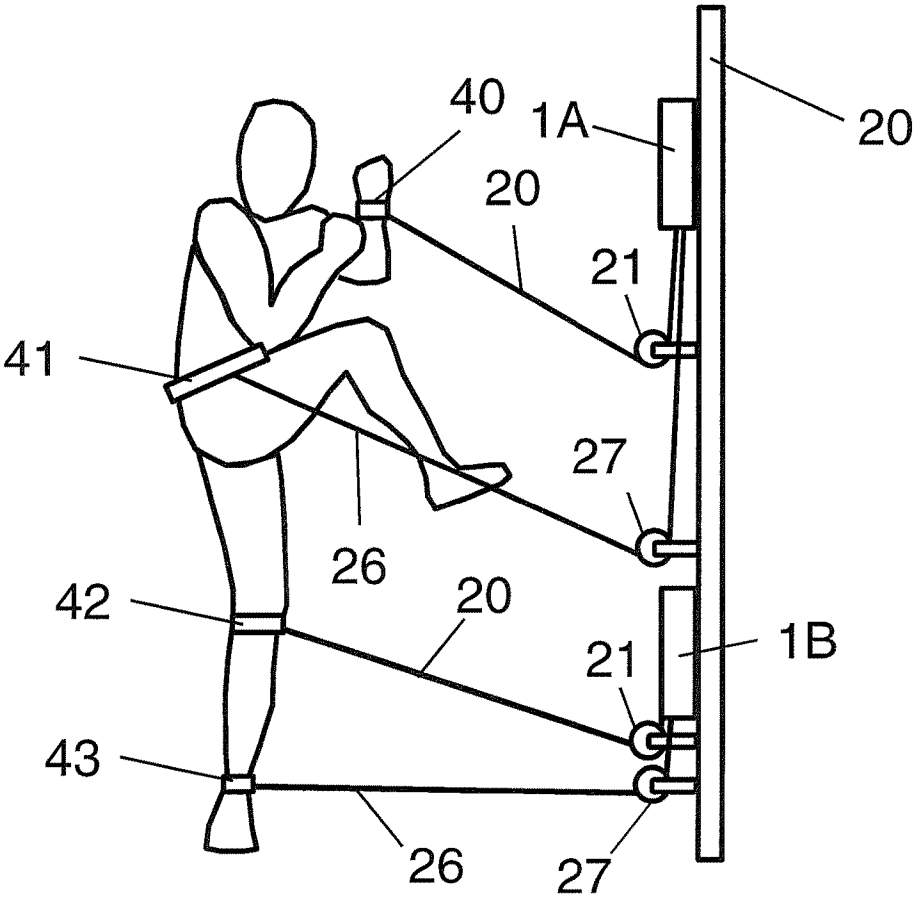
FIG. 18 is one embodiment of the present disclosure for performance exercise 16-17
Figure 19:
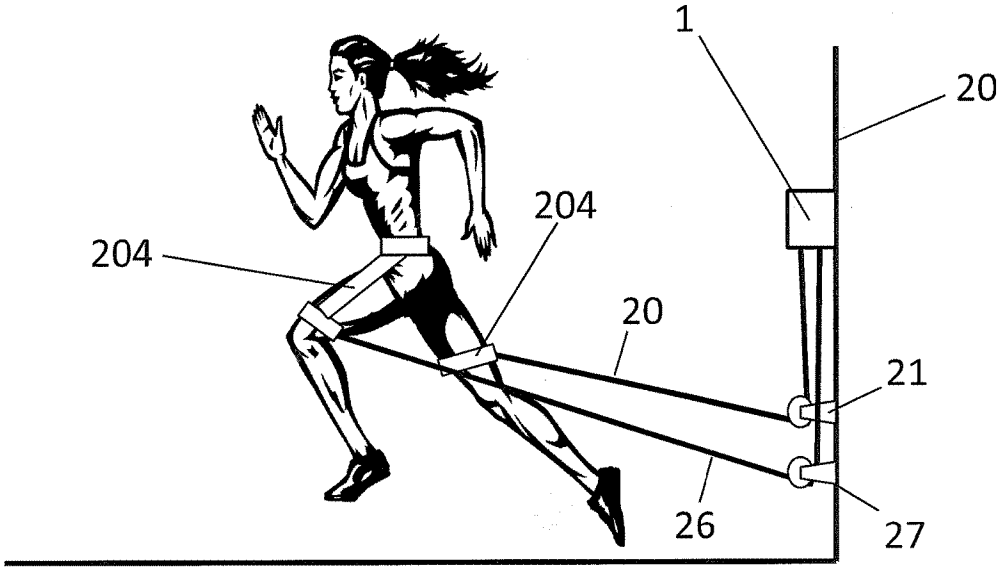
FIG. 19 is one embodiment of the present disclosure for running exercise
Figure 20:
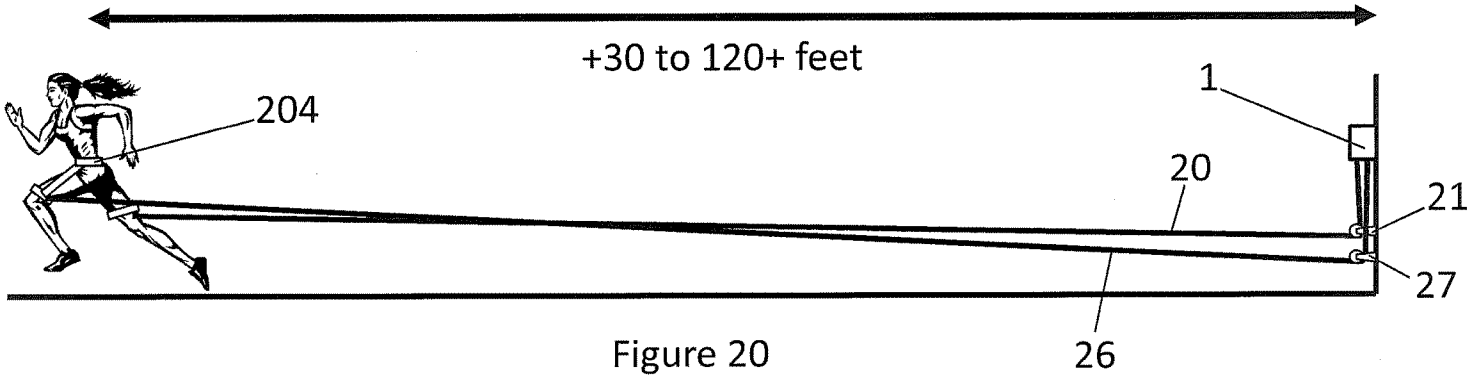
FIG. 20 is one embodiment of the present disclosure for running exercise
Figure 48:
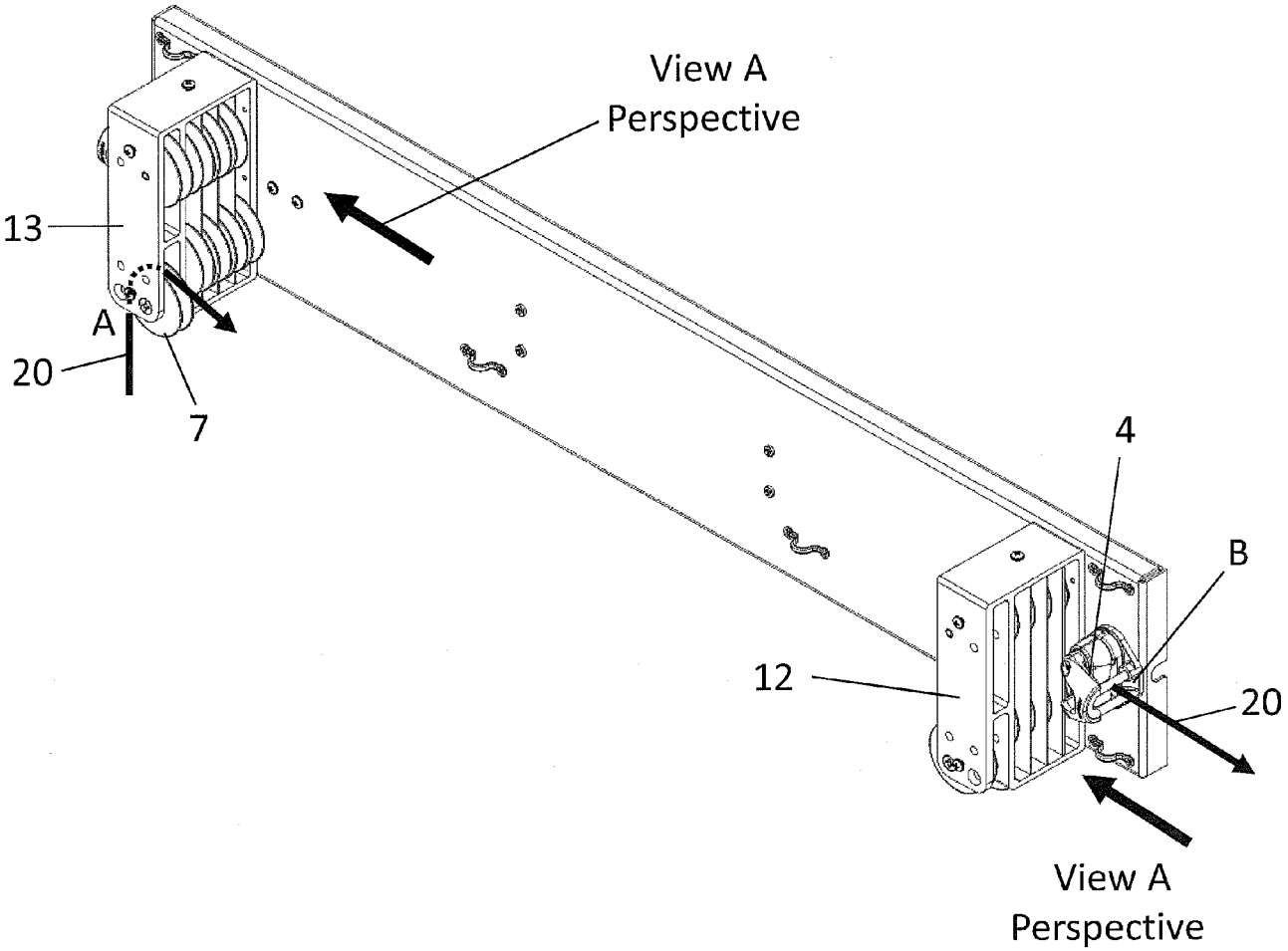
FIG. 48 is a prospective view of the pulley housing
Figure 49:
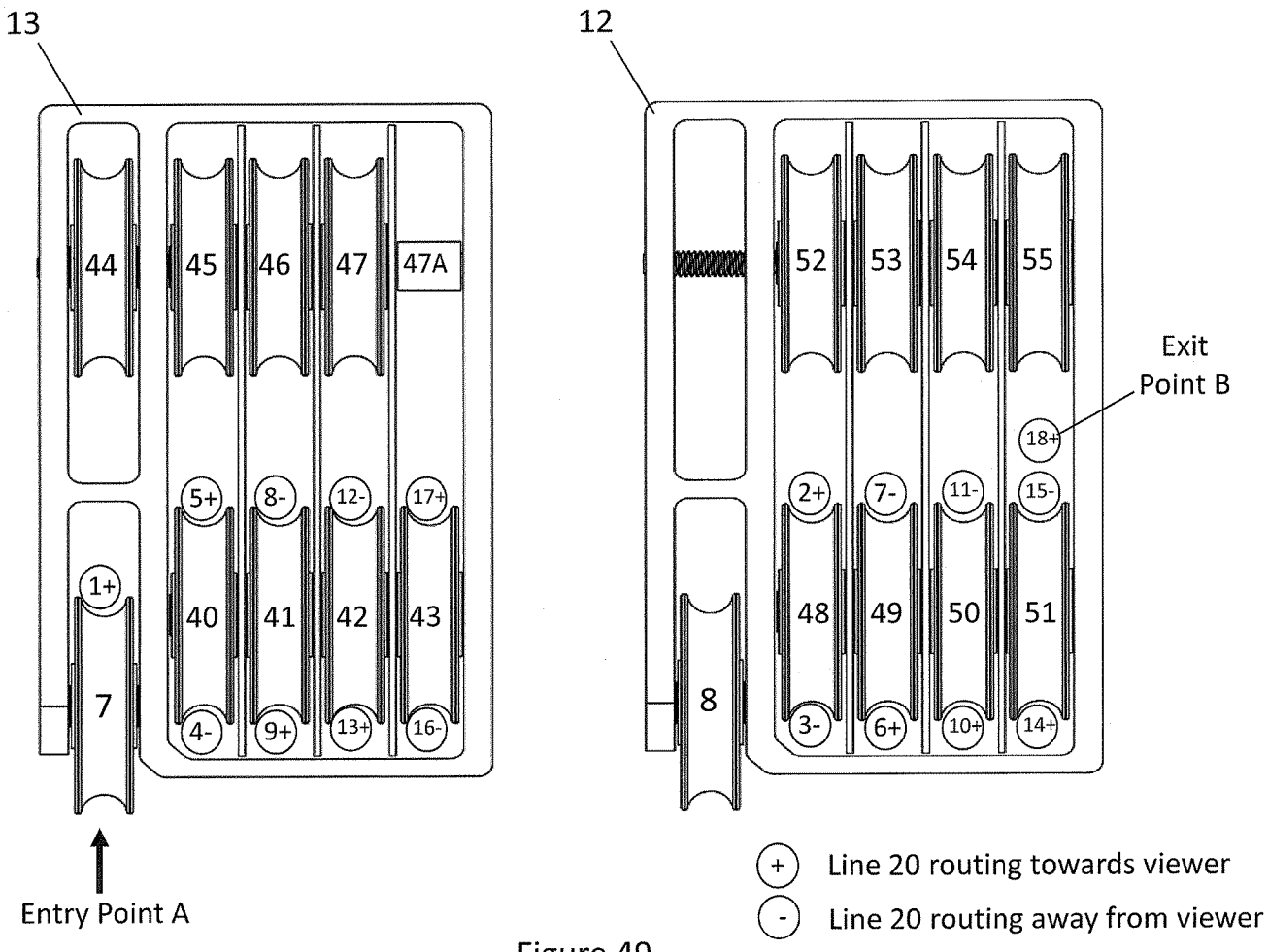
FIG. 49 is a view showing the housings

FIG. 48 shows a perspective view of one embodiment of the present disclosure. FIG. 49 shows housing 12 offset from housing 13 along perspective A of FIG. 48. Housing 12 is closer to the viewer than housing 13. Element (1+) is the first routing with band 20 corning up the back side of pulley 7 and then coming straight at the viewer (+) and then passing over the top of pulley 48 (2+) still moving toward the viewer. The band turns down pulley 48 and then runs away from the viewer (3−) back towards housing 13 entering the bottom side of pulley 40 still moving away from the viewer (4−). It then runs up the back side of pulley 40 and comes over the top straight at the viewer (5+) and then crosses to the bottom side of pulley 49 (6+) coming straight toward the viewer and then moving up the front side of pulley 49 and turning away from the viewer (7−) and heading back to housing 13 and entering the top side of pulley 41 moving away from the viewer (8−). It then turns down the back side of pulley 41 and comes out the bottom toward the viewer (9+) and passes under pulley 50 toward viewer (10+) and then up the front side of pulley 50 and then away from the viewer towards housing 13 (11−). (11−) crosses the module and enters the top of pulley 42 moving away from the viewer (12−) and then down the back side of pulley 42 and out the bottom toward the viewer and housing 12 (13+). 13+ comes across to housing 12 entering the bottom of pulley 51 (14+) moving toward the viewer and then up the front face of pulley 51 and back towards housing 13 (15−). On the way towards housing 13 the band drops and enters pulley 43 moving away from the viewer (16−) and then wraps around the back side of pulley 43 and comes towards the viewer (17+) and exits cam cleat 4 (18+) exit point B. Note there are two counter rotations in this routing where the band makes a "FIG. 8". This is done to help minimize twisting of the band.

Figure 50:
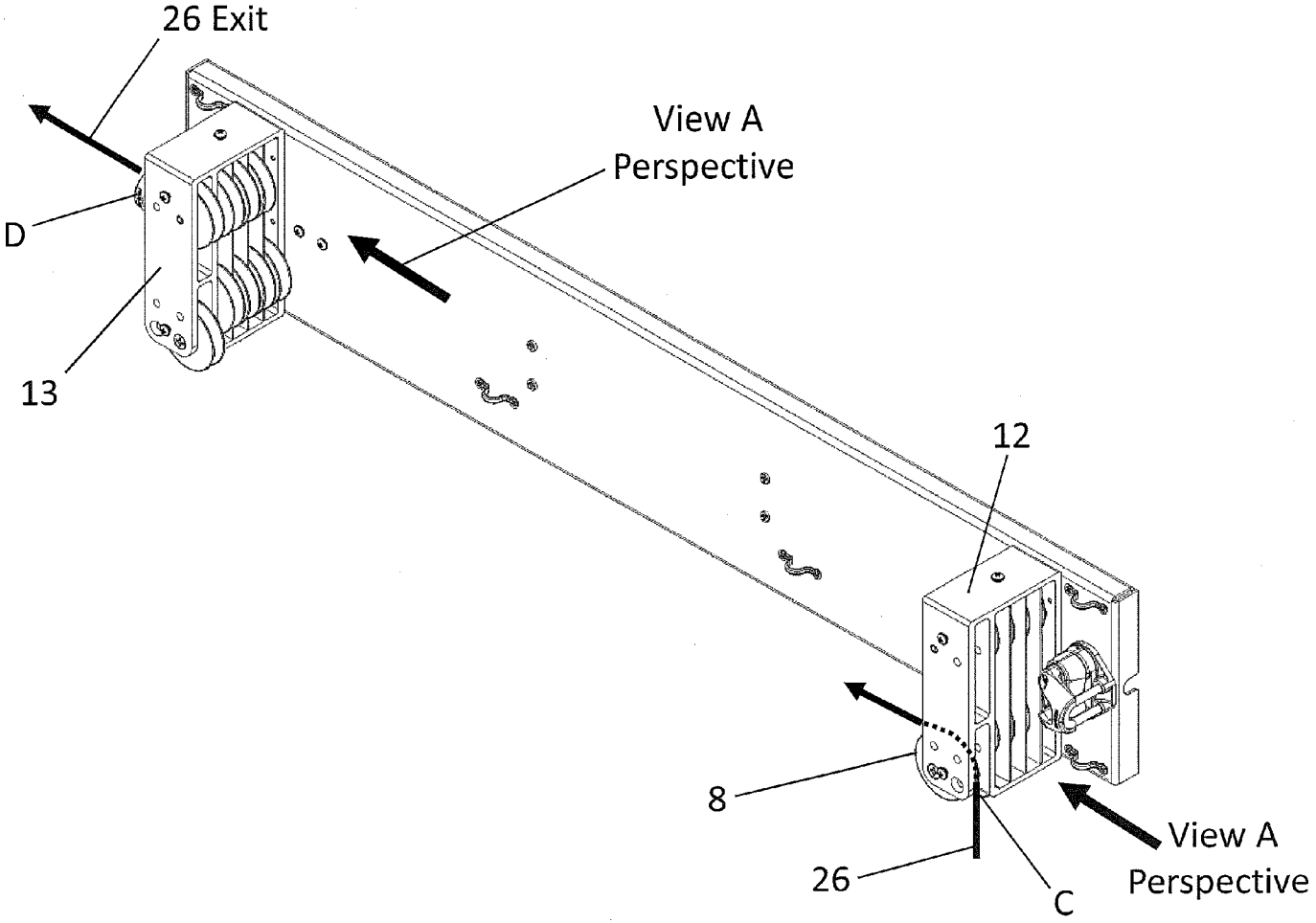
FIG. 50 is a perspective view for routing band around entry pulley in the training module
Figure 51:
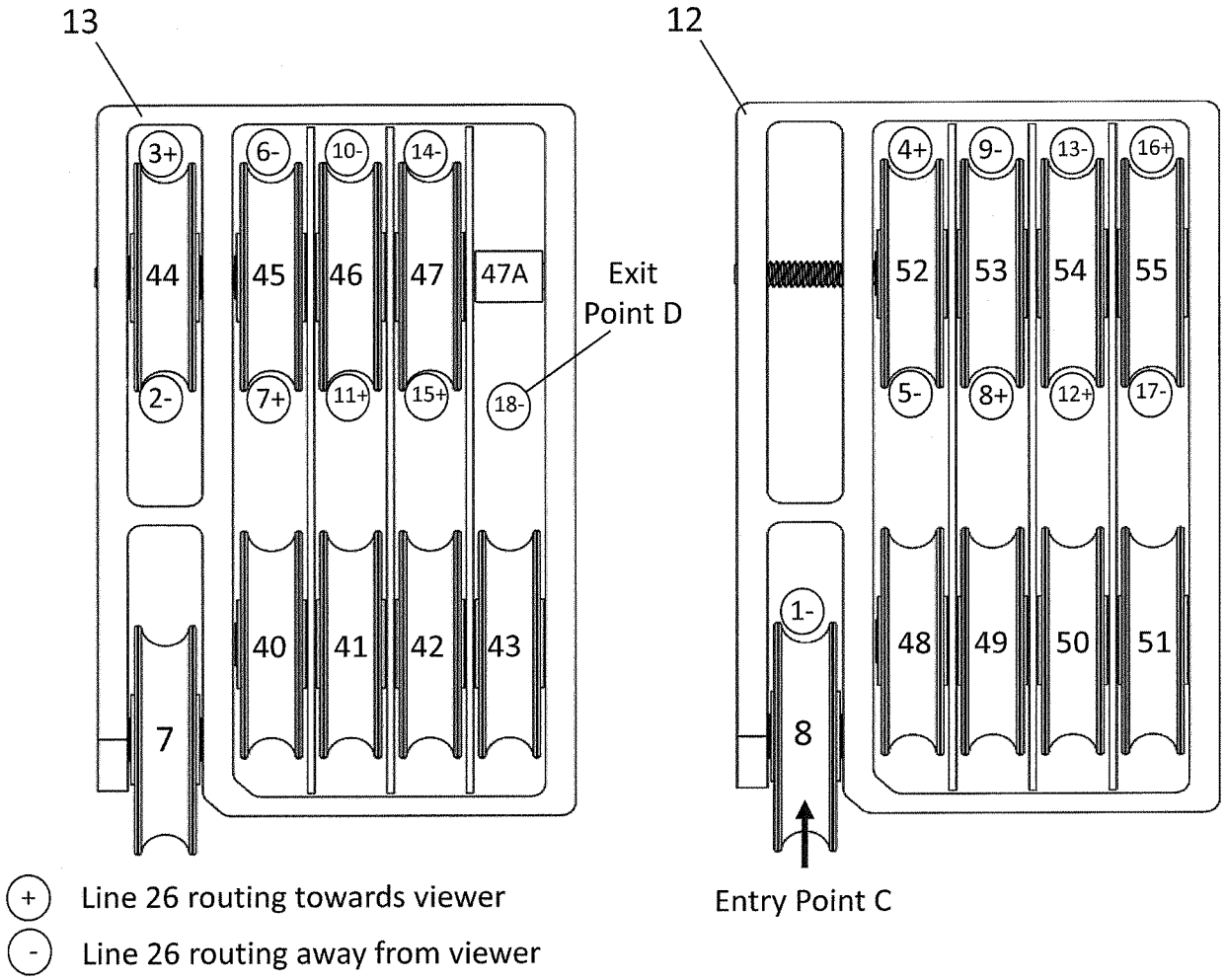
FIG. 51 is a perspective view for routing of resistance band

FIG. 50 shows the perspective for routing band 26 around entry pulley 8 at point C. Referencing FIG. 51 band 26 runs up the front side of pulley 8 and then over the top away from the viewer (1−) towards housing 13 and then entering the lower part of pulley 44 (2−). It then runs up the back side of pulley 44 and comes over the top straight at the viewer (3+) and then comes in the top side of pulley 52 towards the viewer (4+). It then comes down the front side of pulley 52 and out the bottom of pulley 52 moving away from the viewer (5−) it then crosses to the top side of pulley 45 (6−) and then moving down the back side pulley 45 and turning towards the viewer (7+) and heading towards housing 12 and entering the bottom side of pulley 53 (8+) moving toward the viewer and up the face of pulley 53 and then over the top away from the viewer towards housing 13 (9−) to the top of pulley 46 (10−) and then down the back side of pulley 46 and out the bottom towards the viewer (11+) to the bottom side of pulley 54 (12+) and up the front side of pulley 54 and back over the top towards housing 13 (13−). Then entering the top side of pulley 47 moving away from the viewer (14−) and then down the back side of pulley 47 and out the bottom towards the viewer and housing 12 (15+). Then crossing to the top of pulley 55 and over the top towards the viewer (16+) and then down the front face of pulley 55 and out the bottom towards housing 13 (17−). Then out cam cleat 5 exiting at point D (18−).

Figure 53:
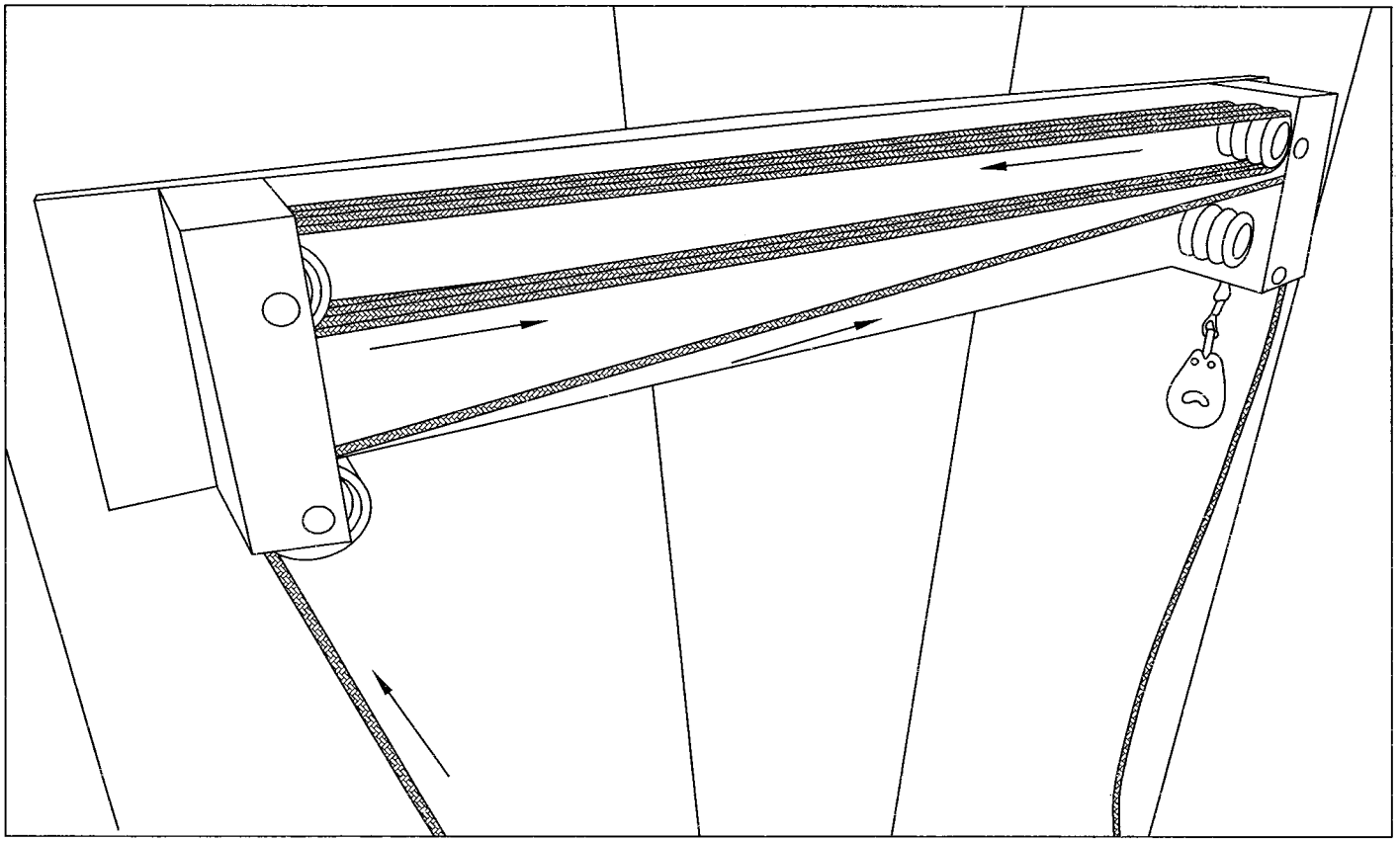
FIG. 53 is a view showing the pulley in the training module
Figure 54:
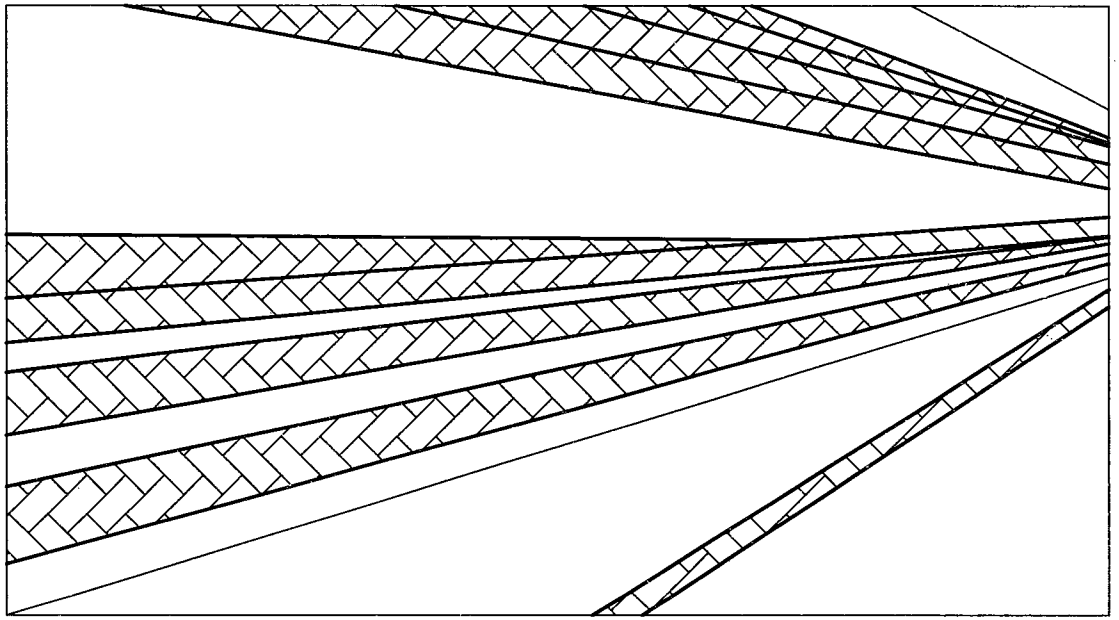
FIG. 54 is a view of counter clockwise cord routing in module
Figure 55:
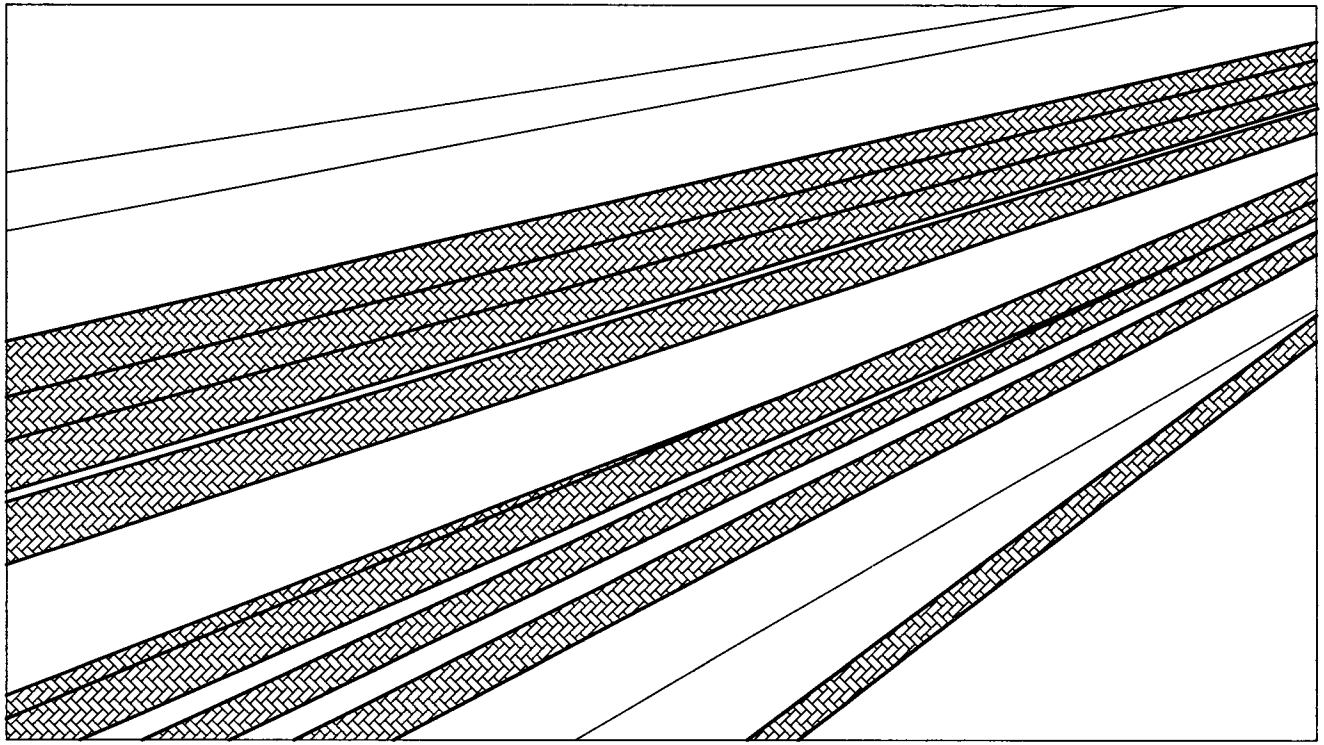
FIG. 55 is a view showing another pulley in the training module
Figure 56:
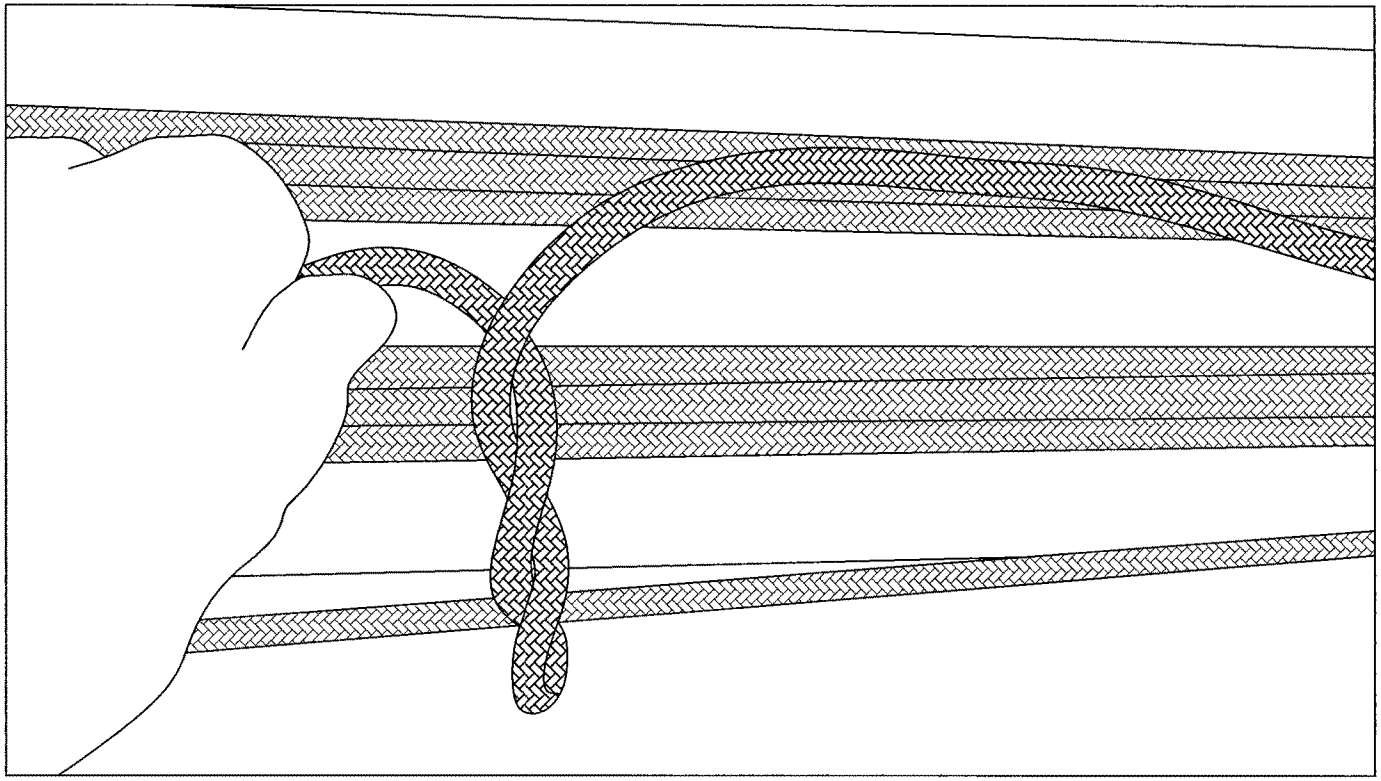
FIG. 56 is a view of a twisted elastic band

In one aspect, the present disclosure provides a novel design to reduce the twisting effect on the elastic bands as the bands are stretched and contracted. FIG. 53 illustrates a counter clockwise elastic band routing entering the power module at the lower left and moving in a counter clockwise direction as it is routed between pulley stacks and then out the right side of the module. FIG. 54 shows a close up photo of the elastic band after routing and before it is extracted and retracted from the module. FIG. 55 shows what the elastic band looks like after pulling band 20 out to a distance of 40 feet and letting it retract back into the module 20 times. All 9 elastic runs became severely twisted. As the twisting increases the elastic bands will loop and tangle upon retraction causing a lock up (see FIG. 56).

Figure 57:
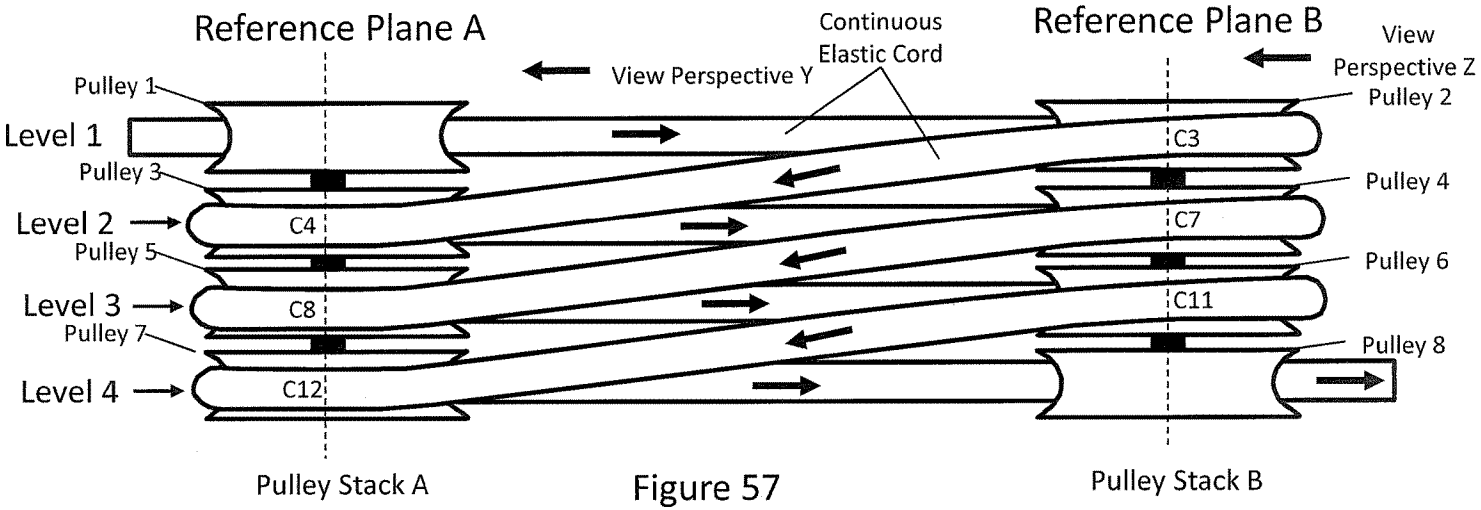
FIG. 57 is a side view of two pulley stacks
Figure 58:
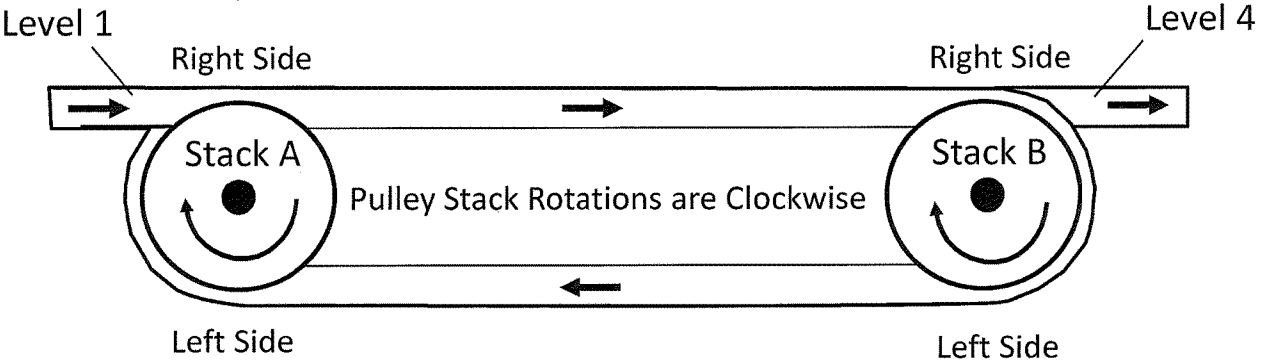
FIG. 58 is a top view of pulley stacks

FIG. 57 shows a side view of a four level clockwise rotational elastic band routing between two pulley stacks where there is no level change on the back side of the stack when the band traverses from Pulley Stack A to Pulley Stack B and a level change on the near side of the stack every time the band moves from Pulley Stack B to Pulley Stack A. Note the dotted line labeled Reference Plane A that cuts through Pulley Stack A and also the dotted line labeled Reference Plane B that cuts through Pulley Stack B. FIG. 58 shows a top view of Pulley Stacks A and B for the routing illustrated in FIG. 57.

Figure 59:
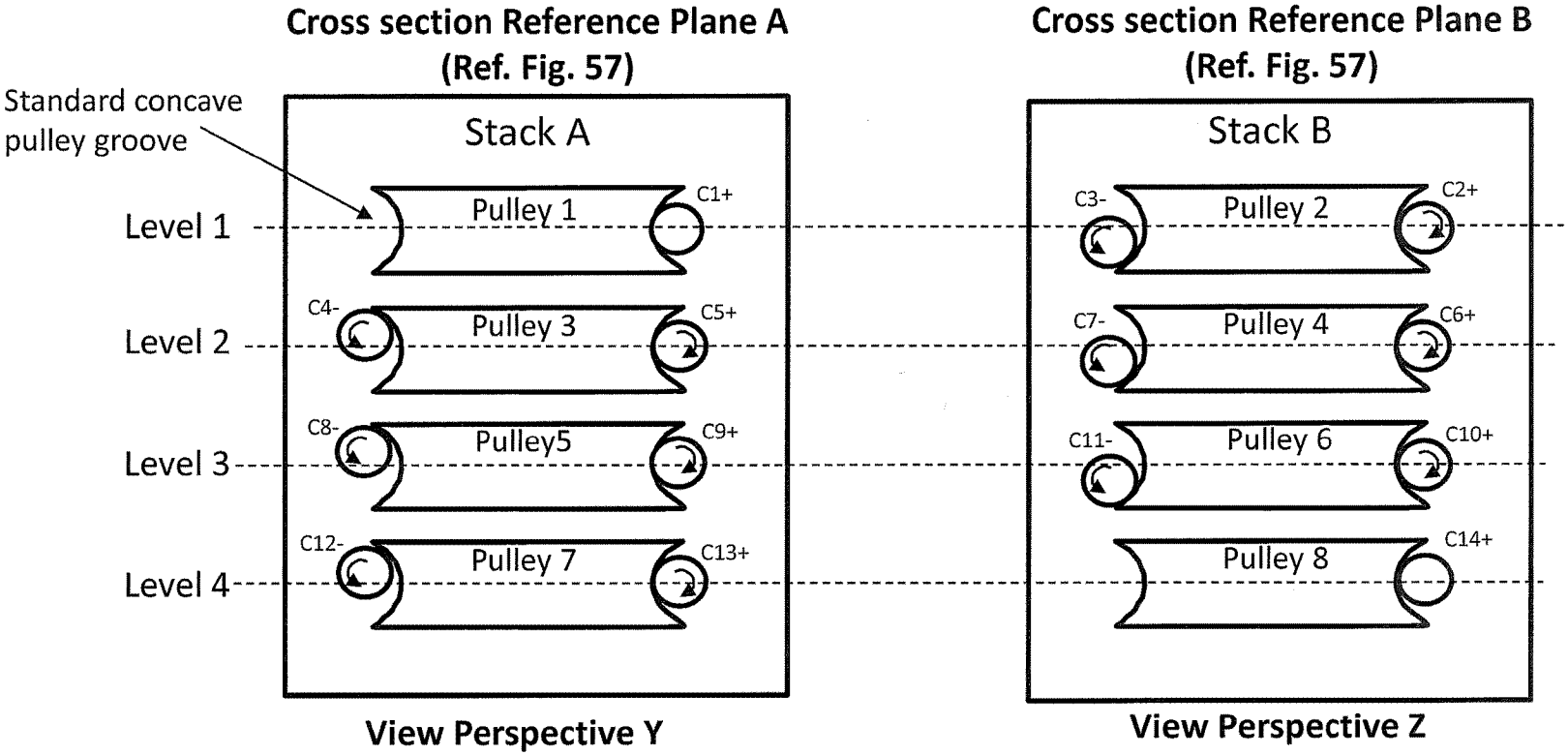
FIG. 59 is a cross section view from FIG. 58
Figure 60:
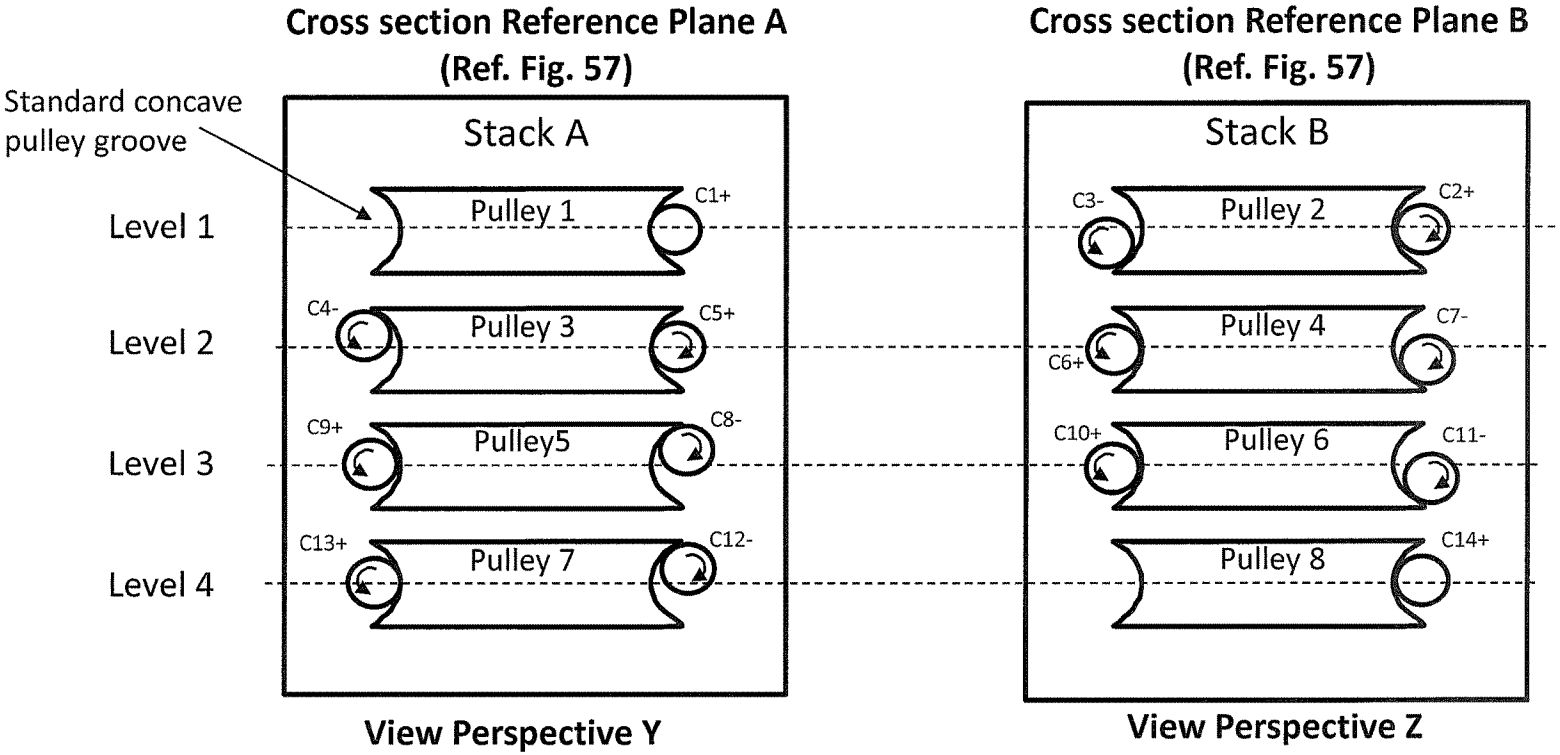
FIG. 60 is a cross section of FIG. 57

Referencing FIG. 59 showing the cross-section from FIG. 58, each band traveling from the right side of Stack A to the right side of Stack B does not change elevation. Because there is no elevation change the band rests on the center of each pulley groove on the right side of each pulley stack (see bands centered on dotted Level 1-4 reference lines). However, when an elevation change occurs on the left side of the pulley stacks where each band leaving Pulley Stack B drops one level as it traverses to Pulley Stack A, the bands are forced to move out of center position because of the elevation change. Following band C1+ leaving Pulley 1 in Stack A coming toward the viewer (+) reaches Pulley 2 of Pulley Stack B (C2+). As C2+ wraps around Pulley 2 it is forced to roll clockwise into position indicated by (C3−) (lower left side Pulley 2, Stack B) which looks like a counter clockwise direction now since the band has turned 180 degrees from C2+ to C3−. When C3− leaves Pulley Stack B it must drop to Level 2. The higher elevation of Pulley 2 forces C4− to the upper left of Pulley 3 while the lower elevation of Pulley 3 forces C3 to the lower left of Pulley 2. As C4 turns around the back side of Pulley 3 it will have to roll to the center of the Pulley 3 center groove marked by the Level 2 dotted line which again appears as a clockwise rotation from the C5 perspective. This process repeats its self every time a complete cycle is made around each pulley stack. As the band is extracted out of the power module under tension the rotation effect is greatest in the clockwise direction. As the band is retracted under less tension the band rotation does reverse but all the rotation on the extraction under force is not fully counteracted on the retraction thus for every extraction/retraction cycle there is a net buildup of clockwise twist. If the module design does not compensate for this effect the elastic bands will deform and the module will foul. FIG. 60 represent one of four design solutions (Counter Rotation) which can be used individually or in conjunction with one another to correct the band twisting issue.

In FIG. 60 Pulley 2 and Pulley 3 are routed the same as in FIG. 59. However, when C5 leaves the right side of Pulley 3 and traverses to Stack B Pulley 4, it doesn't go to the right side of Pulley 4. It instead goes to the left side of Pulley 4 (C6+) and now wraps around Pulley 4 in the counter clockwise direction. The counter clockwise direction continues until C13 leaves the left side of Pulley 7 and crosses over to the right side of Pulley 8 (C14+) turning Pulley 8 clockwise. Periodically reversing the band routing direction will counteract the twisting by reversing the roll direction of the band when it drops a level. The number of counter rotations required to reduce band twisting for a power module will depend the number of pulley levels and elevation drop between levels.

Figure 61:
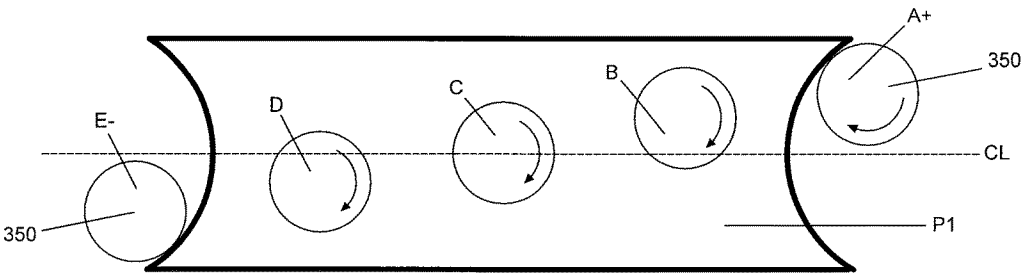
FIG. 61 is a view referencing pulley P1
Figure 62:
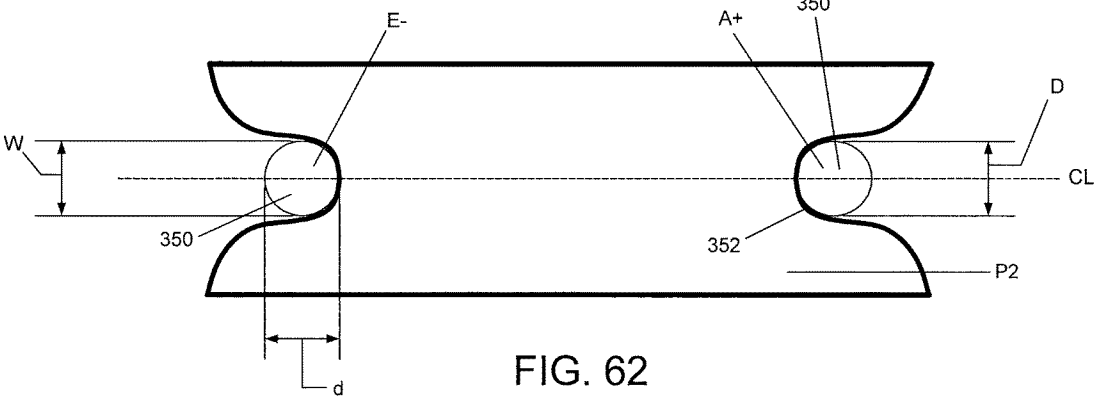
FIG. 62 is a view referencing Pulley P2

Another embodiment to reduce band twist is illustrated in FIGS. 61 and 62. Referencing Pulley P1 in FIG. 61 a conventional concave pulley groove is illustrated which facilitates rolling of the band. If band 350 starts at position A+ because it comes from a pulley of higher elevation and leaves pulley P1 to a lower elevation then Band 350 will roll from position A+ to E− and twisting will occur. Referencing FIG. 62, if the non-conventional pulley groove is designed such that pulley P2 groove is slotted so that the elastic band 350 wedges into a groove 352 having a slightly narrower width W than the band's relaxed diameter D and the groove is as deep d as the band is wide, there will be no way for the band to roll. The band will be locked into position upon entering and exiting the pulley regardless of level changes.

Figure 63:
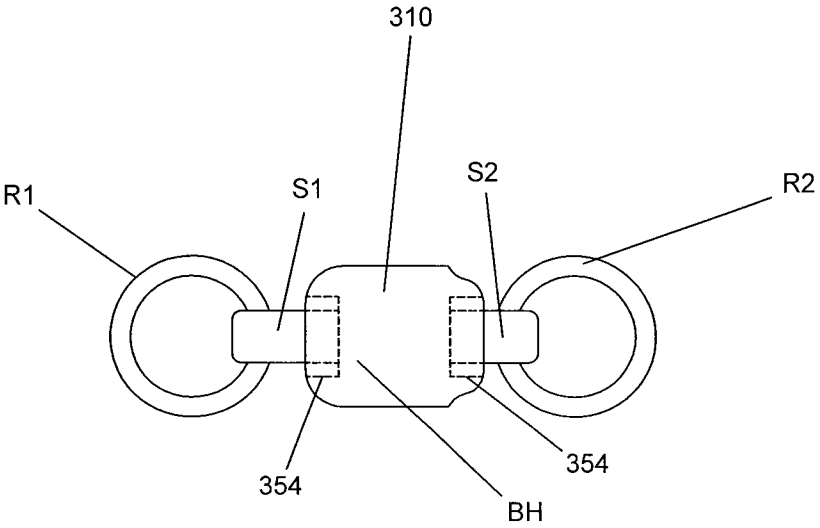
FIG. 63 is a front view of a double bearing swivel assembly
Figure 64:
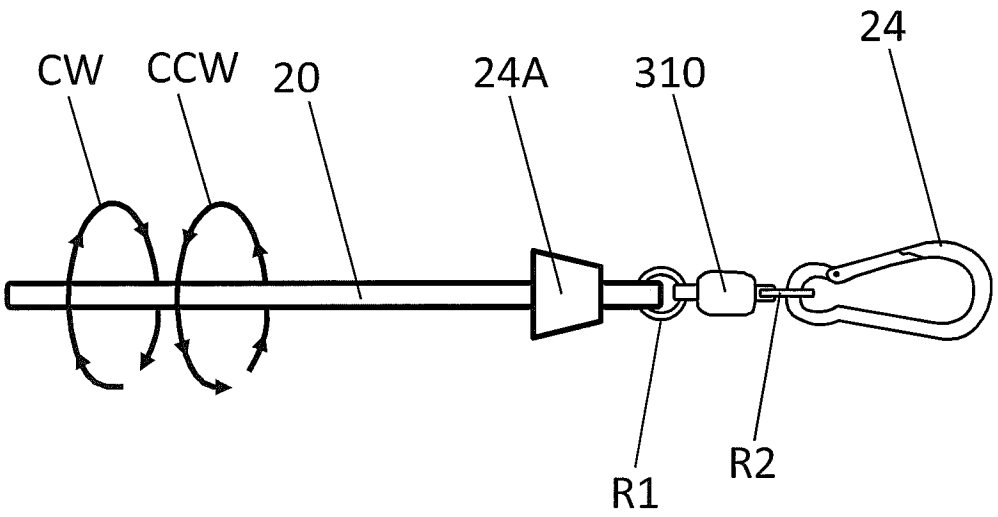
FIG. 64 illustrates an elastic band connected to a spring clip
Figure 65:
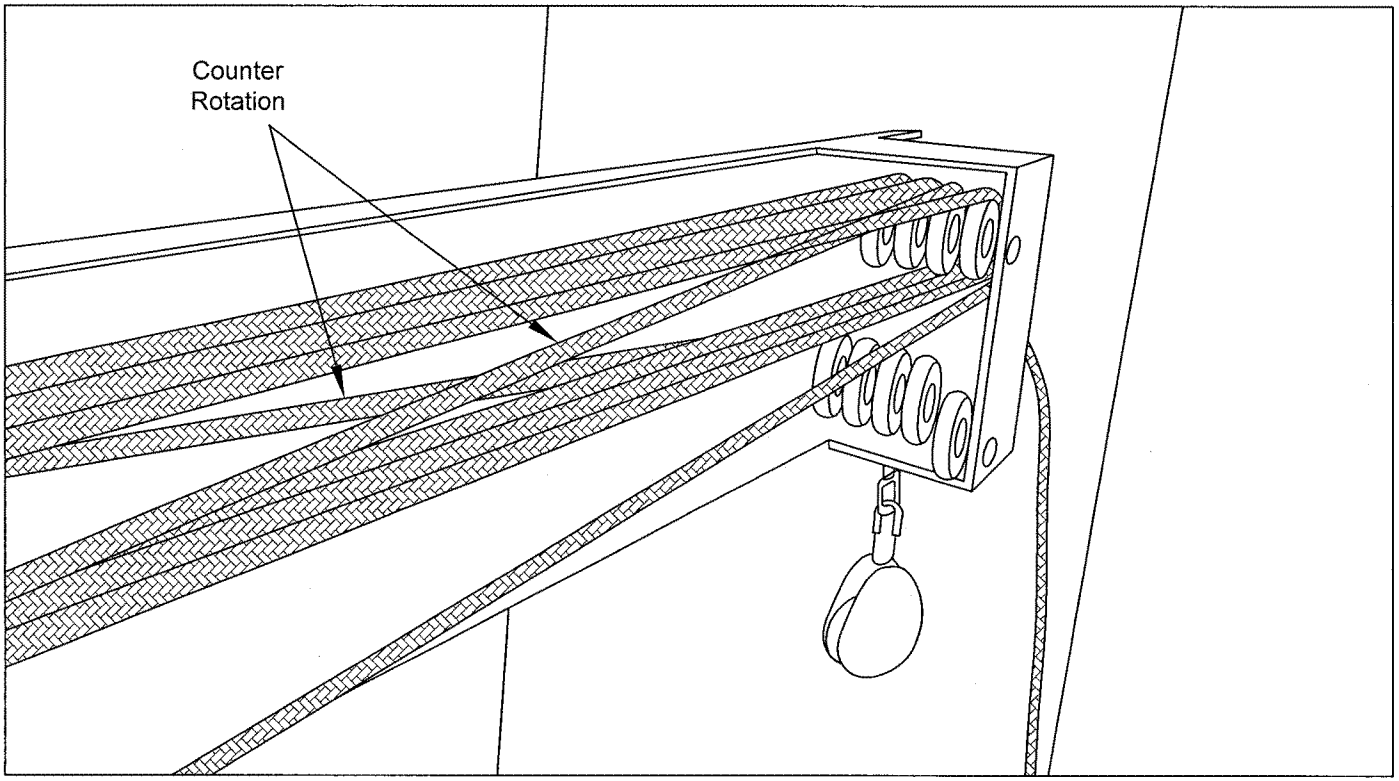
FIG. 65 illustrates the pulley system in the training module
Figure 66:
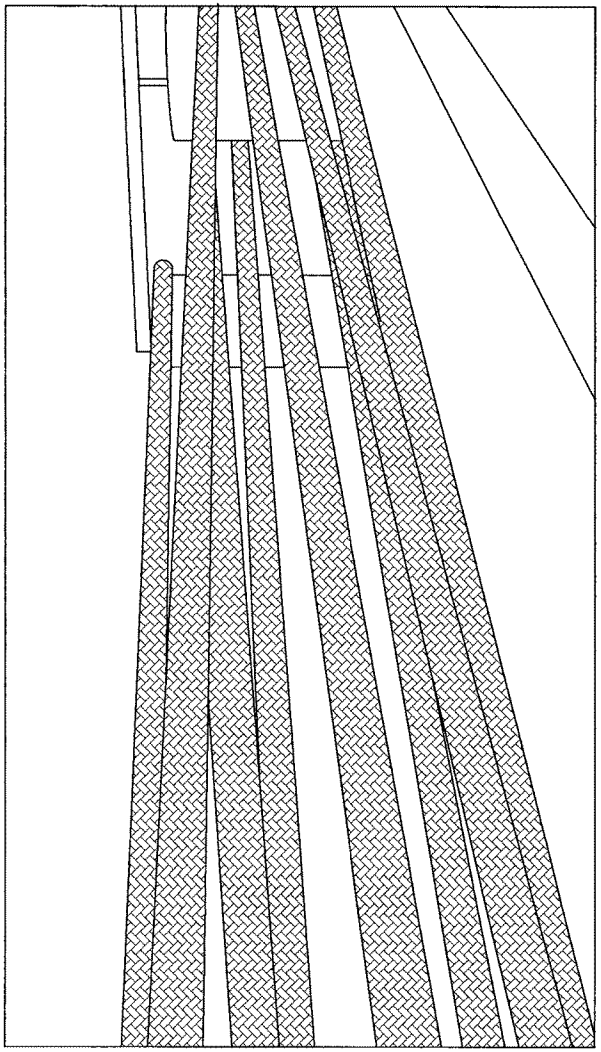
FIG. 66 illustrates the pulley system in the training module

Referencing FIG. 63, a double bearing swivel assembly 310 may be used to allow twisting to self-unwind. Bearing housing BH holds two bearing assemblies 354 allowing both shafts S1 and S2 to easily rotate independently. FIG. 64 shows how elastic band 20 is connected to ringlet R1 and a spring clip used to attach the elastic band to the Trainee's harness means is connected to ringlet R2. Both R1 and R2 spin freely in either direction allowing band 20 to rotate easily in either direction clock wise CW or counter clockwise CCW. Even under load during extraction if a twist build up occurs on extraction the swivel bearing assembly can eliminate it allowing the elastic bands to freely rotate.

Figure 70:
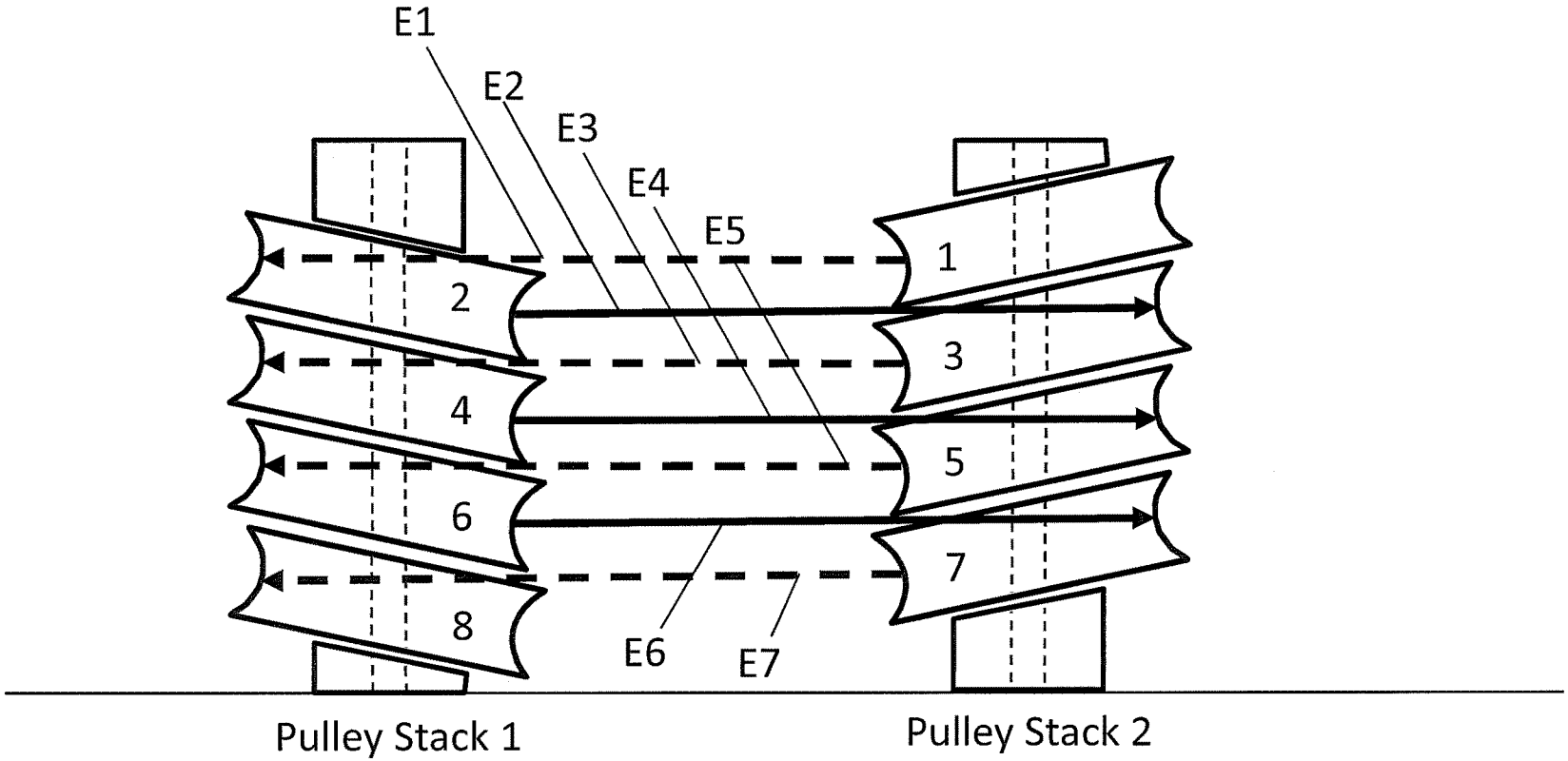
FIG. 70 illustrates two pulley systems
Figure 71:
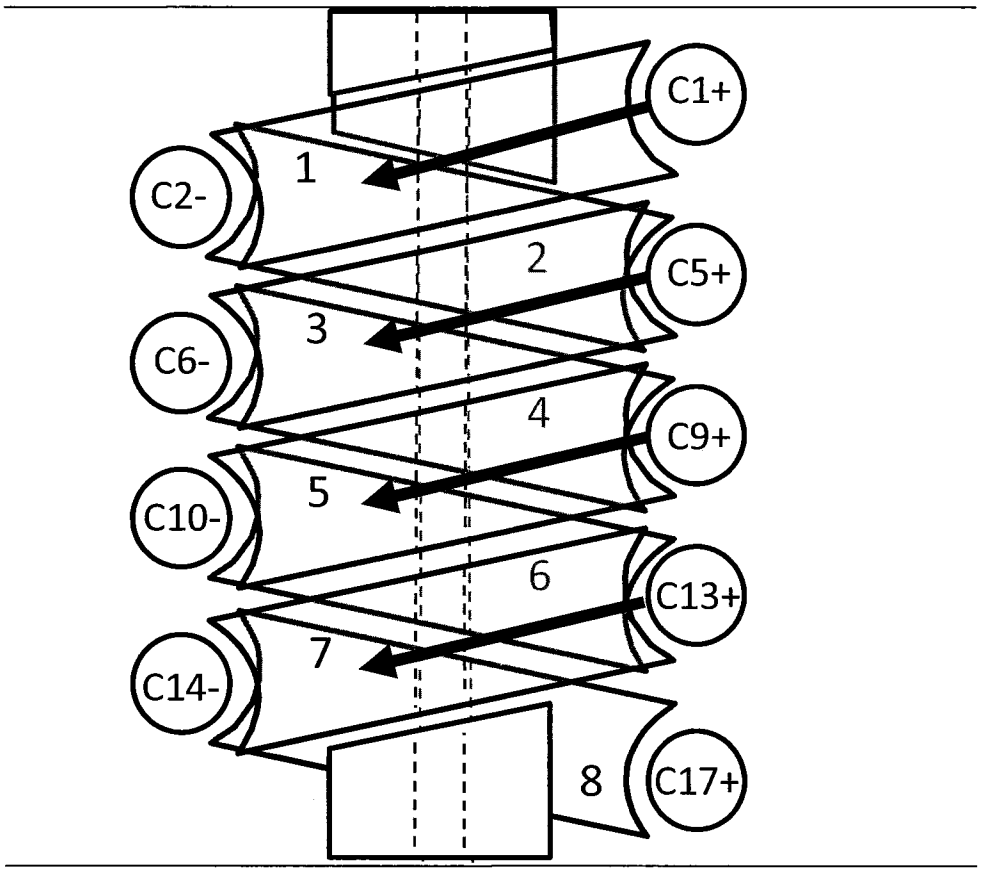
FIG. 71 illustrates a pulley stack

Another embodiment to eliminate band rolling includes tilted pulleys in each stack in opposite directions. FIG. 67 shows a top view of two pulley stacks. FIG. 68 shows a top view of the same two pulley stacks but pulley stack 2 is shifted to the right of the dotted line indicating the centerline between the two stacks. View A reference shall be used when viewing FIG. 69. Referencing FIG. 69, both sets of pulleys in stack 1 and stack 2 are angles in opposite directions by X degrees such that pulley groove centers line up with opposing pulley stacks. Referencing FIG. 70, left side Pulley 1 E1 elevation line intersects left side pulley 2 center line. Right side Pulley 2 centerline E2 intersects right side Pulley 3 center groove. Left side Pulley 3 centerline E3 intersects Pulley 4 left side center groove. This continues so all pulley groove centers match opposing stack pulley centerlines. Referencing FIG. 71, when pulley stacks 1 and 2 are realigned as showing in FIG. 67 there are no elevation drops between stacks now and thus no reason for the elastic bands to roll out of the pulley groove centers. Elevation changes are accomplished when the band is actually resting in the center groove turning around the pulley.

Figure 72:
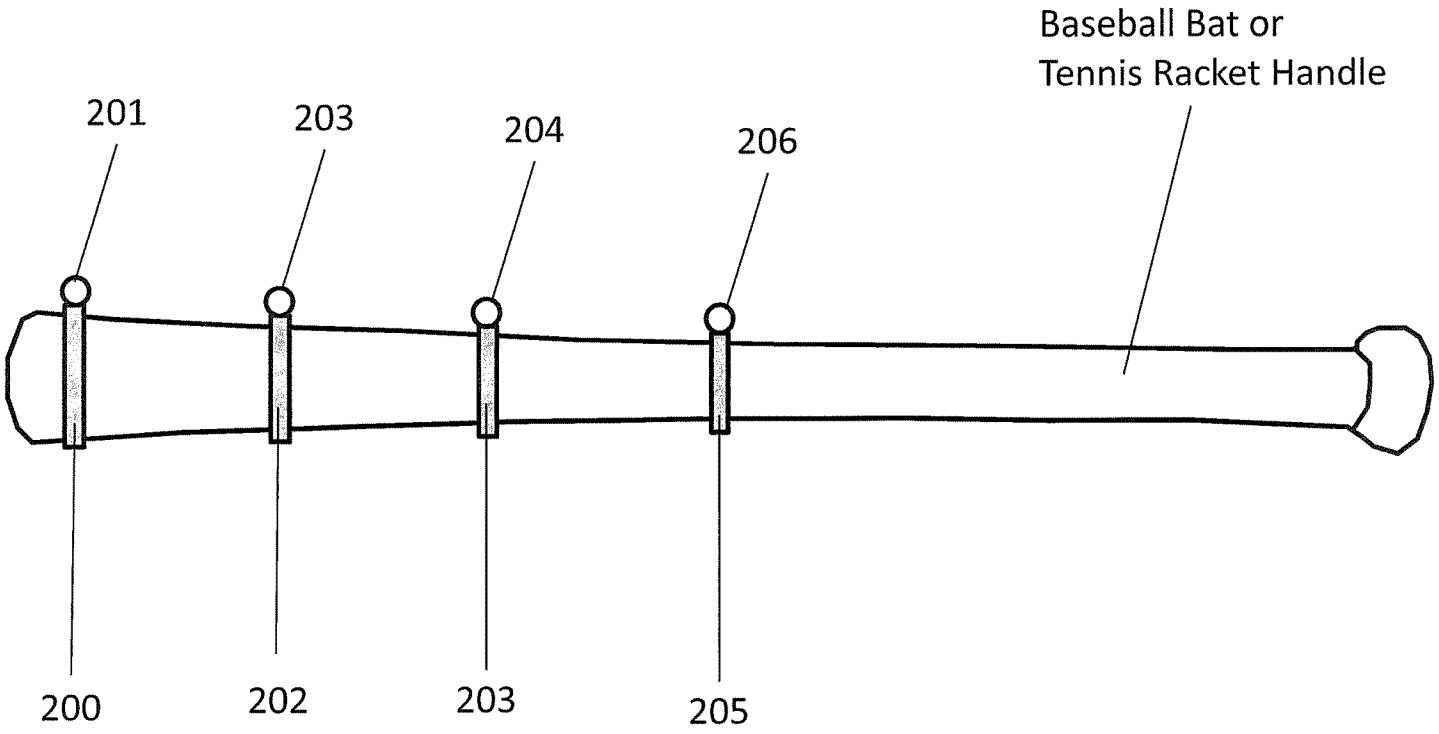
FIG. 72 illustrates another embodiment to develop hitting power

FIG. 72 illustrates another embodiment to assist baseball players and tennis players to develop hitting power. Bearings 200, 202, 203 and 205 with connector means 201, 203, 204 and 206 respectively allow resistance band connectivity to a bat or racket allowing the handle to rotate 360 degrees continuously while swinging the bat or racket. Connection points are not fixed so bearings allow rotation of the handle during the swinging motion. Also multiple connection points allow multiple band connections to apply leverage in different areas of the bat or racket while swinging.

Figure 73:
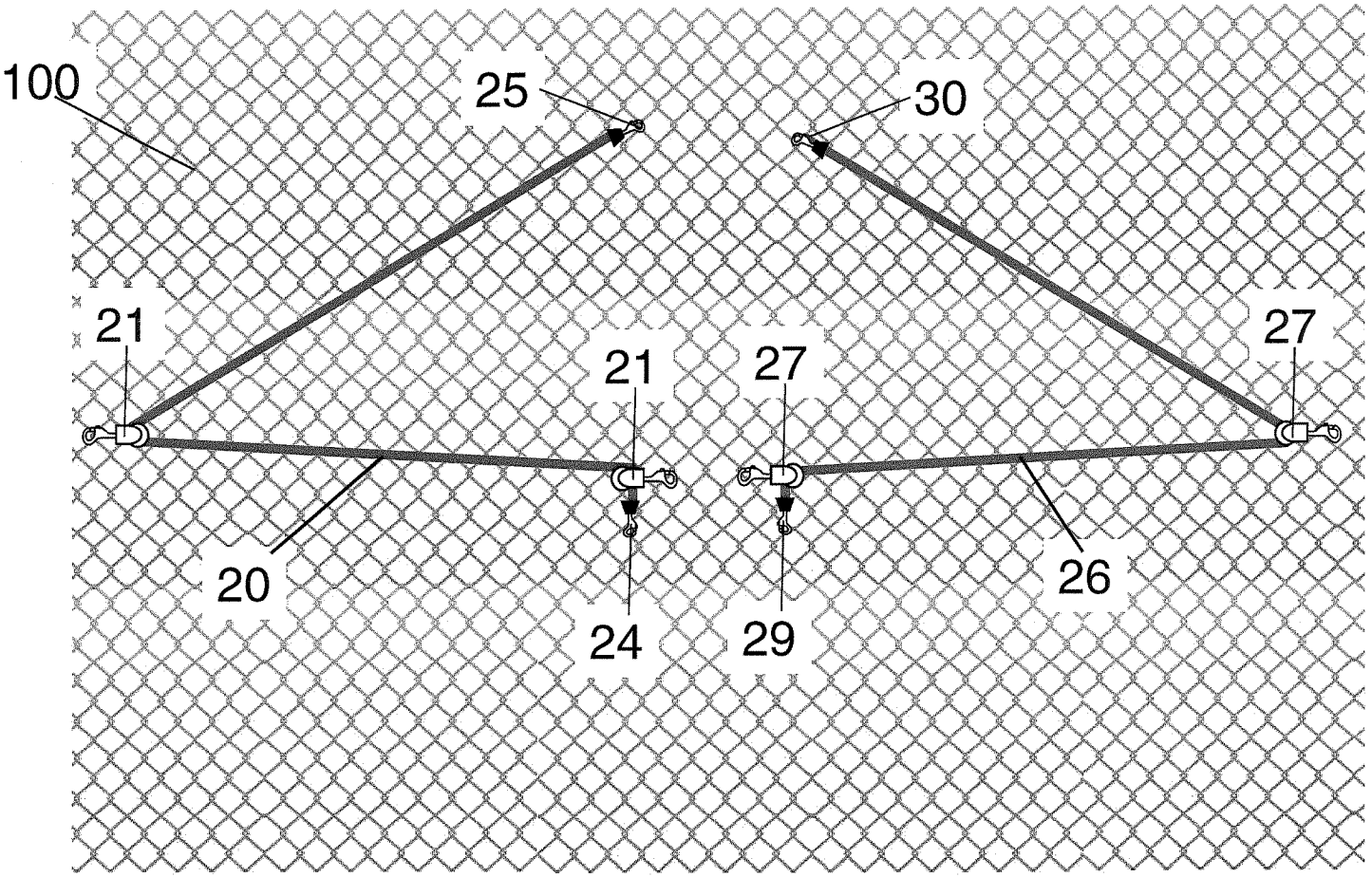
FIG. 73 illustrates another embodiment of the present disclosure

FIG. 73 illustrates another embodiment of the present disclosure where elongated bands 20 and 26 are not routed through pulley systems but are attached to a support structure 100 and utilize the VOAMs 21 and 27 to preload bands 20 and 26 at connection points 24 and 29 using hooks 25 and 30 on distal band ends.

Figure 74:
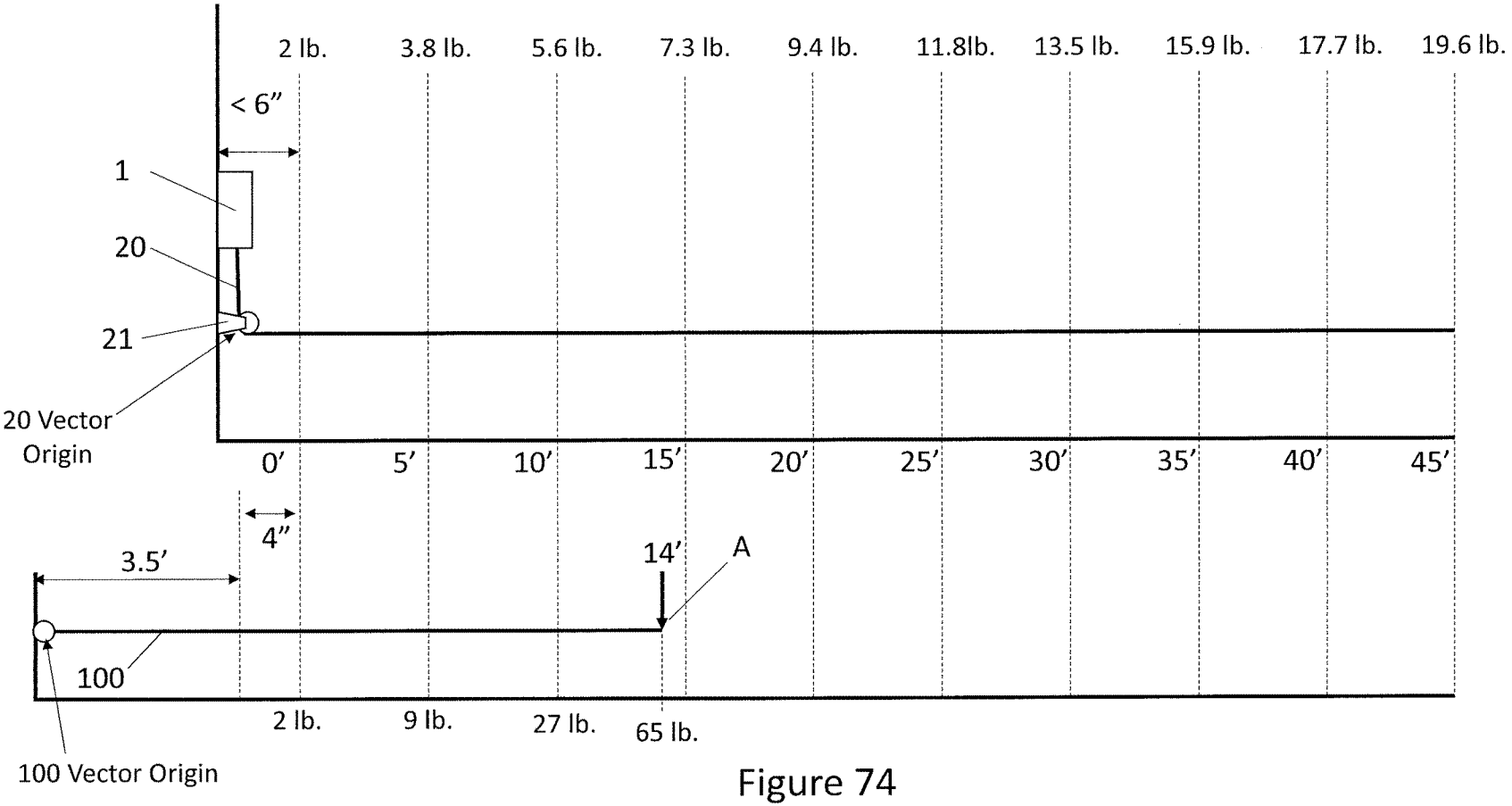
FIG. 74 illustrates the resistance provided by the elastic band
Figure 75:
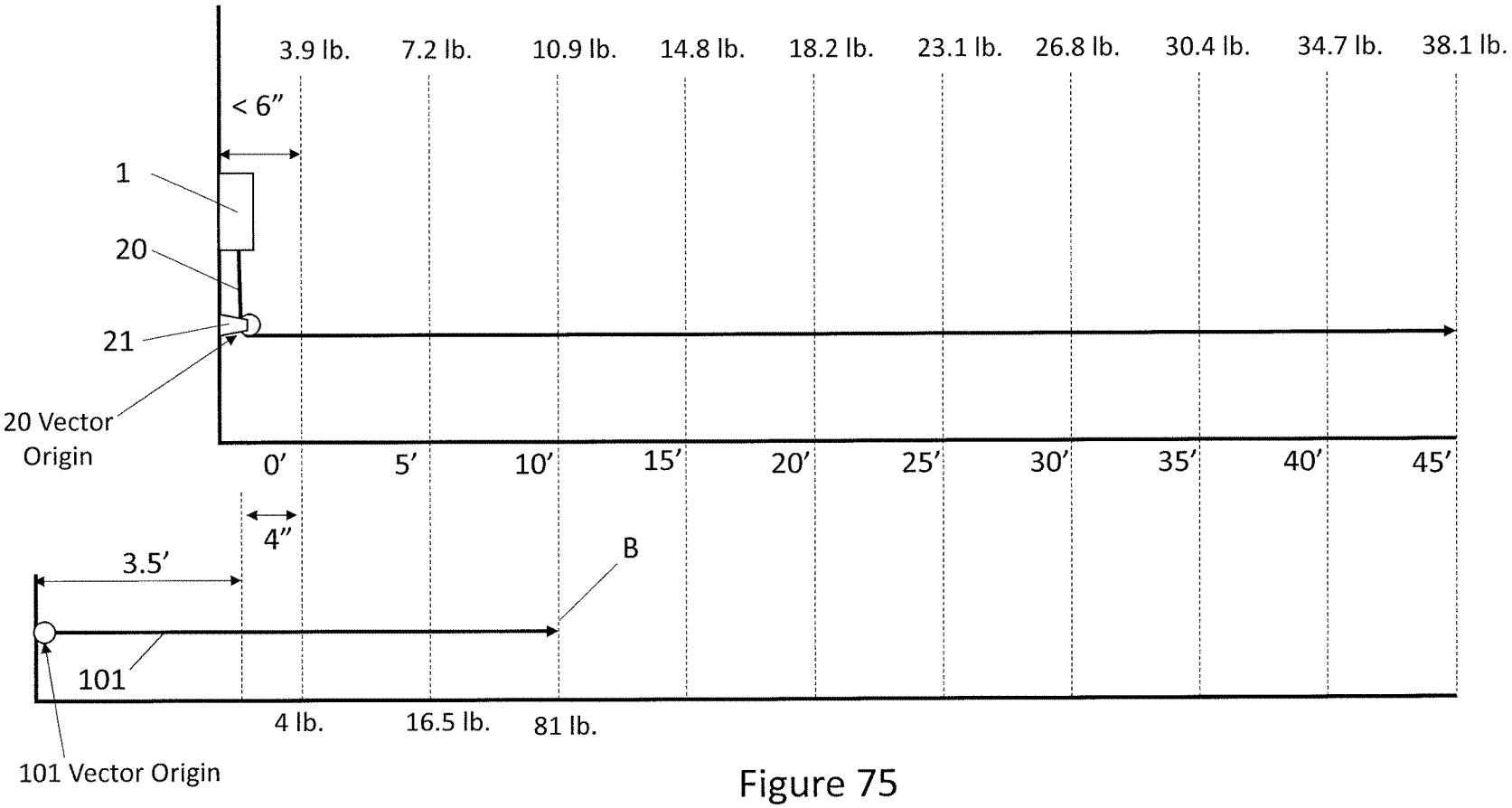
FIG. 75 illustrates the resistance provided by the elastic band
Figure 76:
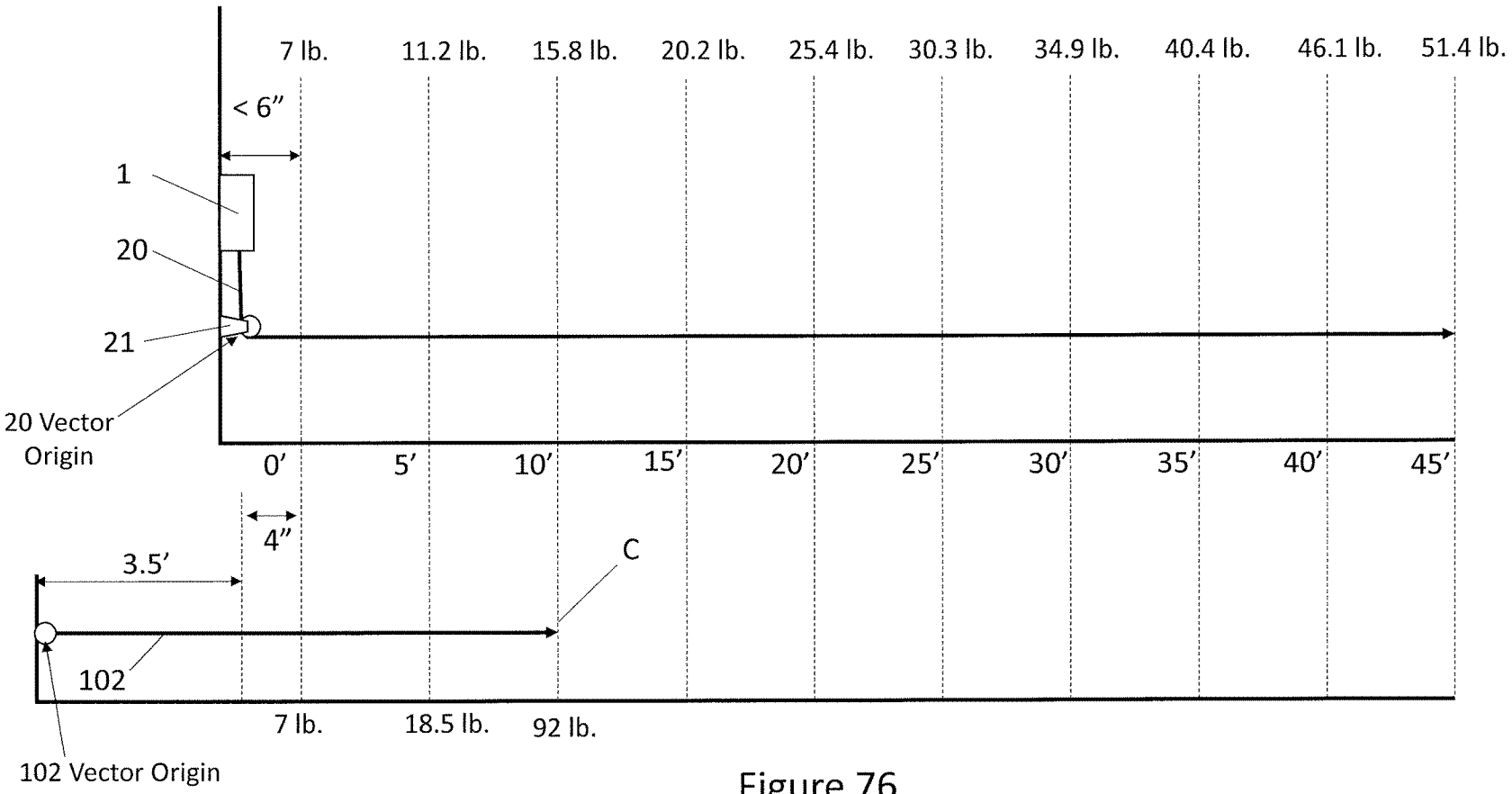
FIG. 76 illustrates the resistance provided by the elastic band
Figure 77:
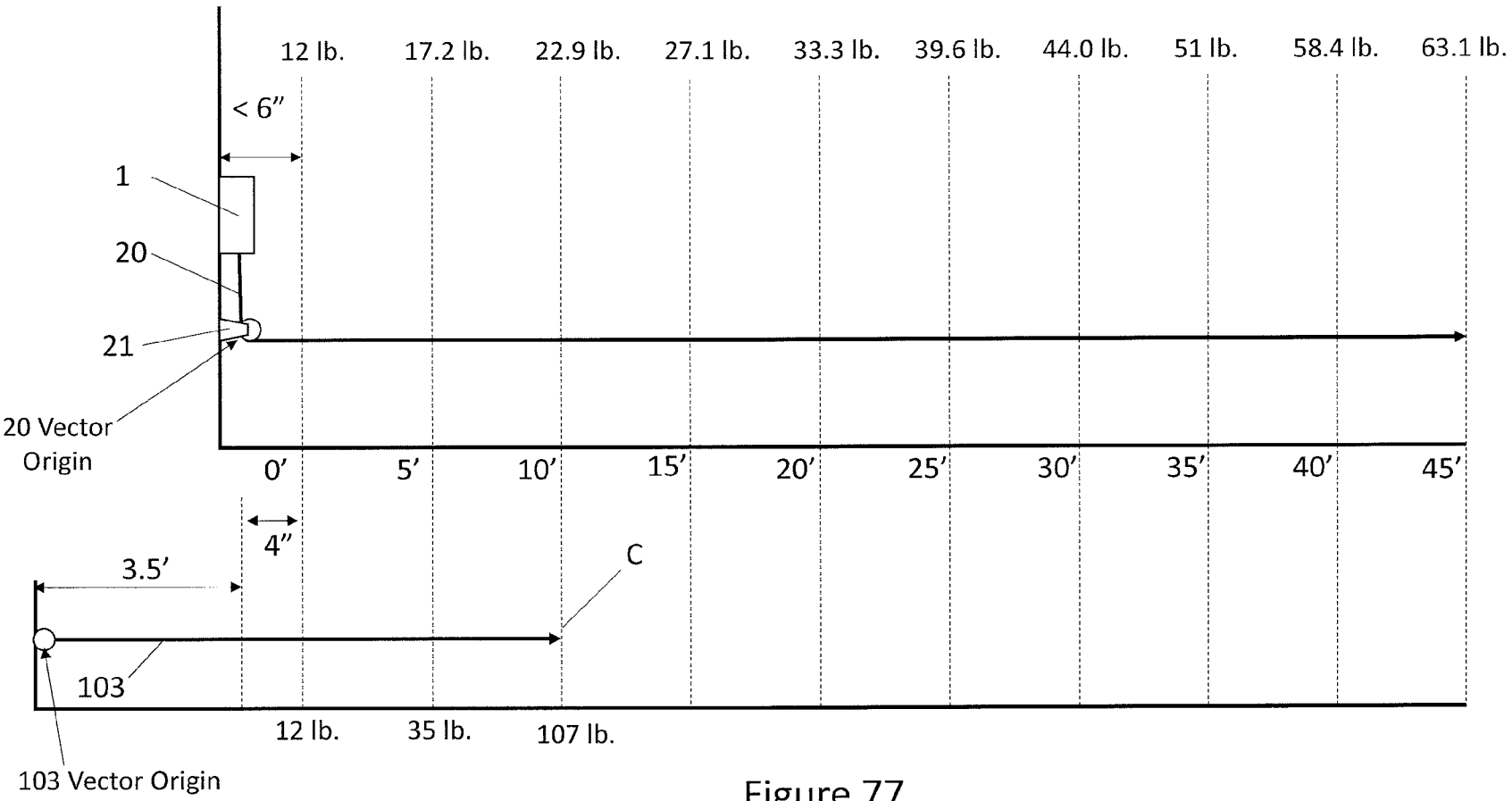
FIG. 77 illustrates the resistance provided by the elastic band
Figure 78:
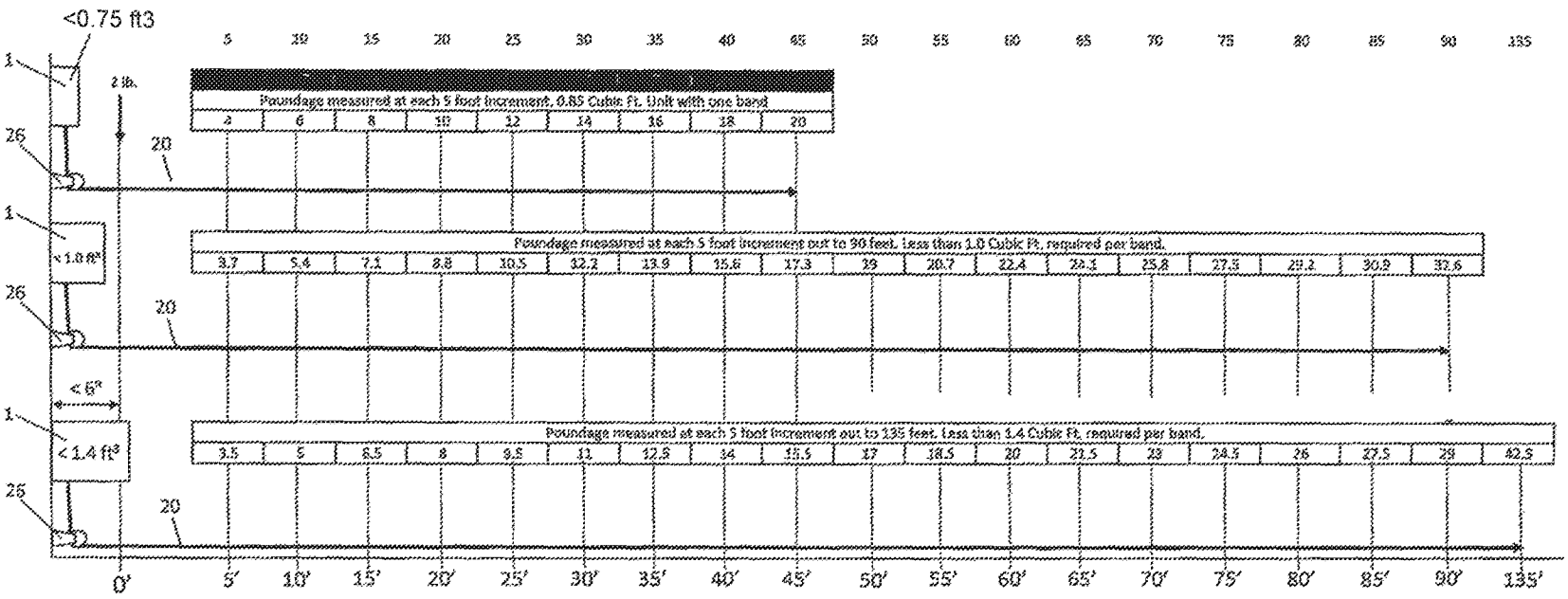
FIG. 78 illustrates the applied resistance at various distances
Figure 79:
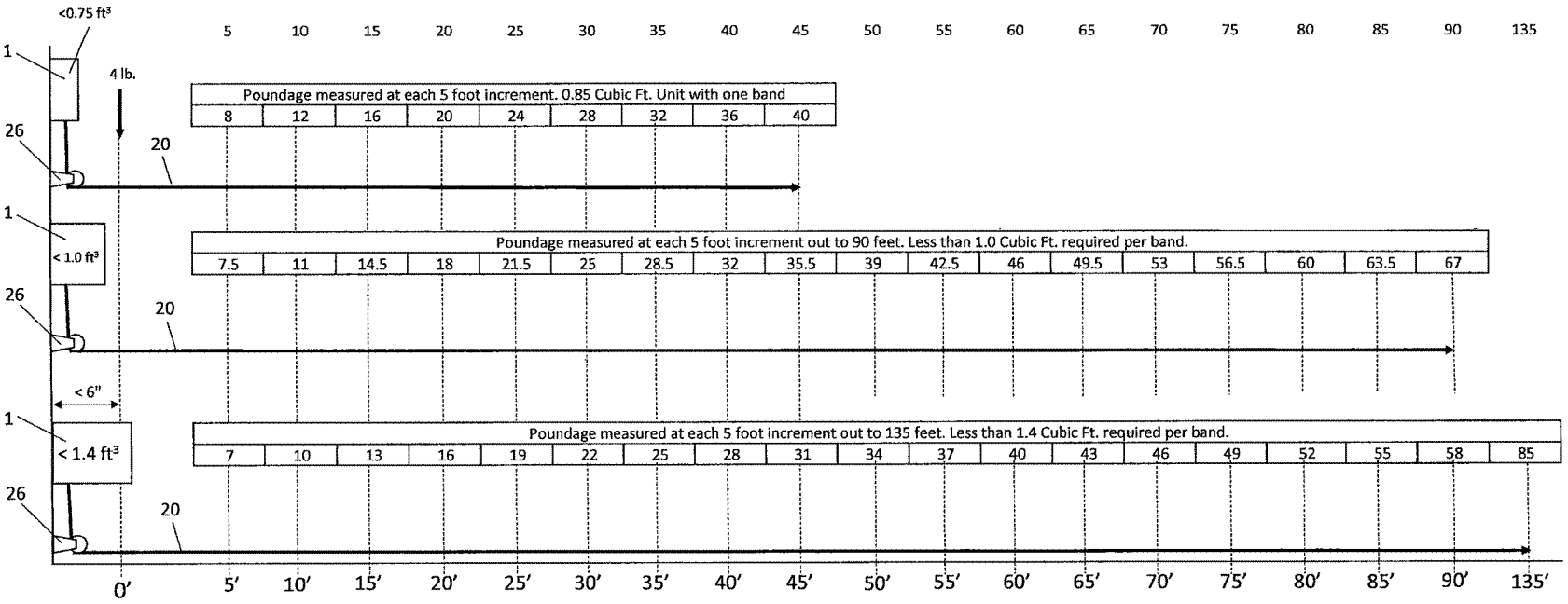
FIG. 79 illustrates the applied resistance at various distances
Figure 80:
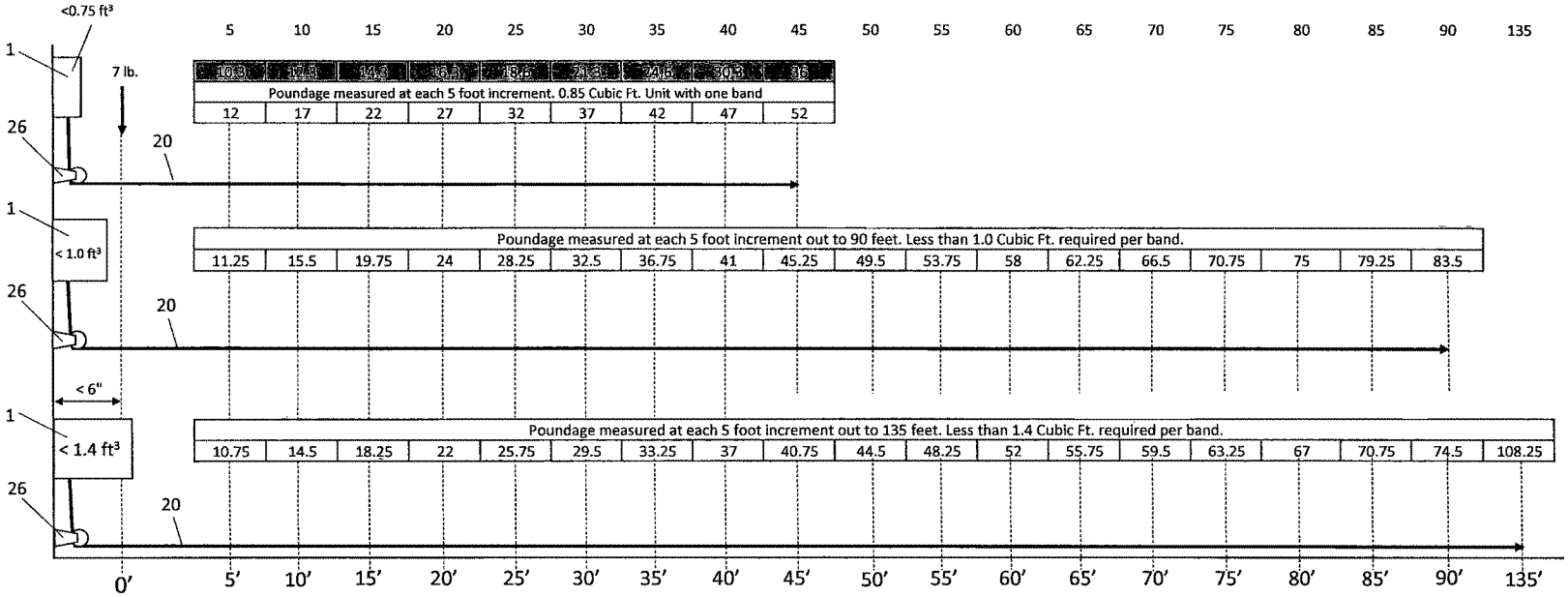
FIG. 80 illustrates the applied resistance at various distances
Figure 81:
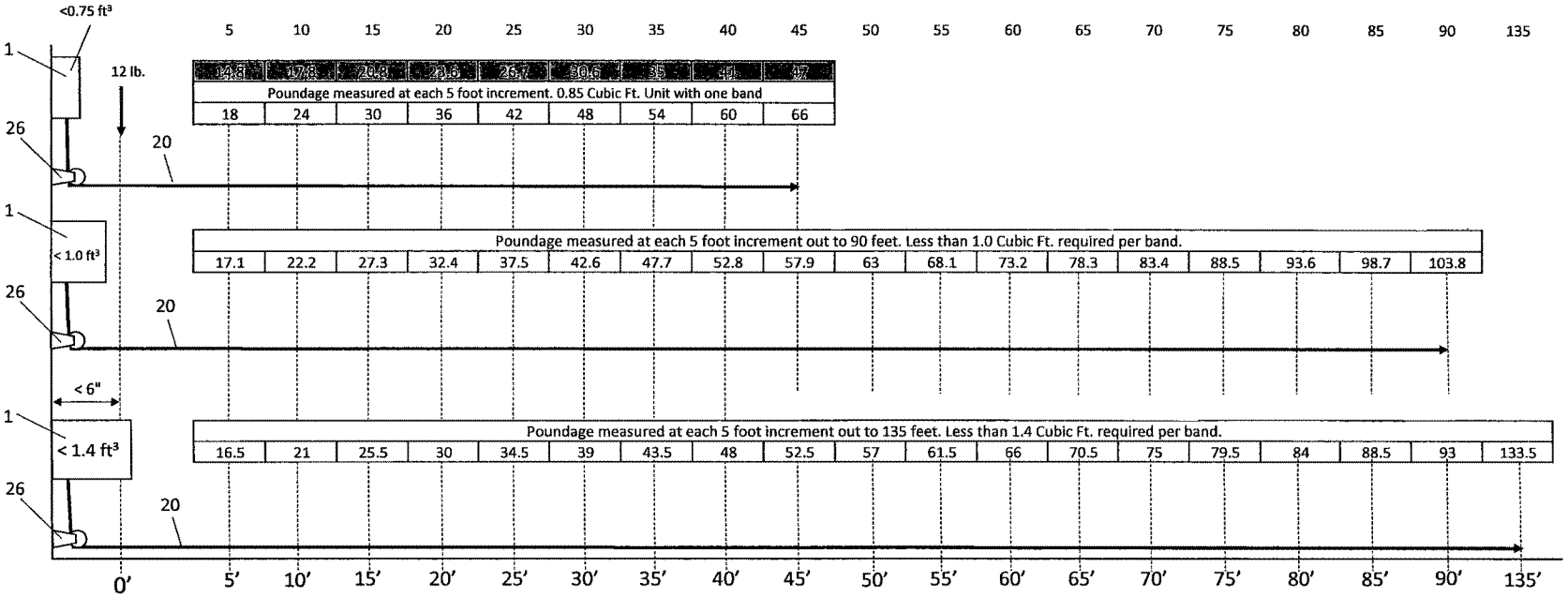
FIG. 81 illustrates the applied resistance at various distances

As discussed above, a major deficiency in prior art elastic band training apparatus is the unacceptable increase in resistance provided by the elastic band per distance that the band is stretched from its slack state. According to one embodiment of the present disclosure, an apparatus may comprise one or more elastic bands that provide a resistance that increases less than 10% over each five foot increment from a distance starting at one-half foot out to a distance of 135 feet or more. FIGS. 74-77 illustrate the resistance provided by the elastic band 20 per distance from the origin of the training vector provided by the band. As illustrated, each training vector provided by band 20 originates from VOAM 21. In each of the figures, the resistance characteristics of band 20 is compared to a band of equal diameter having a length of 3.5 feet. For the band 20, the zero distance point is 6 inches from the structure holding VOAM 21. For bands 100,101,102,103 (each having a length of 3.5 feet), the zero distance point is 46 inches from the origin of the vector provided by band 100,101,102,103. In FIG. 74, the band 20 and band 100 each have a diameter of 3/16 inches. In FIG. 75, the band 20 and band 101 each have a diameter of 1/4 inches. In FIG. 76, the band 20 and band 102 each have a diameter of 5/16 inches. In FIG. 77, the band 20 and band 103 each have a diameter of 3/8 inches.

Another important aspect of the present disclosure is the portability of the training apparatus having the capability of providing the desired resistance over distance. The portability of the apparatus is determined in part by the volume of the module 1. The module 1 includes the base structure 2 which carries the pulley assemblies. The cover 10 encloses the pulley assemblies to form a rectangular module. In one embodiment, the module 1 has a volume of 0.81 $ft^3$ and can carry a pair of elastic bands, each having a length of 28 ft. and a diameter ranging from 3/16 inches to ½ inch.

In one aspect of the present disclosure, the size of the training apparatus may be determined by inputting certain parameters. The input parameters include:

a) Resistance Band Diameter ($B_{Dia}$) in inches–Input range 0.1875" to 0.5"

b) Desired Unit Training Distance in Feet ($TR_{ft.}$)–Input range=10 to 135 feet c) Distance Stretched ($D_{Stretched}$) in feet–Input Range 0<Dstretched<TRft.

Certain intermediate parameters may then be determined:

$$\mathrm{Ref}_{LB}@6''=[682.667(B\mathrm{Dia3})-384.0(B\mathrm{Dia2})+101.333(B\mathrm{Dia})-8.0] \quad \text{a)}$$

Each band diameter used in the module must be set to a reference resistance level specific to that band diameter within 6 inches of the Module support structure. This set point establishes our zero foot reference point.

$$R_{mod}=[0.0000000211(TR_{ft.}4)-0.00000873(TR_{ft.}3)+0.001289(TR_{ft.}2)-0.081912(TR_{ft.})+2.78441] \quad \text{b)}$$

This equation determines an elastic coefficient modifier which modifies the elastic properties of each band diameter as the desired training distance is increased and more cordage is integrated into the resistance module.

The volume of the training apparatus and applied resistance at a desired training distance may then be determined as follows:

$$V(\mathrm{ft}^3)=0.000000235(TR_{ft.}^3)-0.000081215(TR_{ft.}^2)+0.0180107(TR_{ft.})+0.06892232 \text{ for } (10'<TR\mathrm{ft.}<135') \quad \text{a)}$$

The applied resistance for any given distance stretched over the Desired Training Range ($TR_{ft}$) is a function of Band Diameter ($B_{Dia}$), Distance Stretched ($D_{Stretched}$) in ft., the Set Reference force in lb. within 6" of the module support structure ($\mathrm{Ref}_{LB}@6''$) and the Elastic Coefficient modifier ($R_{Mod}$). Given those inputs the force measured at any point in the Desired Training Range will be less than the value determined by the given equation:

$$R_{Applied}=(136.53333(B_{Dia}^3)-128.0(B_{Dia}^2)+42.67(B_{Dia})-4.0)\times(R_{Mod})\times(D_{Stretched})+\mathrm{Ref}_{LB}@6'' \quad \text{b)}$$

FIGS. 78-81 illustrate the applied resistance at various distances from the reference point for elastic bands of different diameters. The reference point is determined as one half foot from the origin of the training vector provided by the elastic band. The various volumes of the module 1 required to house the elastic cord and pulley assemblies to provide the applied resistance is shown on the figure.

FIG. 52 shows a table illustrating the various parameters of training apparatus determined by the method described above according to one aspect of the present disclosure.

I claim:

1. A training apparatus comprising:

a module having a first end spaced from a second end;

a first plurality of pulleys mounted proximate the first end of said module;

a second plurality of pulleys mounted proximate the second end of said module;

a resistance band having one end anchored to said module and being routed back and forth around respective ones of said first plurality of pulleys and respective ones of said second plurality of pulleys to a free end of said band, said band being routed around the pulleys in a manner to effect rotation of at least two pulleys in each plurality of pulleys in opposite directions when said free end of said band is extracted from said module, wherein at least one of said pulleys comprises a band receiving groove having a width smaller than the relaxed-state diameter of said resistance band and a depth larger than the relaxed-state diameter of said resistance band to thereby inhibit a band received within the groove from rolling.

2. The training apparatus of claim 1 wherein said band is routed around a first one of said first plurality of pulleys to a first one of said second plurality of pulleys to effect rotation of said first ones of said first and second plurality of pulleys in a first direction, the band being routed from said first one of said second plurality of pulleys to a second one of said first plurality of pulleys to a second one of said second plurality of pulleys to effect rotation of said second ones of said first and second plurality of pulleys in a second direction opposite from the first direction.

3. The training apparatus of claim 2 wherein a majority of pulleys among the pulleys in said second plurality of pulleys rotate in the second direction.

4. The training apparatus of claim 2 wherein a majority of pulleys among the pulleys in said first and second plurality of pulleys rotate in the second direction.

5. The training apparatus of claim 1 wherein a majority of pulleys among the pulleys in said first and second plurality of pulleys rotate in the same direction.

6. The training apparatus of claim 1 wherein the anchored end of said band is anchored proximate the second end of said module.

7. The training module of claim 6 wherein the free end of said band is extracted from said module proximate the first end of said module.

8. The training apparatus of claim 1 wherein the pulleys in said first plurality of pulleys rotate about a first common axis and the pulleys in said second plurality of pulleys rotate about a second common axis.

9. The training apparatus of claim 1 wherein the pulleys in said first plurality of pulleys rotate about different parallel axes and the pulleys in said second plurality of pulleys rotate about different parallel axes.

10. The training apparatus of claim 9 wherein each pulley in said first plurality of pulleys is mounted on a first mounting axis and is rotatable about an axis offset from said first mounting axis by a first tilt angle, wherein each pulley in said second plurality of pulleys is mounted on a second common mounting axis and is rotatable about an axis offset from said second common mounting axis at a second tilt angle, and wherein said first and second tilt angles have substantially equal magnitudes and opposing directions.

11. The training apparatus of claim 1 comprising:

a third plurality of pulleys mounted proximate the second end of said module;

a fourth plurality of pulleys mounted proximate the first end of said module;

a second resistance band having one end anchored to said module and being routed back and forth around respective ones of said fourth plurality of pulleys and respective ones of said third plurality of pulleys to a free end of said band, said band being routed around the pulleys in a manner to effect rotation of at least two pulleys in each plurality of pulleys in opposite directions when said free end of said band is extracted from said module.

12. The training apparatus of claim 11 wherein said first plurality of pulleys and said fourth plurality of pulleys are contained in a first housing mounted proximate the first end of said module and said second plurality of pulleys and said third plurality of pulleys are contained in a second housing mounted proximate the second end of said module.

13. The training apparatus of claim 1 comprising a swivel assembly connected to the free end of said resistance band, said swivel assembly comprising a housing and at least one ringlet carried by a rotatable shaft coupled to said housing by a bearing assembly.

14. A training apparatus comprising:

a module having a first end spaced from a second end;

a first plurality of pulleys mounted proximate the first end of said module;

a second plurality of pulleys mounted proximate the second end of said module;

a resistance band having one end anchored to said module and being routed back and forth around respective ones of said first plurality of pulleys and respective ones of said second plurality of pulleys to a free end of said band, said band being routed around the pulleys in a manner to effect rotation of at least two pulleys in each plurality of pulleys in opposite directions when said free end of said band is extracted from said module;

wherein the pulleys in said first plurality of pulleys rotate about different parallel axes and the pulleys in said second plurality of pulleys rotate about different parallel axes;

wherein each pulley in said first plurality of pulleys is mounted on a first mounting axis and is rotatable about an axis offset from said first mounting axis by a first tilt angle, wherein each pulley in said second plurality of pulleys is mounted on a second common mounting axis and is rotatable about an axis offset from said second common mounting axis at a second tilt angle, and wherein said first and second tilt angles have substantially equal magnitudes and opposing directions; and wherein each pulley defines a band receiving groove having a centerline, the centerline of the groove on the side opposite the first tilt angle of two or more pulleys in said first plurality of pulleys being aligned with the centerline of the groove on the side opposite the second tilt angle of two or more respective pulleys in said second plurality of pulleys, the centerline of the groove on the side of the second tilt angle of two or more pulleys in said second plurality of pulleys being aligned with the centerline of the groove on the side of the first tilt angle of two or more respective pulleys in said first plurality of pulleys.

15. A training apparatus comprising:

a module having a first end spaced from a second end;

a first plurality of pulleys mounted proximate the first end of said module, each pulley in said first plurality of pulleys being mounted on a first common mounting axis and having a rotating axis offset from said first common mounting axis at a first tilt angle;

a second plurality of pulleys mounted proximate the second end of said module, each pulley in said second plurality of pulleys being mounted on a second common mounting axis and having a rotating axis offset from said second common mounting axis at a second tilt angle; and a resistance band having one end anchored to said module and being routed back and forth around respective ones of said first plurality of pulleys and respective ones of said second plurality of pulleys to a free end of said band, wherein said first and second tilt angles have substantially equal magnitudes and opposing directions, and wherein at least one of said pulleys comprises a band receiving groove having a width smaller than the relaxed-state diameter of said resistance band and a depth larger than the relaxed-state diameter of said resistance band to thereby inhibit a band received within the groove from rolling.

16. The training apparatus of claim 15 wherein said band is routed around the pulleys in a manner to effect rotation of at least two pulleys in each plurality of pulleys in opposite directions when said free end of said band is extracted from said module.

17. A training apparatus comprising:

a module having a first end spaced from a second end;

a first plurality of pulleys mounted proximate the first end of said module, each pulley in said first plurality of pulleys being mounted on a first common mounting axis and having a rotating axis offset from said first common mounting axis at a first tilt angle;

a second plurality of pulleys mounted proximate the second end of said module, each pulley in said second plurality of pulleys being mounted on a second common mounting axis and having a rotating axis offset from said second common mounting axis at a second tilt angle; and a resistance band having one end anchored to said module and being routed back and forth around respective ones of said first plurality of pulleys and respective ones of said second plurality of pulleys to a free end of said band, wherein said first and second tilt angles have substantially equal magnitudes and opposing directions, wherein each pulley defines a band receiving groove having a centerline, the centerline of the groove on the side opposite of the first tilt angle of two or more pulleys in said first plurality of pulleys being aligned with the centerline of the groove on the side opposite the second tilt angle of two or more respective pulleys in said second plurality of pulleys, the centerline of the groove on the side of the second tilt angle of two or more pulleys in said second plurality of pulleys being aligned with the centerline of the groove on the side of the first tilt angle of two or more respective pulleys in said first plurality of pulleys.

18. A training apparatus comprising:

a module;

a resistance band having a predetermined relaxed-state diameter;

a plurality of pulleys, each pulley comprising a band receiving groove for receiving said resistance band therein and routing said resistance band on said module, at least one of said pulleys comprising a band receiving groove having a width and a depth dimensioned relative to the relaxed-state diameter of said resistance band to thereby inhibit the band received within the groove from rolling, wherein the at least one of said pulleys comprises a band receiving groove having a width smaller than the relaxed-state diameter of said resistance band, and wherein the at least one of said pulleys comprises a band receiving groove having a depth at least as large as the relaxed-state diameter of said resistance band.

19. The training apparatus of claim 18 comprising a swivel assembly connected to a free end of said resistance band, said swivel assembly comprising a housing and at least one ringlet carried by a rotatable shaft coupled to said housing by a bearing assembly, said ringlet being coupled to the free end of said resistance band.

20. The training apparatus of claim 19 wherein said swivel assembly further comprises a second ringlet carried by a second rotatable shaft coupled to said housing by a bearing assembly, said second ringlet being adapted for attachment to a harness worn by a trainee.

* * * * *